US011365508B2

(12) United States Patent
Kim et al.

(10) Patent No.: US 11,365,508 B2
(45) Date of Patent: Jun. 21, 2022

(54) WASHING MACHINE HAVING A MANUAL WASHING UNIT

(71) Applicant: SAMSUNG ELECTRONICS CO., LTD., Suwon-si (KR)

(72) Inventors: Min Hyung Kim, Seoul (KR); Yong Kwon Won, Suwon (KR); Jun Ho Kim, Suwon (KR); Hyeon Cheol Kim, Seoul (KR); Sung Yong Eun, Suwon (KR); Goan Su Jung, Yeosu (KR); Young Sun Shin, Seoul (KR); Mitsuhiro Shigeri, Yokohama (JP); Hyun Mook Kim, Osan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/654,993

(22) Filed: Oct. 16, 2019

(65) Prior Publication Data

US 2020/0048811 A1 Feb. 13, 2020

Related U.S. Application Data

(63) Continuation of application No. 14/729,150, filed on Jun. 3, 2015, now Pat. No. 10,450,687, which is a (Continued)

(30) Foreign Application Priority Data

Feb. 25, 2014 (KR) ..... 10-2014-0022198
Mar. 7, 2014 (KR) ..... 10-2014-0027423
Jan. 22, 2015 (KR) ..... 10-2015-0010520

(51) Int. Cl.
*D06F 39/14* (2006.01)
*D06F 29/00* (2006.01)
(Continued)

(52) U.S. Cl.
CPC ..... *D06F 39/14* (2013.01); *D06F 29/00* (2013.01); *D06F 31/00* (2013.01); *D06F 1/04* (2013.01)

(58) Field of Classification Search
CPC ..... D06F 29/00; D06F 31/00; D06F 39/12; D06F 1/04; D06F 39/14
(Continued)

(56) References Cited

U.S. PATENT DOCUMENTS 1,240,037 A 9/1917 Ellis
3,026,699 A * 3/1962 Rhodes ..... D06F 29/00 68/237
(Continued)

FOREIGN PATENT DOCUMENTS

JP 58-8484 1/1983
JP 6-41688 6/1994
(Continued)

OTHER PUBLICATIONS

Korean Office Action dated May 27, 2015 in corresponding Korean Patent Application No. 10-2015-0046529.
(Continued)

*Primary Examiner* — Michael E Barr
*Assistant Examiner* — Thomas Bucci
(74) *Attorney, Agent, or Firm* — Staas & Halsey LLP

(57) ABSTRACT

Disclosed is a washing machine capable of improving the efficiency of washing and product quality by improving a pivoting structure of a door assembly having a door and an auxiliary washing unit forming an auxiliary washing space. Also, the door and the auxiliary washing unit may be coupled by a locking part so that a user can open and close the door assembly conveniently when manual washing is not needed. When manual washing is needed, the user may
(Continued)

release a locked state of the locking part to move the door and the auxiliary washing unit separately.

18 Claims, 46 Drawing Sheets

Related U.S. Application Data continuation of application No. PCT/KR2015/000848, filed on Jan. 27, 2015.

(51) Int. Cl.
*D06F 31/00* (2006.01)
*D06F 1/04* (2006.01)

(58) Field of Classification Search
USPC ..... 68/27, 13 R, 196, 12.26, 4
See application file for complete search history.

(56) References Cited

U.S. PATENT DOCUMENTS

| | | | | |
|---|---|---|---|---|
| 3,039,284 | A | 6/1962 | Shelton et al. | |
| 3,039,286 | A | 6/1962 | Shelton | |
| 3,209,560 | A * | 10/1965 | Shelton | D06F 13/00 68/4 |
| 3,309,903 | A | 3/1967 | Despins | |
| 3,575,020 | A | 4/1971 | Hubbard | |
| 3,760,612 | A * | 9/1973 | Bochan | D06F 39/02 68/17 R |
| 3,908,412 | A | 9/1975 | De Hedouville | |
| 5,253,493 | A * | 10/1993 | Ohashi | D06F 29/00 68/4 |
| 5,291,758 | A * | 3/1994 | Lee | D06F 37/28 68/196 |
| 5,315,727 | A * | 5/1994 | Lee | D06F 39/008 68/180 |
| 5,857,363 | A | 1/1999 | Jung et al. | |
| 6,161,401 | A | 12/2000 | Wunderlich et al. | |
| 6,216,498 | B1 | 4/2001 | Wright et al. | |
| 6,327,729 | B1 | 12/2001 | Wunderlich et al. | |
| 6,353,954 | B1 | 3/2002 | Dunsbergen et al. | |
| 7,296,443 | B2 | 10/2007 | Usherovich et al. | |
| 8,225,804 | B2 | 7/2012 | Publ | |
| 8,763,619 | B2 | 7/2014 | Lele et al. | |
| 9,404,213 | B2 | 8/2016 | Kappler | |
| 9,725,841 | B2 | 8/2017 | Lee et al. | |
| 2002/0072194 | A1 | 6/2002 | Nakao et al. | |
| 2002/0134177 | A1 | 9/2002 | Taekuchi et al. | |
| 2004/0144138 | A1 | 7/2004 | Takeuchi et al. | |
| 2004/0231370 | A1 | 11/2004 | Cheo et al. | |
| 2005/0016073 | A1 | 1/2005 | Petta et al. | |
| 2005/0056059 | A1 * | 3/2005 | Usherovich | D06F 39/14 68/19 |
| 2005/0072194 | A1 * | 4/2005 | Ryohke | D06F 34/20 68/3 R |
| 2005/0274154 | A1 | 12/2005 | Johnson | |
| 2006/0156763 | A1 * | 7/2006 | Vecchi | D06F 39/14 68/13 A |
| 2011/0018408 | A1 | 1/2011 | Cho et al. | |
| 2011/0050060 | A1 | 3/2011 | Kim et al. | |

FOREIGN PATENT DOCUMENTS

| | | |
|---|---|---|
| JP | 2002-273092 | 9/2002 |
| KR | 1999-016037 | 3/1999 |
| KR | 10-0220751 | 6/1999 |
| KR | 2000-0013789 | 7/2000 |
| KR | 2003-0055953 | 7/2003 |
| KR | 10-2009-0100154 | 9/2009 |
| KR | 20-2013-0001857 | 3/2013 |

OTHER PUBLICATIONS

International Search Report dated May 22, 2015 in corresponding International Patent Application No. PCT/KR2015/000848.
Mexican Office Action dated Feb. 11, 2019, in corresponding Mexican Patent Application No. MX/a/2015/010627.
Malaysian Office Action dated Jan. 9, 2019, in corresponding Malaysian Patent Application No. PI 2015702567.
Mexican Office Action dated Aug. 27, 2018, in corresponding Mexican Patent Application No. MX/a/2015/010627.
European Office Action dated May 19, 2017, in corresponding European Patent Application No. 15 736 162.7.
Chinese Office Action dated Feb. 6, 2017, in corresponding Chinese Patent Application No. 201580000410.9.
South African Acceptance of Complete Specification accpeted Oct. 31, 2016, in corresponding South African Patent Application No. 2015/07150.
European Search Report dated Oct. 31, 2016, in corresponding European Patent Application No. 15 736 162.7.
European Office Action dated Nov. 22, 2016, in corresponding European Patent Application No. 15 736 162.7.
Canadian Notice of Allowance dated Dec. 14, 2016, in corresponding Canadian Patent Application No. 2,898,050.
Chinese Office Action dated Aug. 3, 2016 in corresponding Chinese Patent Application No. 201580000410.9.
Notice of Allowance dated Dec. 22, 2015 in related U.S. Appl. No. 14/716,076.
Corrected Notice of Allowance dated Mar. 18, 2016 in related U.S. Appl. No. 14/716,076.
Korean Office Action dated Sep. 17, 2015 in corresponding Korean Patent Application No. 10-2015-0046529.
First Action Interview Pilot Program Pre-Interview Communication dated Sep. 23, 2015 in related U.S. Appl. No. 14/716,076.
Office Action dated Jun. 15, 2017 in related U.S. Appl. No. 14/729,150.
Office Action dated Aug. 25, 2017 in related U.S. Appl. No. 14/729,150.
Office Action dated Mar. 13, 2018 in related U.S. Appl. No. 14/729,150.
Office Action dated May 24, 2018 in related U.S. Appl. No. 14/729,150.
Office Action dated Feb. 6, 2019 in related U.S. Appl. No. 14/729,150.
Notice of Allowance dated Jun. 13, 2019 in related U.S. Appl. No. 14/729,150.
Philippines Office Action dated Nov. 11, 2019, issued in corresponding Philippines Patent Application No. 1/2015/501629.
Korean Office Action dated Feb. 14, 2021, in corresponding Korean Patent Application No. 10-2015-0010520.
Office Action dated Oct. 19, 2021, in Korean Application No. 10-2015-0010520.
Office Action dated Aug. 23, 2021, in Korean Application No. 10-2015-0010520.

* cited by examiner

WASHING MACHINE HAVING A MANUAL WASHING UNIT

CROSS-REFERENCE TO RELATED APPLICATIONS

This application is a continuation of U.S. patent application Ser. No. 14/729,150, filed Jun. 3, 2015, which is a continuation of International Application PCT/KR2015/000848, filed Jan. 27, 2015, and claims foreign priority to Korean application 10-2015-0010520 filed Jan. 22, 2015, Korean application 10-2014-0027423 filed Mar. 7, 2014, and Korean application 10-2014-0022198 filed Feb. 25, 2014, the disclosures of which are incorporated herein by reference in their entireties.

BACKGROUND

1. Field

Embodiments relate to a washing machine, and more particularly, to a fully automatic washing machine having a manual washing vessel at an upper part thereof.

2. Description of the Related Art

A washing machine is a machine that washes laundry using electric power, and generally includes an outer tub in which washing water is stored, an inner tub that is rotatably installed in the outer tub, and a pulsator that is rotatably provided at the bottom of the inner tub. The washing machine forms a washing space by the outer tub and the inner tub, and washes laundry by changing streams of water.

The washing machine can be classified as a stirring type, a whirlpool type, or a drum type according to a washing method. A stirring type washing machine washes laundry by rotating an agitator standing in the center of a tub to the left and right. A whirlpool type washing machine washes laundry using frictional force between laundry and streams of water generated by rotating a pulsator in the shape of a disk mounted at the bottom of an inner tub to the left and right. A drum type washing machine washes laundry by rotating a drum with a plurality of lifters protruding along the inside surface after water and detergent are put into the drum.

A washing machine can be classified as a top loading washing machine or a front loading washing machine according to its shape. In a top loading washing machine, laundry can be put into an inner tub through an opening formed in the top surface. In a front loading washing machine, laundry can be put into an inner tub through an opening formed in one lateral surface. Generally, the stirring type washing machine and the whirlpool type washing machine are embodied as top loading washing machines, and the drum type washing machine is embodied as a front loading washing machine.

However, it is difficult to completely remove hard dirt or small stains from laundry through the washing process of the washing machine according to the relate art. Since the washing machine according to the related art has no washing space for manual washing or separate washing other than the washing space defined by the outer tub and the inner tub, laundry with hard dirt or small stains needs to be hand-washed or separately washed in another place before being put into the washing machine. In this case, the manual washing or separate washing consumes additional washing water.

If a washing machine allows manual washing or separate washing, no additional washing space is needed, and washing water can be saved since washing water used in manual washing or separate washing can be reused.

SUMMARY

An aspect of an embodiment is to provide a washing machine having a manual washing vessel in which a space for manual washing is formed.

In accordance with an aspect of an embodiment, there is provided a washing machine including: a main body having an opening at one side and including a main washing space; a door configured to be pivotable over the opening; an auxiliary washing unit forming an auxiliary washing space partitioned from the main washing space and allowing auxiliary washing independently; and a hinge pin unit configured to enable the auxiliary washing unit to be separated from the door.

The hinge pin unit may be disposed on a pivot axis of the auxiliary washing unit so that the auxiliary washing unit is pivotably coupled to the door.

The hinge pin unit may separate the auxiliary washing unit from the door through sliding movement.

The auxiliary washing unit may include: a unit body forming the auxiliary washing space; and an auxiliary pivot part protruding from the unit body and configured to pivot about the pivot axis of the auxiliary washing unit to prevent pivotal movement of the unit body from being interfered with by the door, and the hinge pin unit may be disposed at the auxiliary pivot part.

The hinge pin unit may include a body; a hinge pin extending from one side of the body and configured to be inserted into the door; and a sliding part inclined with respect to the longitudinal direction of the body and configured to restrict movement of the hinge pin in a direction in which the hinge pin exits the door, and the sliding part may be pressed remove the hinge pin unit from the door.

The hinge pin unit may further include a catching part extending from the body at the other side of the body, and configured to restrict movement of the hinge pin in the direction in which the hinge pin is inserted into the door.

In accordance with another aspect of an embodiment, there is provided a washing machine including: a main body having an opening; an outer tub disposed inside the main body and configured to store washing water; an inner tub having a main washing space in which laundry is washed and configured to be rotatable inside the outer tub; a door assembly including a door configured to be pivotable to open and close the opening, and an auxiliary washing unit having an auxiliary washing space and configured to be pivotable in the inside of the door, and a damping unit disposed on pivot axes of the door and the auxiliary washing unit to damp pivotal movement of the door or the auxiliary washing unit, the door assembly being disposed pivotably over the opening.

The damping unit may include a door damping unit configured to damp pivotal movement of the door and disposed on the pivot axis of the door, and an auxiliary damping unit configured to damp pivotal movement of the auxiliary washing unit and disposed on the pivot axis of the auxiliary washing unit.

The door damping unit and the auxiliary damping unit may operate independently.

The door damping unit may be opposite to the auxiliary damping unit with the door and the auxiliary washing unit interposed therebetween.

The door damping unit may include a door damper fixed to the main body and configured to generate damping power; and a door damper shaft connected to the door damper, configured to receive the damping power from the door damper, and fixed to the door.

The door damper shaft may include a first door damper shaft connected to the door damper and disposed in the axial direction of the pivot axis of the door, and a second door damper shaft bent from the first door damper shaft, fixed to the inner side surface of the door, and disposed in a radial shape with respect to the pivot axis of the door.

The auxiliary damping unit may include an auxiliary damper fixed to the main body and configured to generate damping power, and an auxiliary damper shaft connected to the auxiliary damper, configured to receive damping power from the auxiliary damper, and fixed to the auxiliary washing unit to pivot together with the auxiliary washing unit.

The auxiliary washing unit may include: a unit body forming the auxiliary washing space; and an auxiliary pivot part protruding from the unit body and configured to pivot about the pivot axis of the auxiliary washing unit to prevent pivotal movement of the unit body from being interfered by the door, and at least one part of the auxiliary damper shaft may be fixed to the auxiliary pivot part.

The damping unit may be one of a spring damper and an oil damper.

The auxiliary washing unit may be configured to be pivotable independently from the door.

The pivot axis of the door may be the same as the pivot axis of the auxiliary washing unit.

In accordance with another aspect of an embodiment, there is provided a washing machine including: a main body having an opening; an outer tub disposed inside the main body and configured to store washing water; an inner tub having a main washing space in which laundry is washed and configured to be rotatable inside the outer tub; a door assembly comprising a door configured to be pivotable to open and close the opening, and an auxiliary washing unit having an auxiliary washing space and configured to be pivotable on the same pivot axis as the door in the inside of the door, the door assembly disposed over the opening; and a pivot shaft disposed on the pivot axis and configured to enable the door assembly to pivot.

The pivot shaft may be configured to penetrate the door and the auxiliary washing unit.

The pivot shaft may include: a door restricting part configured to restrict pivotal movement of the door; and an auxiliary restricting part extending from the door restricting part in the axial direction of the pivot axis and configured to restrict pivotal movement of the auxiliary washing unit.

The door restricting part and the auxiliary restricting part may respectively restrict pivotal movement of the door and the auxiliary washing unit independently.

In accordance with another aspect of an embodiment, there is provided a washing machine including: a main body having an opening; an outer tub disposed inside the main body and configured to store washing water; an inner tub having a main washing space in which laundry is washed and configured to be rotatable inside the outer tub; and a door assembly comprising a door configured to be pivotable to open and close the opening, and an auxiliary washing unit forming an auxiliary washing space, configured to be pivotable in the inside of the door, and configured to be separable from the door, the door assembly being disposed over the opening.

The washing machine may further include a pin holder disposed on a pivot axis of the auxiliary washing unit such that the auxiliary washing unit is pivotably coupled to the door, the pin holder being configured to enable the auxiliary washing unit to be separated from the door.

The pin holder may include: a holder main body fixed to the auxiliary washing unit; and a moving protrusion configured to move forward or backward from the holder main body in the axial direction of the pivot axis of the auxiliary washing unit, and selectively pivotably coupled to the door.

The moving protrusion may move between a protruding position at which the moving protrusion protrudes from the holder main body so that the auxiliary washing unit is pivotably coupled to the door, and an inserted position at which at least one part of the moving protrusion is inserted into the holder main body so that the auxiliary washing unit is separated from the door, and the pin holder may include an elastic member disposed on a moving path of the moving protrusion so that the moving protrusion returns to the protruding position from the inserted position.

The auxiliary washing unit may include: a unit body forming the auxiliary washing space; and an auxiliary pivot part protruding from the unit body and configured to pivot about the pivot axis of the auxiliary washing unit to prevent pivotal movement of the unit body from being interfered by the door, and the pin holder may be disposed at the auxiliary pivot part.

A pivot axis of the door may be the same as the pivot axis of the auxiliary washing unit.

In accordance with another aspect of an embodiment, there is provided a washing machine including: a main body having an opening; an outer tub disposed inside the main body and configured to store washing water; an inner tub having a main washing space in which laundry is washed and configured to be rotatable inside the outer tub; and a door assembly comprising a door configured to open and close the opening, and an auxiliary washing unit forming an auxiliary washing space for manual washing, and disposed in the inside of the door, the door assembly being pivotably disposed over the opening, wherein the door assembly is hinge-coupled to the main body adjacent to one of side of the opening so as to be pivotable in a left-right direction with respect to the main body.

In accordance with another aspect of an embodiment, there is provided a washing machine including: a main body having an opening in an upper part thereof; a tub disposed inside the main body and forming a main washing space; and a door assembly configured to be pivotable over the opening, wherein the door assembly includes a first door forming an auxiliary washing space, and a second door configured to cover the auxiliary washing space, wherein the first door includes at least one first door-main body coupling part configured to be hinge-coupled to the main body, and the second door includes at least one second door-main body coupling part configured to be hinge-coupled to the main body.

In accordance with another aspect of an embodiment, there is provided a washing machine including: a main body having an opening in an upper part thereof; a tub disposed inside the main body and forming a main washing space; and a door assembly disposed to be pivotable over the opening, wherein the door assembly includes a first door forming an auxiliary washing space, and a second door configured to cover the auxiliary washing space, wherein the first door includes at least one first door-door coupling part configured to be hinge-coupled to the second door, and the second door includes at least one second door-door coupling part configured to be hinge-coupled to the first door-door coupling part and at least one second door-main body coupling part configured to be hinge-coupled to the main body.

In accordance with another aspect of an embodiment, there is provided a washing machine including: a main body having an opening in an upper part thereof; a tub disposed inside the main body and forming a main washing space; and a door assembly configured to be pivotable over the opening, wherein the door assembly includes a first door forming an auxiliary washing space, and a second door configured to cover the auxiliary washing space, wherein the first door includes at least one first door-main body coupling part configured to be hinge-coupled to the main body, and at least one first door-door coupling part configured to be hinge-coupled to the second door, wherein the second door includes at least one second door-door coupling part configured to be hinge-coupled to the first door-door coupling part.

In accordance with another aspect of an embodiment, there is provided a washing machine including: a main body having an opening; and a door assembly disposed over the opening, wherein the door assembly includes: a door configured to open and close the opening; an auxiliary washing unit disposed inside the door and forming an auxiliary washing space; and a locking part configured to lock the door with the auxiliary washing unit.

When the locking part locks the door with the auxiliary washing unit, the door and the auxiliary washing unit may be pivotable together.

The locking part may be installed in one of the door and the auxiliary washing unit, and a catching part for catching the locking part may be installed in the other of the door and the auxiliary washing unit.

The locking part may be pressed by an elastic member and maintained in a state in which the locking part is caught by the catching part as long as no external force is applied.

The locking part may be installed in the door, and the catching part may be installed in the auxiliary washing unit.

A through hole which the locking part penetrates may be formed in the auxiliary washing unit.

The catching part may be disposed below the through hole and catch the locking part passing through the through hole.

The door assembly may include a handle part configured to operate the door or the auxiliary washing unit.

The handle part may include a door handle part formed in the door, and an auxiliary handle part formed in the auxiliary washing unit.

A length of the auxiliary handle part may be longer than a length of the door handle part.

The handle part may be provided in the auxiliary washing unit, and the door and the auxiliary washing unit may operate together according to a manipulation of the handle part.

The door and the auxiliary washing unit may be pivotable about the same pivot axis.

The auxiliary washing unit may include an auxiliary water supply opening for supplying washing water to the auxiliary washing space.

The auxiliary washing unit may include an auxiliary drain for discharging washing water stored in the auxiliary washing space.

The auxiliary drain may be configured to discharge washing water stored in the auxiliary washing space when the auxiliary washing unit pivots.

In accordance with another aspect of an embodiment, there is provided a washing machine including: a main body having an opening at one side and a main washing space; a door disposed pivotably over the opening; and an auxiliary washing unit forming an auxiliary washing space partitioned from the main washing space, and allowing a user to perform auxiliary washing independently, the auxiliary washing unit being detachably coupled to the door.

The auxiliary washing unit may be locked with the door by a locking part.

If the door and the auxiliary washing unit are locked by the locking part, the door and the auxiliary washing unit may pivot together to open and close the opening.

If a locked state of the locking part is released, the door or the auxiliary washing unit may be separately pivotable.

If the door is opened and the auxiliary washing unit is positioned to cover the opening, auxiliary washing may be able to be performed.

The door assembly may move to one of a closed position at which the door and the auxiliary washing unit are disposed over the opening, an auxiliary washing position at which the door is opened from the closed position and the opening is covered by the auxiliary washing unit, and an opened position at which the door and the auxiliary washing unit open the opening.

An embodiment has the following effects.

The washing machine according to an embodiment includes an auxiliary washing unit in which auxiliary washing can be performed.

Also, auxiliary washing can be performed independently from an existing washing method to improve washing efficiency.

Also, since a door and an auxiliary washing unit may be coupled by a locking part, a user can open and close a door assembly conveniently when auxiliary washing is not needed. When auxiliary washing is needed, the user can release a locked state of the locking part to move the door and the auxiliary washing unit separately.

DETAILED DESCRIPTION

Hereinafter, exemplary embodiments will be described in detail with reference to the attached drawings.

Figure 1:
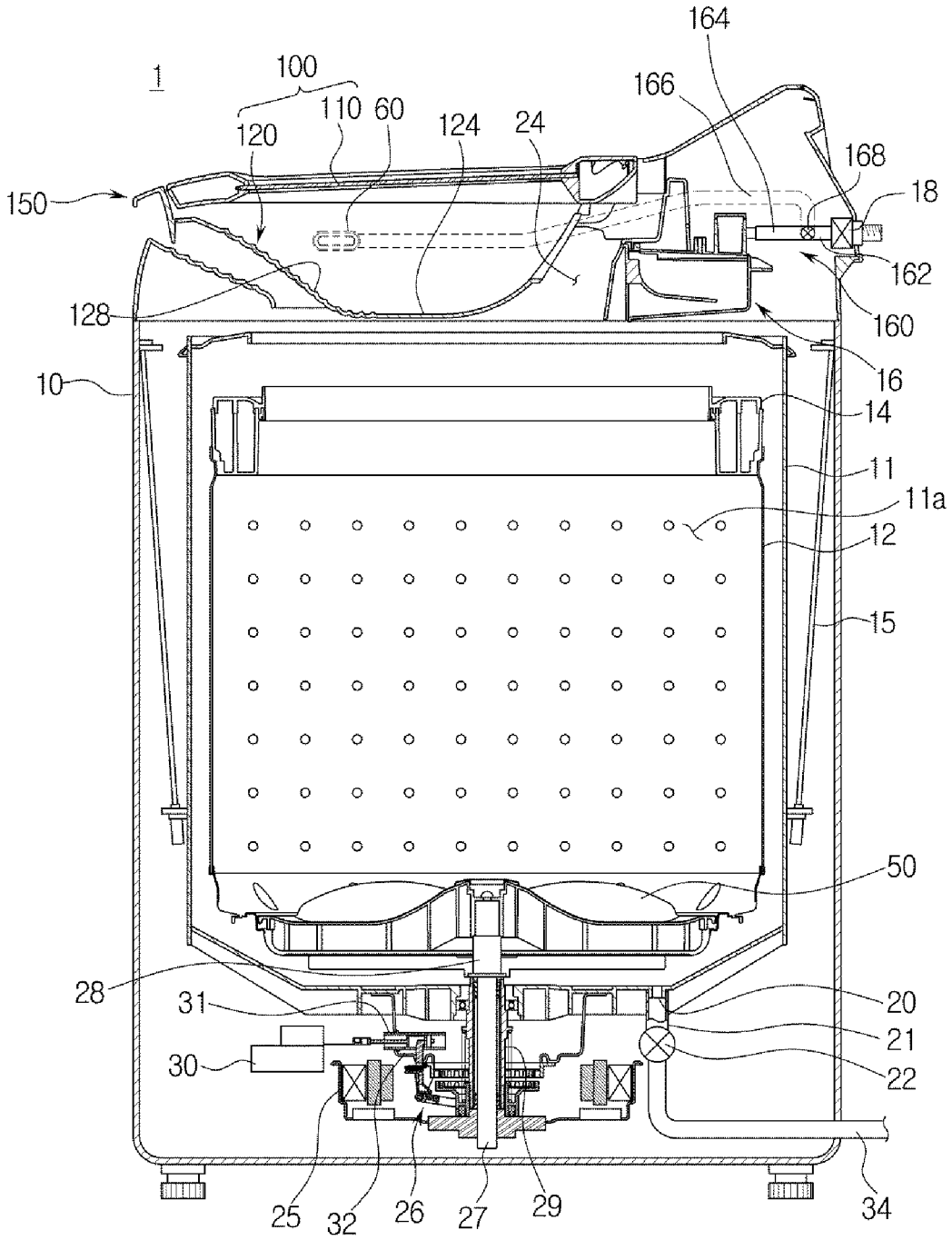
FIG. 1 is a cross-sectional view of a washing machine according to a first embodiment.

FIG. 1 is a cross-sectional view of a washing machine according to a first embodiment.

As illustrated in FIG. 1, a washing machine 1 includes, for example, a main body 10 that forms an exterior of the washing machine 1, an outer tub 11 that is disposed in the main body 10 and in which washing water is stored, an inner tub 12 that is rotatably disposed in the outer tub 11, and a pulsator 50 that is disposed in the inner tub 12 and generates a water current.

An opening 24 through which laundry may be put into the inner tub 12 is formed in an upper portion of the main body 10. The opening 24 may be opened and closed by a door assembly 100 installed at the upper portion of the main body 10. The outer tub 11 may be supported on the main body 10 by a suspension device 15.

A water supply pipe 17 for supplying washing water into the outer tub 11 may be installed in an upper portion of the outer tub 11. One side of the water supply pipe 17 may be connected to an external water supply source, and the other side of the water supply pipe 17 may be connected to a detergent supply device 16. Water supplied through the water supply pipe 17 may be supplied into the outer tub 11 through the detergent supply unit 16 together with detergent. A water supply valve 18 may be installed at the water supply pipe 17 to control water supply.

The inner tub 12 has a cylindrical shape with an opened upper portion, and a plurality of spin-drying holes 13 are formed in sides of the inner tub 12. A balancer 14 may be mounted on the upper portion of the inner tub 12 so that the inner tub 12 can rotate stably during high-speed rotation.

A motor 25 that generates a driving force to rotate the inner tub 12 and the pulsator 50, and a power switching device 26 that simultaneously or selectively transfers the driving force generated by the motor 25 to the inner tub 12 and the pulsator 50 are installed at a lower exterior of the outer tub 11.

A hollow type spin-drying shaft 29 may be coupled to the inner tub 12, and a washing shaft 27 installed in a hollow portion of the spin-drying shaft 29 may be coupled to the pulsator 50 using a washing shaft coupling part 28. The motor 25 may simultaneously or selectively transfer the driving force to the inner tub 12 and the pulsator 50 according to an ascending/descending operation of the power switching device 26.

The power switching device 26 may include an actuator 30 that generates a driving force for power switching, a rod part 31 that performs a linear motion according to an operation of the actuator 30, and a clutch part 32 that is connected to the rod part 31 to pivot according to an operation of the rod part 31.

A drain 20 may be formed in a bottom of the outer tub 11 to discharge washing water stored in the outer tub 11, and a first drain pipe 21 may be connected to the drain 20. A drain valve 22 may be installed in the first drain pipe 21 to control drainage. An outlet of the drain valve 22 may be connected to a second drain pipe 34 for discharging washing water to the outside.

Figure 2:
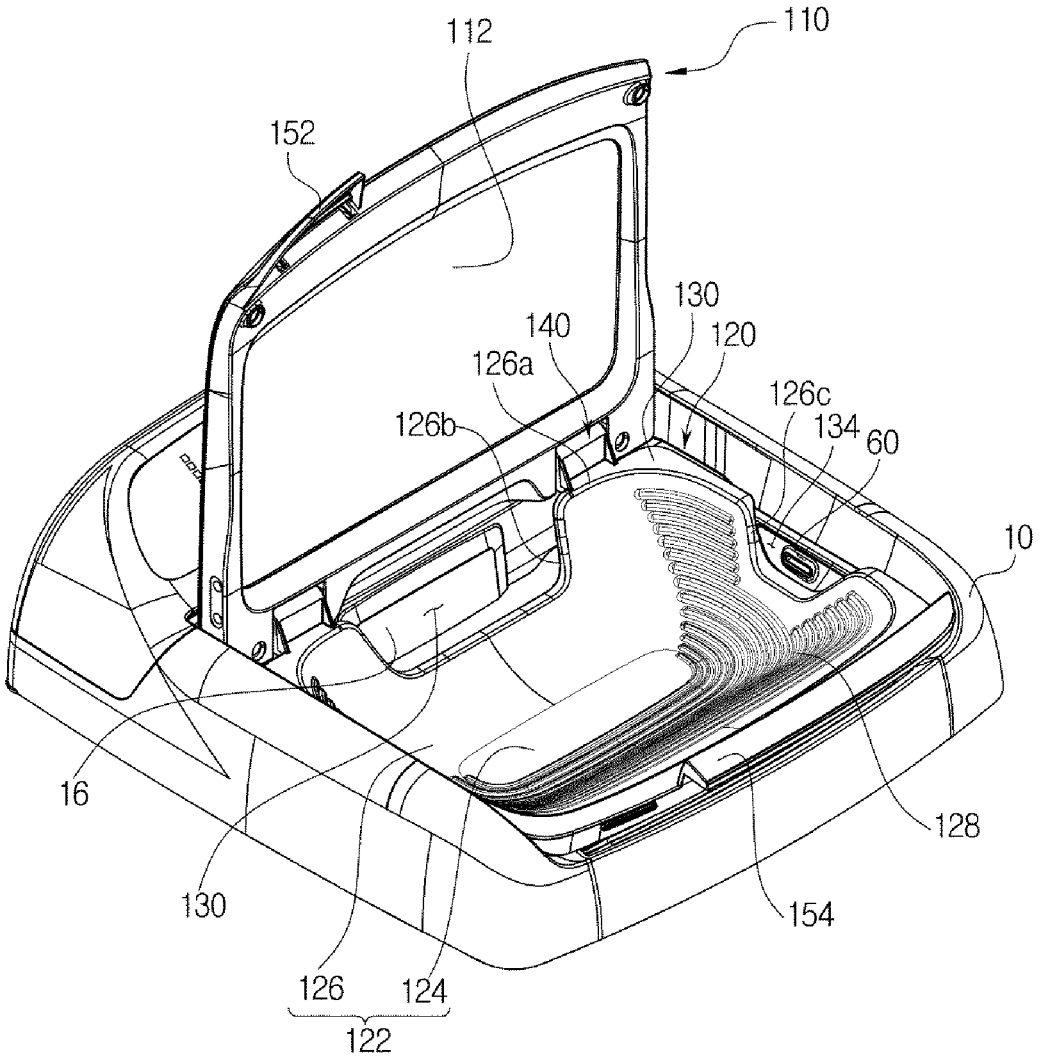
FIG. 2 is a perspective view of a state in which a door of the washing machine according to the first embodiment is opened.
Figure 3:
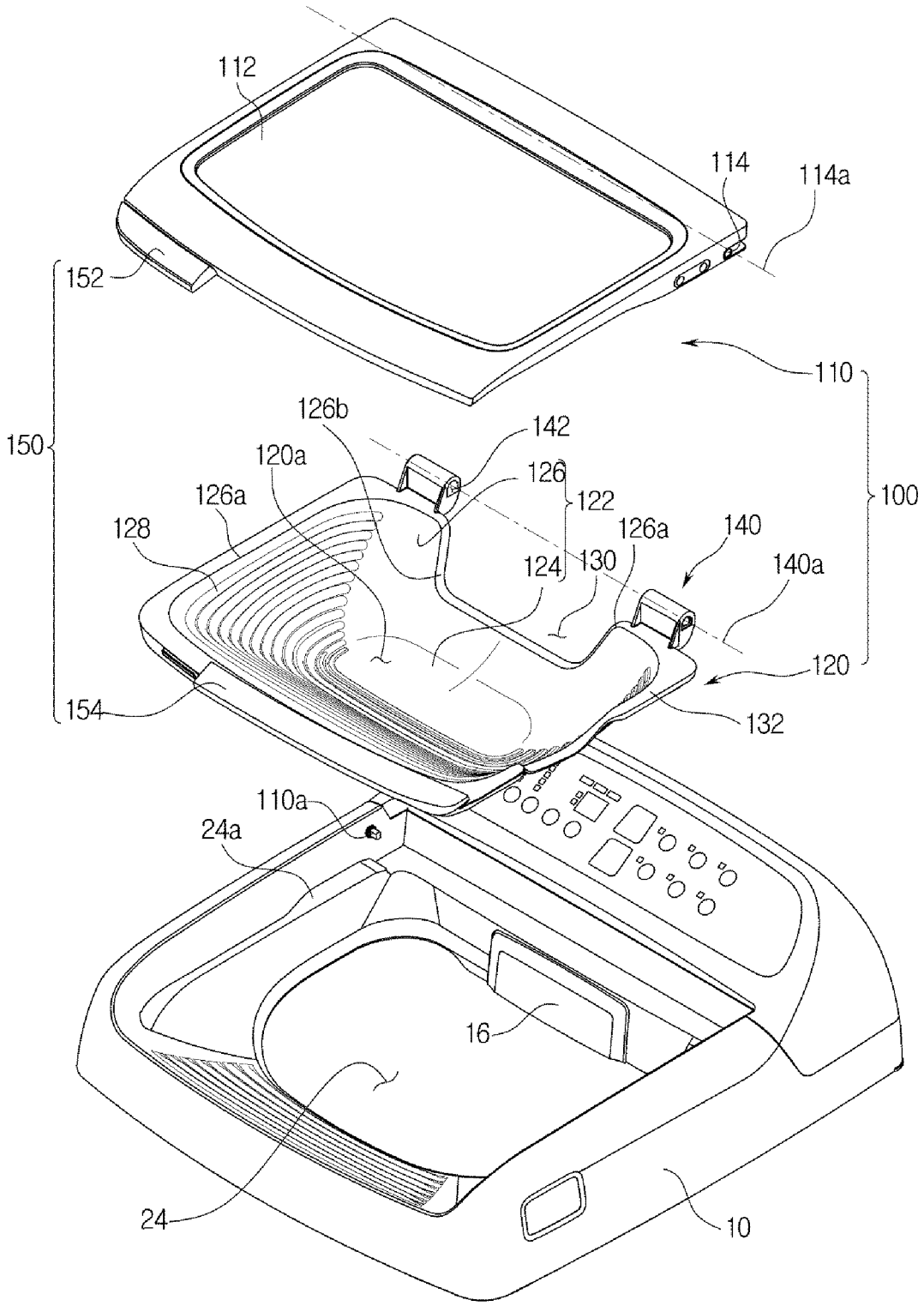
FIG. 3 is an exploded perspective view of a door assembly of the washing machine according to the first embodiment.
Figure 4:
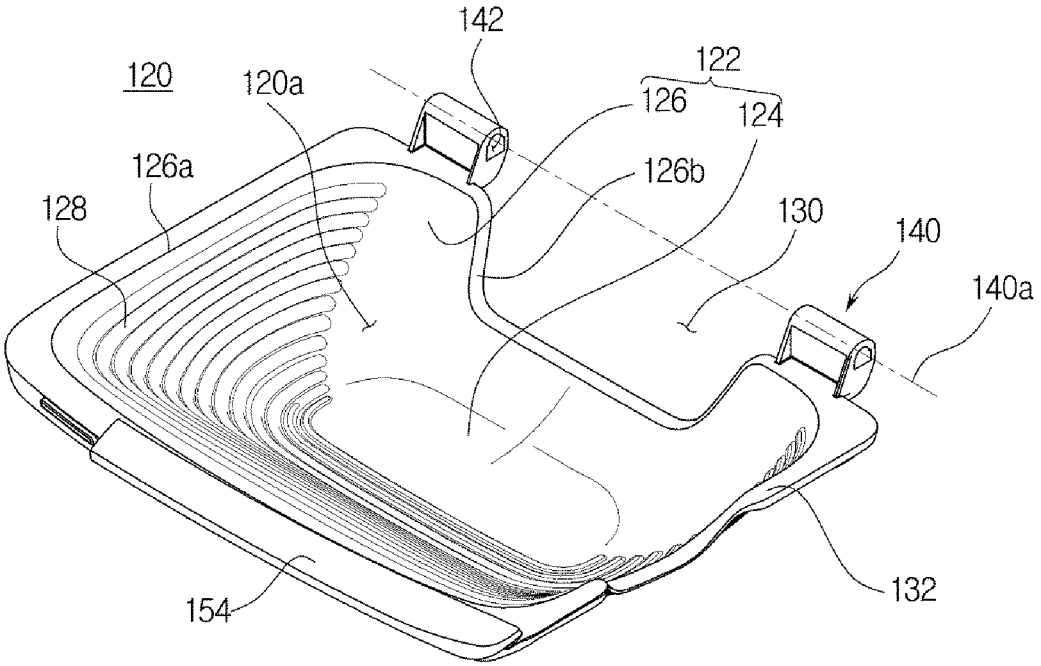
FIG. 4 is a perspective view of an auxiliary washing unit of the washing machine according to the first embodiment.

FIG. 2 is a perspective view of a state in which a door of the washing machine 1 according to the first embodiment is opened, FIG. 3 is an exploded perspective view of a door assembly 100 of the washing machine 1 according to the first embodiment, and FIG. 4 is a perspective view of an auxiliary washing unit of the washing machine 1 according to the first embodiment.

Referring to FIGS. 2, 3, and 4, the door assembly 100 may be provided to cover the opening 24.

The door assembly 100 may include a door 110 and an auxiliary washing unit 120.

The door 110 may be disposed at one side of the main body 10 to open and close the opening 24. A transparent member 112 may be disposed on the door 110 so that the inside of the washing machine 1 is visible even when the door 110 closes the opening 24. The transparent member 112 may be positioned in the center portion of a door frame 111.

The auxiliary washing unit 120 has an auxiliary washing space 120*a* in which manual washing can be performed separately. The auxiliary washing space 120*a* may be provided so that washing can be performed separately from a main washing space 11*a* (see FIG. 1) formed by the outer tub 11 (see FIG. 1) and the inner tub 12 (see FIG. 1).

The main washing space 11*a* and the auxiliary washing space 120*a* are separated from each other so that washing can be performed independently in each space. Also, washing in the main washing space 11*a* and the auxiliary washing space 120*a* may be performed separately or simultaneously.

The auxiliary washing unit 120 may be disposed under the door 110 to be pivotable about one side thereof. The auxiliary washing unit 120 may be disposed coaxially with a pivot axis of the door 110. Pivotal movement of the auxiliary washing unit 120 and the door 110 will be described later in detail.

The auxiliary washing unit 120 may include a unit body 122 including a bottom part 124 and a side part 126.

The auxiliary washing space 120*a* of the auxiliary washing unit 120 may be formed by the unit body 122. The bottom part 124, which is a factor determining a depth of the auxiliary washing space 120*a*, may be provided to be flat or curved. The side part 126 may be formed to be inclined toward the bottom part 124.

The bottom part 124 and the side part 126 may be provided with the recessed auxiliary washing space 120*a* such that manual washing can be performed while washing water is stored in the auxiliary washing space 120*a*.

The auxiliary washing unit 120 may include rubbing protrusions 128.

The rubbing protrusions 128 are provided on the unit body 122 to facilitate auxiliary washing. In an embodiment, the rubbing protrusions 128 are provided on the side part 126. However, the present invention is not limited thereto. Any rubbing protrusions 128 that are provided on an inner surface of the unit body 122 may be used. The rubbing protrusions 128 serve to increase frictional force with the laundry when manual washing is performed such that dirt is easily washed from the laundry. In an embodiment, the plurality of rubbing protrusions 128 are formed on the inner surface of the auxiliary washing unit 120 to be more convex than the adjacent inner surface. The rubbing protrusions 128 may be formed in parallel. However, the shape and arrangement of the rubbing protrusions 128 are not limited.

The auxiliary washing unit 120 may include an auxiliary drain 130.

The auxiliary drain 130 may be provided to drain the washing water stored in the auxiliary washing space 120*a*. The auxiliary drain 130 may be provided in a hole shape, may have a separate opening and closing member, and may be disposed in the bottom part 124 of the auxiliary washing space 120*a*. In an embodiment, the auxiliary drain 130 may be provided at the side part 126 of the unit body 122. The auxiliary drain 130 may be provided so that the washing water stored in the auxiliary washing space 120*a* is discharged when the auxiliary washing unit 120 is tilted.

The auxiliary drain 130 may be formed by an edge 126*b* of the auxiliary drain 130 formed to be lower than an adjacent upper end 126*a* of the unit body 122. That is, the auxiliary drain 130 may be formed in a portion of the unit body 122 that is recessed from the upper end 126*a* of the unit body 122. However, the shape of the auxiliary drain 130 is not limited as long as the washing water stored in the auxiliary washing space 120*a* can be discharged when the auxiliary washing unit 120 is tilted may be used.

The auxiliary washing unit 120 may include a seating flange 132.

The seating flange 132 may be formed in a flange shape on an upper end of the auxiliary washing unit 120 along an edge thereof and may be disposed to be seated on the main body 10. That is, the seating flange 132 may be provided in the flange shape along the upper end 126*a* of the unit body 122.

A seating part 24*a* that protrudes toward the opening 24 may be provided around the opening 24 of the main body 10. The seating flange 132 may be provided to be seated on the seating part 24*a*. The seating flange 132 may be seated on the seating part 24*a* so that the auxiliary washing unit 120 can be laid to the main body 10.

A cushion member 133 may be provided on the lower surface of the auxiliary washing unit 120. For example, the cushion member 133 may be provided on the lower surface of the seating flange 132 (see FIG. 8C). Since the cushion member 133 relieves an impact when the seating flange 132 is seated on the seating part 24*a*, the auxiliary washing unit 120 or the main body 10 may be prevented from being damaged or making noise when the auxiliary washing unit 120 is seated on the main body 10.

Referring to FIGS. 1 to 4, the washing machine 1 according to the first embodiment of the present invention may include a water supply device 160 for supplying water into the main washing space 11*a* and the auxiliary washing space 120*a*. The water supply device 160 may include a water supply pipe 162, a main water supply pipe 164, an auxiliary water supply pipe 166, and a switching unit 168.

One end of the water supply pipe 162 may be connected to the water supply valve 18, and the other end thereof may be connected to the switching unit 168. The water supply pipe 162 may be provided to transfer the washing water supplied from the water supply valve 18 to the switching unit 168.

The main water supply pipe 164 may be provided to supply water into the main washing space 11*a*. One end of the main water supply pipe 164 may be connected to the detergent supply device 16, and the other end thereof may be connected to the switching unit 168.

The auxiliary water supply pipe 166 may be provided to supply water into the auxiliary washing space 120*a* of the auxiliary washing unit 120. One end of the auxiliary water supply pipe 166 may be connected to an auxiliary water supply port 60, and the other end thereof may be connected to the switching unit 168.

The switching unit 168 may be provided to selectively supply the washing water transferred from the water supply pipe 162 to one of the main water supply pipe 164 and the auxiliary water supply pipe 166. That is, the switching unit 168 may be provided so that the washing water can be supplied into a washing space through at least one of the main water supply pipe 164 and the auxiliary water supply pipe 166 through control of the switching unit 168. The switching unit 168 may include a three-way valve.

In an embodiment, the main water supply pipe 164 and the auxiliary water supply pipe 166 are provided to branch off from the water supply pipe 162 with the switching unit 168 interposed therebetween. Alternatively, the main water supply pipe 164 and the auxiliary water supply pipe 166 may be connected to the water supply valve 18 so that the washing water can be supplied by controlling the water supply valve 18. That is, the other end of the main water supply pipe 164 having the one end connected to the detergent supply device 16, and the other end of the auxiliary water supply pipe 166 having the one end connected to the auxiliary water supply port 60 may be connected to the water supply valve 18.

In an embodiment, the washing water may be selectively supplied to one of the main water supply pipe 164 and the auxiliary water supply pipe 166. However, the washing water may be simultaneously supplied to the main water supply pipe 164 and the auxiliary water supply pipe 166 at the same time. Also, washing water may be supplied through the auxiliary water supply pipe 166 regardless of whether the opening 24 is opened or closed by the auxiliary washing unit 120. If the auxiliary washing unit 120 closes the opening 24, washing water supplied through the auxiliary washing pipe 166 may be stored in the auxiliary washing unit 120. Even when the auxiliary washing unit 120 opens the opening 24, washing water may be supplied through the auxiliary water supply pipe 166 so that a user can wash laundry or his/her hands.

The auxiliary water supply port 60 may be disposed in communication with the auxiliary water supply pipe 166. The auxiliary water supply port 60 may be disposed at one side of the auxiliary washing unit 120 to supply the washing water into the auxiliary washing unit 120.

The auxiliary washing unit 120 includes a washing water inlet 134 corresponding to the auxiliary water supply port 60, so that the washing water supplied from the auxiliary water supply port 60 can be introduced into the auxiliary washing unit 120. The washing water inlet 134 may be formed by an inlet edge 126*c* formed to be lower than the adjacent upper end 126*a* of the unit body 122. That is, the washing water inlet 134 may be formed in a portion that is recessed from the upper end 126*a* of the unit body 122. However, the shape of the washing water inlet 134 is not limited as long as the washing water can be introduced into the auxiliary washing space 120*a* without interference with by the unit body 122 when the washing water is introduced through the auxiliary water supply port 60.

The auxiliary washing unit 120 may be formed of a thermoplastic resin. The auxiliary washing unit 120 may be formed of an acrylonitrile butadiene styrene (ABS) material. However, the present invention is not limited thereto, and the auxiliary washing unit 120 may be formed of any material having sufficient shock resistance and stiffness for manual washing.

The door 110 and the auxiliary washing unit 120 are also referred to as a main door 110 and a manual washing vessel 120, respectively.

Figure 5A:
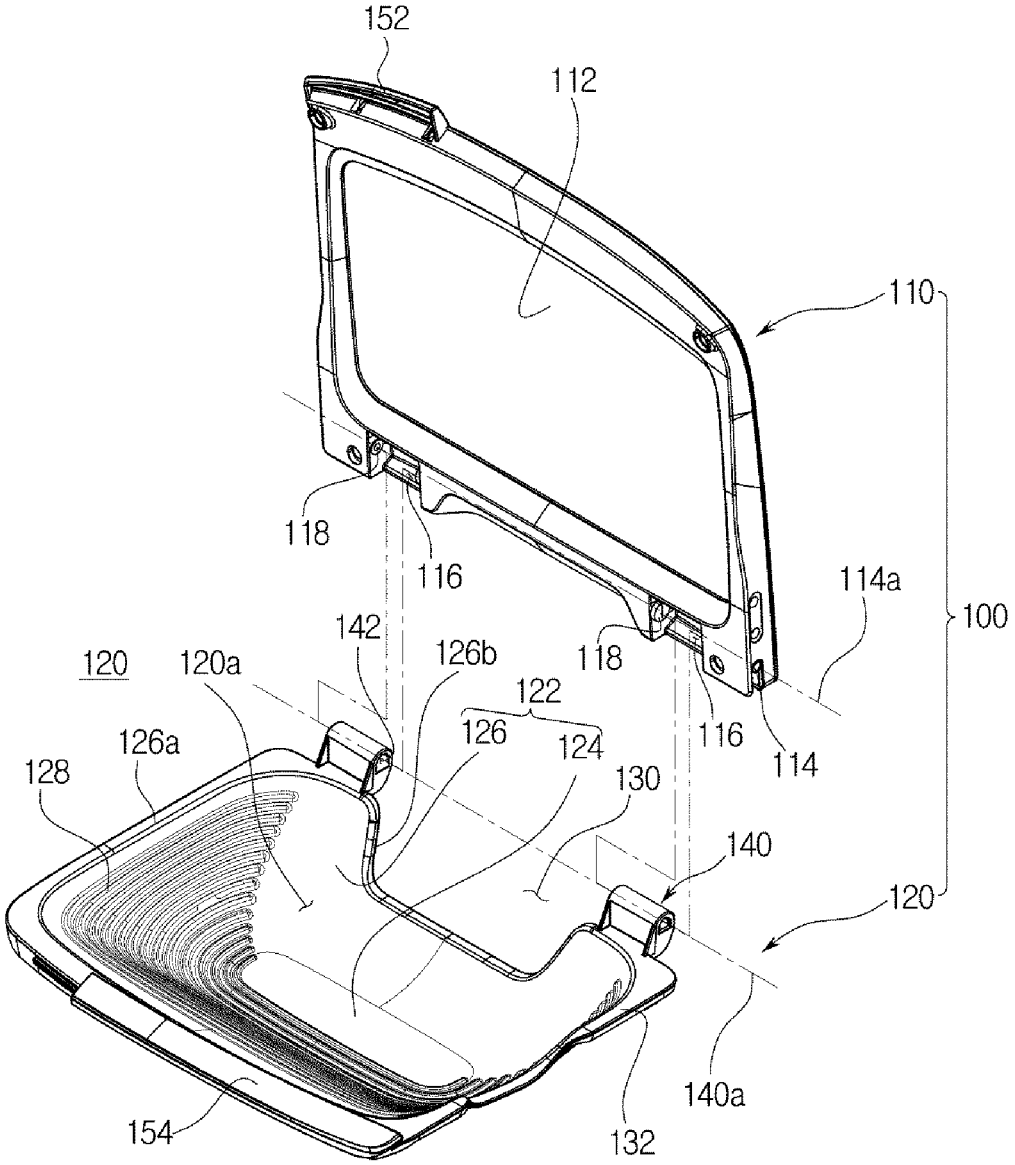
FIG. 5A is a perspective view of coupling of the door assembly of the washing machine according to the first embodiment.
Figure 5B:
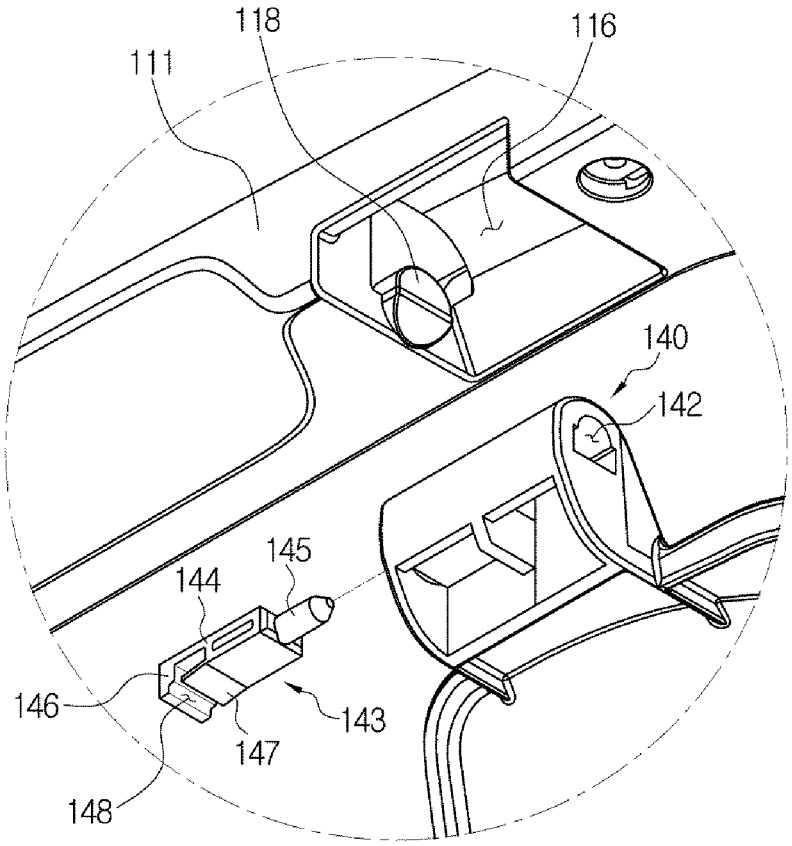
FIG. 5B is an exploded perspective view of coupling of the door assembly of the washing machine according to the first embodiment.
Figure 5C:
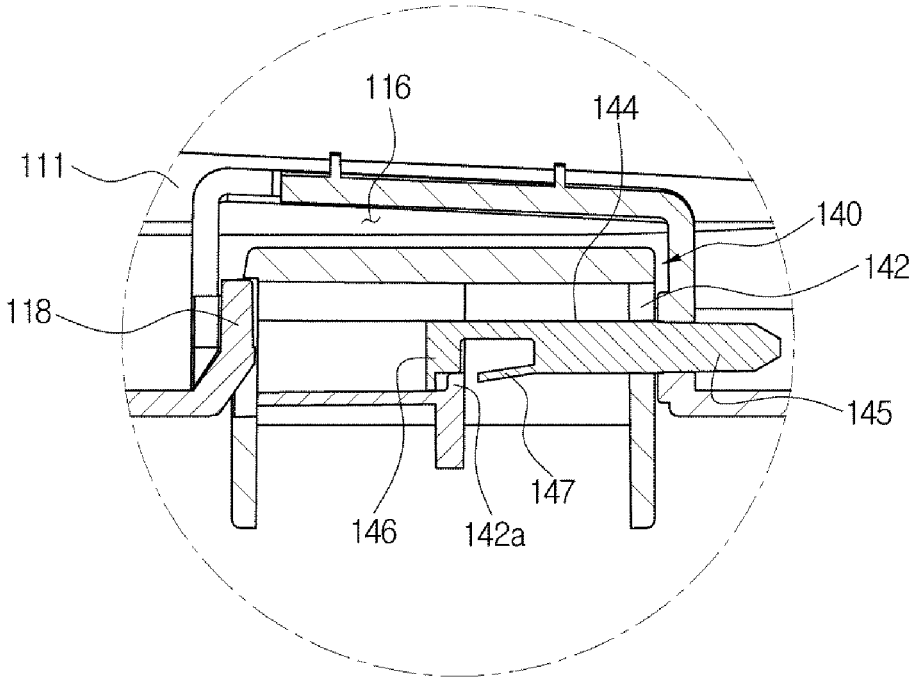
FIG. 5C is a cross-sectional view of coupling of the door assembly of the washing machine according to the first embodiment.
Figure 6:
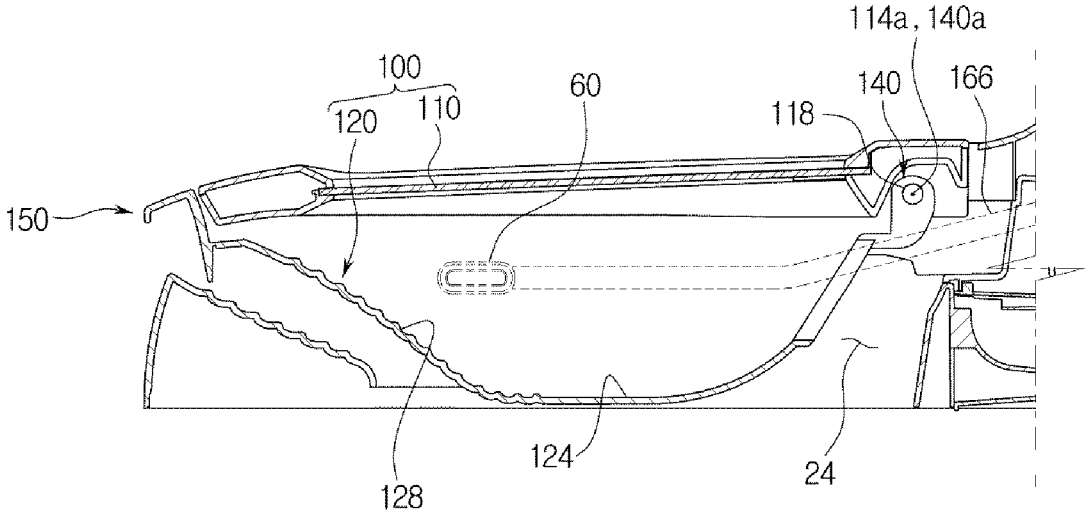
FIG. 6 is a cross-sectional view of the door assembly of the washing machine according to the first embodiment.
Figure 7:
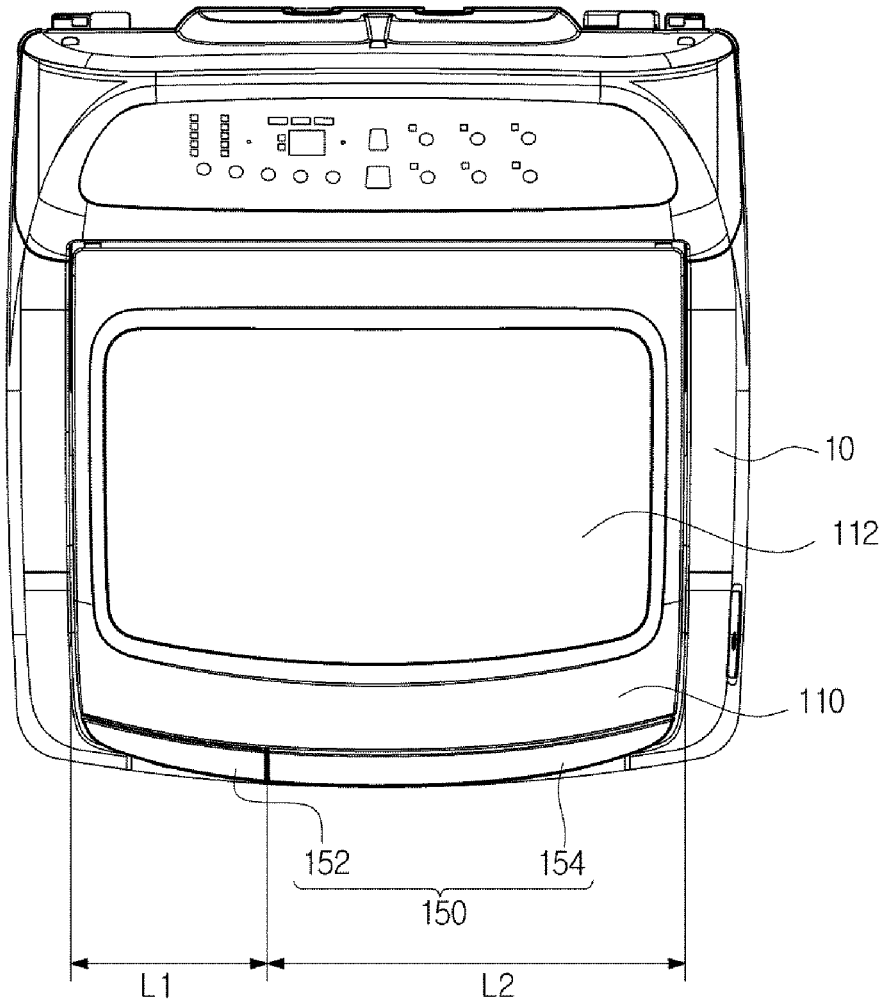
FIG. 7 is a top view of the washing machine according to the first embodiment.

FIG. 5A is a perspective view of coupling of the door assembly 100 of the washing machine 1 according to the first embodiment, FIG. 5B is an exploded perspective view of coupling of the door assembly 100 of the washing machine according to the first embodiment, FIG. 5C is a cross-sectional view of coupling of the door assembly 100 of the washing machine 1 according to the first embodiment, FIG. 6 is a cross-sectional view of the door assembly 100 of the washing machine 1 according to the first embodiment, and FIG. 7 is a top view of the washing machine 1 according to the first embodiment.

The door 110 and the auxiliary washing unit 120 are each provided to be pivotable with respect to the main body 10.

The door 110 may be provided to be pivotable about a door pivot axis 114*a*, and the auxiliary washing unit 120 may be provided to be pivotable about an auxiliary pivot axis 140*a*.

In an embodiment, the door pivot axis 114*a* and the auxiliary pivot axis 140*a* are disposed on the same side of the door 110 and the auxiliary washing unit 120 so that the door 110 and the auxiliary washing unit 120 can be opened and closed in the same direction.

The door pivot axis 114*a* and the auxiliary pivot axis 140*a* may be coaxial. That is, the door pivot axis 114*a* and the auxiliary pivot axis 140*a* may be coincident.

To this end, the door 110 may be pivotably coupled to the main body 10 by a door pivot part 110*a* disposed on the main body 10 along the door pivot axis 114*a*, and the auxiliary washing unit 120 may be pivotably coupled to the door 110 by an auxiliary pivot part 140.

The door pivot part 110*a* may be formed in a shape that protrudes toward the door pivot axis 114*a* so that the door 110 can pivot about the door pivot axis 114*a* on the main body 10. Specifically, an accommodation part 114 may be disposed in the door 110, and the door pivot part 110*a* may be inserted into the accommodation part 114 so that the door 110 may be pivotably supported by the main body 10. However, the present invention is not limited thereto, and the door pivot part 110*a* may be formed in a shape that protrudes toward the door pivot axis 114*a* so that the door 110 can pivot about the door pivot axis 114*a* on an outer surface of the door 110. The shape of the door pivot part 110*a* is not limited, and any shape with which the door 110 is pivotable with respect to the main body 10 may be used.

The door 110 may include an insertion part 116 formed to be recessed from one side of the door 110 so that the auxiliary pivot part 140 can pivot, and pivot protrusions 118 may be formed on the insertion part 116 to protrude toward the auxiliary pivot axis 140*a* so that the auxiliary washing unit 120 can pivot about the auxiliary pivot axis 140*a*. Pivot holes 142 corresponding to the pivot protrusions 118 may be formed in the auxiliary washing unit 120. The auxiliary pivot part 140 may be pivotably inserted into a part of the door 110 so that the door pivot axis 114*a* and the auxiliary pivot axis 140*a* coincide.

The auxiliary washing unit 120 may be pivotably coupled to the main body 10 on a second pivot axis so that the auxiliary washing unit 120 can pivot with respect to the main body 10. The door 110 may be pivotably coupled to the main body 10 on a first pivot axis so that the door 110 can pivot with respect to the main body 10. Herein, the second pivot axis may be the auxiliary pivot axis 120*a*, and the first pivot axis may be the door pivot axis 114*a*.

The auxiliary washing unit 120 and the door 110 may also be referred to as a first door 120 and a second door 110, respectively. The first door 120 may include at least one first door-door coupling part that is hinge-coupled to the second door 110.

The first door-door coupling part may be the auxiliary pivot part 140 of the auxiliary washing unit 120.

The second door 110 may include at least one second door-door coupling part that is hinge-coupled to the first door-door coupling part, and at least one second door-main body coupling part that is hinge-coupled to the main body. The second door-door coupling part may be the insertion part 116 of the door 110, and the second door-main body coupling part may be the accommodation part 114 of the door 110.

A hinge pin unit 143 may be inserted into the pivot hole 142.

The hinge pin unit 143 may include a pin body 144, a hinge pin 145 extending from one side of the body 144, a catching part 146 extending from the lower part of the pin body 144, and a sliding part 147 extending at a predetermined angle from the lower part of the hinge body 144 and disposed elastically with respect to the hinge body 144. Specifically, the catching part 146 may be formed at the other side of the hinge body 144 opposite to the hinge pin 145, and the sliding part 147 may be inclined with respect to the longitudinal direction of the hinge body 144.

In the inner surface of the auxiliary pivot part 140 that defines the pivot hole 142, a catching protrusion 142*a* may be formed to abut to a fixing part 148 which is a space between the catching part 146 and the sliding part 147. The maximum length of the hinge pin unit 143 may be shorter than a length of the pivot hole 142.

The hinge pin unit 143 may be disposed on the pivot axis of the auxiliary washing unit 120 so that the auxiliary washing unit 120 can be pivotably coupled to the door 110. That is, the hinge pin unit 143 may be inserted into the pivot hole 142 of the auxiliary pivot part 140, thus forming the auxiliary pivot axis that is the center of rotation of the auxiliary washing unit 120.

In order for the auxiliary washing unit 120 to be coupled to the door 110, the hinge pin unit 143 may be inserted into the pivot hole 142 such that the hinge pin 145 faces one side of the pivot hole 142. The hinge pin unit 143 may be inserted from the other side of the pivot hole 142. The auxiliary pivot part 140 may be inserted into the insertion part 116 such that the pivot protrusion 118 is inserted into the other side of the pivot hole 142 while the hinge pin unit 143 is inserted into the pivot hole 142. If the pivot protrusion 118 is inserted into the other side of the pivot hole 142, the hinge pin unit 143 may slide toward one side of the pivot hole 142. If the sliding unit 147 of the hinge pin unit 143 slides along the upper surface of the catching protrusion 142*a* until the fixed part 148 reaches the catching protrusion 142*a*, the catching part 146 of the hinge pin unit 143 may be caught by the catching protrusion 142*a*. Accordingly, the hinge pin unit 143 may be fixed without further moving toward the side of the pivot hole 142. Also, the end of the sliding part 147 may be caught by the catching protrusion 142*a* so that the hinge pin unit 143 is fixed without further moving toward the other side of the pivot hole 142. That is, the catching part 146 restricts movement of the hinge pin 145 in the direction in which the hinge pin 145 is inserted into the pivot hole 142 of the door 110, and the sliding part 147 restricts movement of the hinge pin 145 in the direction in which the hinge pin 145 exits the pivot hole 142 of the door 110. The hinge pin 145 may be inserted into a pivot hole (not shown) formed in one side of the insertion part 116 so that the auxiliary washing unit 120 can be pivotably coupled to the door 110.

When a user detaches the auxiliary washing unit 120 from the door 110, the user may slide the hinge pin unit 143 toward the other side of the pivot hole 142 until the hinge pin 145 exits the pivot hole (not shown) formed in the one side of the insertion part 116, and then detach the auxiliary pivot part 140 from the insertion part 116. That is, the user may press the sliding part 147 so that the end of the sliding part 147 may be released from the catching protrusion 142*a*, and slide the hinge pin unit 143 toward the other side of the pivot hole 142 until the hinge pin 145 exits the pivot hole (not shown) formed in the one side of the insertion part 116, thereby detaching the auxiliary pivot part 140 from the insertion part 116. Thereby, the user can detach the auxiliary washing unit 120 from the door 110. Since the auxiliary washing unit 120 may be detachably coupled to the door 110, a user can detach the auxiliary washing unit 120 from the door 110 as necessary for repair or for convenience in use.

However, the shape and arrangement in which the door 110 and the auxiliary washing unit 120 pivot are not limited. Any shape or arrangement in which the door 110 and the auxiliary washing unit 120 are configured to open and close the opening 24 may be used.

The auxiliary pivot part 140 may be provided to protrude from the unit body 122 so that the auxiliary pivot axis 140*a* is spaced apart from the unit body 122. Through this configuration, a rotational radius of the auxiliary washing unit 120 may be increased, and the unit body 122 may also be prevented from interfering with the door 110 or the main body 10 when the auxiliary washing unit 120 pivots.

The door assembly 100 may include a handle part 150.

The handle part 150 may include a door handle part 152 provided at the door 110, and an auxiliary handle part 154 provided at the auxiliary washing unit 120.

The door handle part 152 may be disposed at the other side of the door 110 to correspond to the door pivot axis 114 disposed at one side thereof. In the same manner, the auxiliary handle part 154 may be disposed at the other side of the auxiliary washing unit 120 to correspond to the auxiliary pivot axis 140*a* disposed at one side thereof. The door handle part 152 and the auxiliary hand part 154 may be provided in parallel in a lengthwise direction.

The door handle part 152 and the auxiliary handle part 154 are provided on a front surface of the door 110 and a front surface of the auxiliary washing unit 120, respectively, so that a user can manipulate the door handle part 152 or the auxiliary handle part 154 to pivot the door 110 and the auxiliary washing unit 120. The door 110 may be operated through an operation of the door handle part 152, and only the auxiliary washing unit 120 may be pivoted or the auxiliary washing unit 120 and the door 110 may be pivoted together through an operation of the auxiliary handle part 154.

On a front surface of the door assembly 100, the door handle part 152 may be formed to have a first length L1, and the auxiliary handle part 154 may be formed to have a second length L2 in parallel with the first length L1. When the door handle part 152 is operated, the door 110 may pivot, and when the auxiliary handle part 154 is operated while the door 110 is opened, the auxiliary washing unit 120 may be pivoted. When the auxiliary handle part 154 is operated while the door 110 is closed, the door 110 and the auxiliary washing unit 120 may be pivoted together, and thus the second length L2 may be longer than the first length L1 in consideration of weights of the door 110 and the auxiliary washing unit 120. That is, the auxiliary handle part 154 may be formed longer than the door handle part 152. A ratio of the first length L1 of the door handle part 152 with respect to the second length L2 of the auxiliary handle part 154 may be appropriately set in consideration of the structure or use environment of the door assembly 100.

Hereinafter, an operation of the door assembly 100 of the washing machine 1 having the above configuration will be described.

Figure 8A:
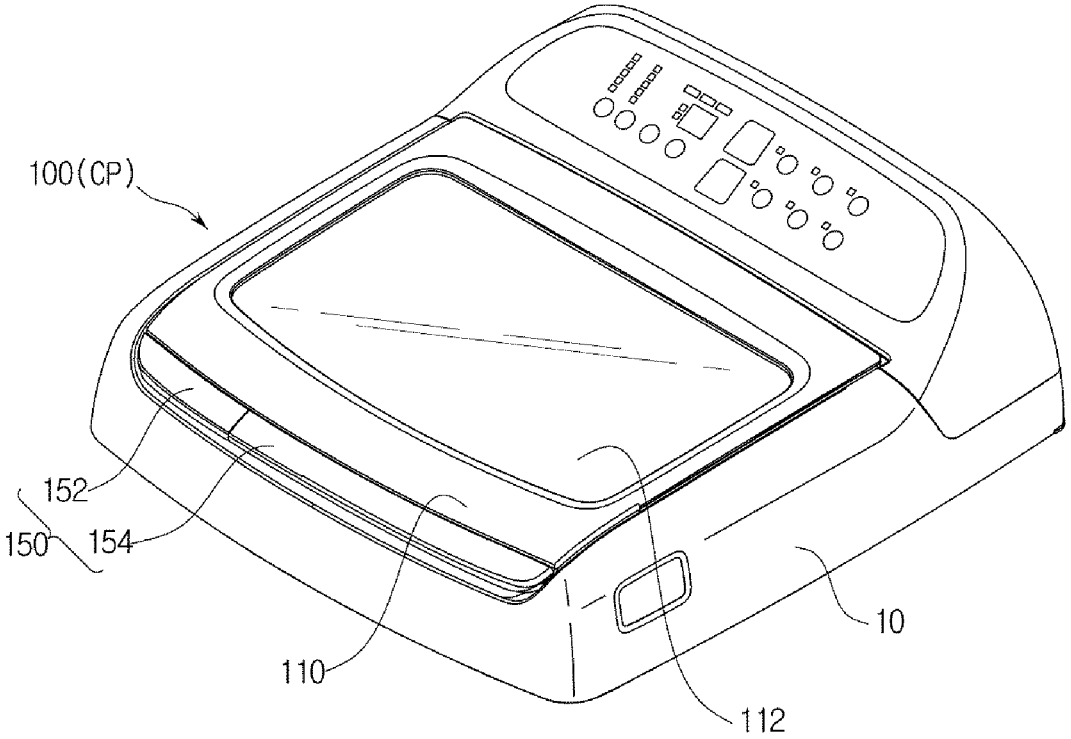
FIGS. 8A, 8B, and 8C illustrate an operation of the door assembly of the washing machine according to the first embodiment.
Figure 8B:
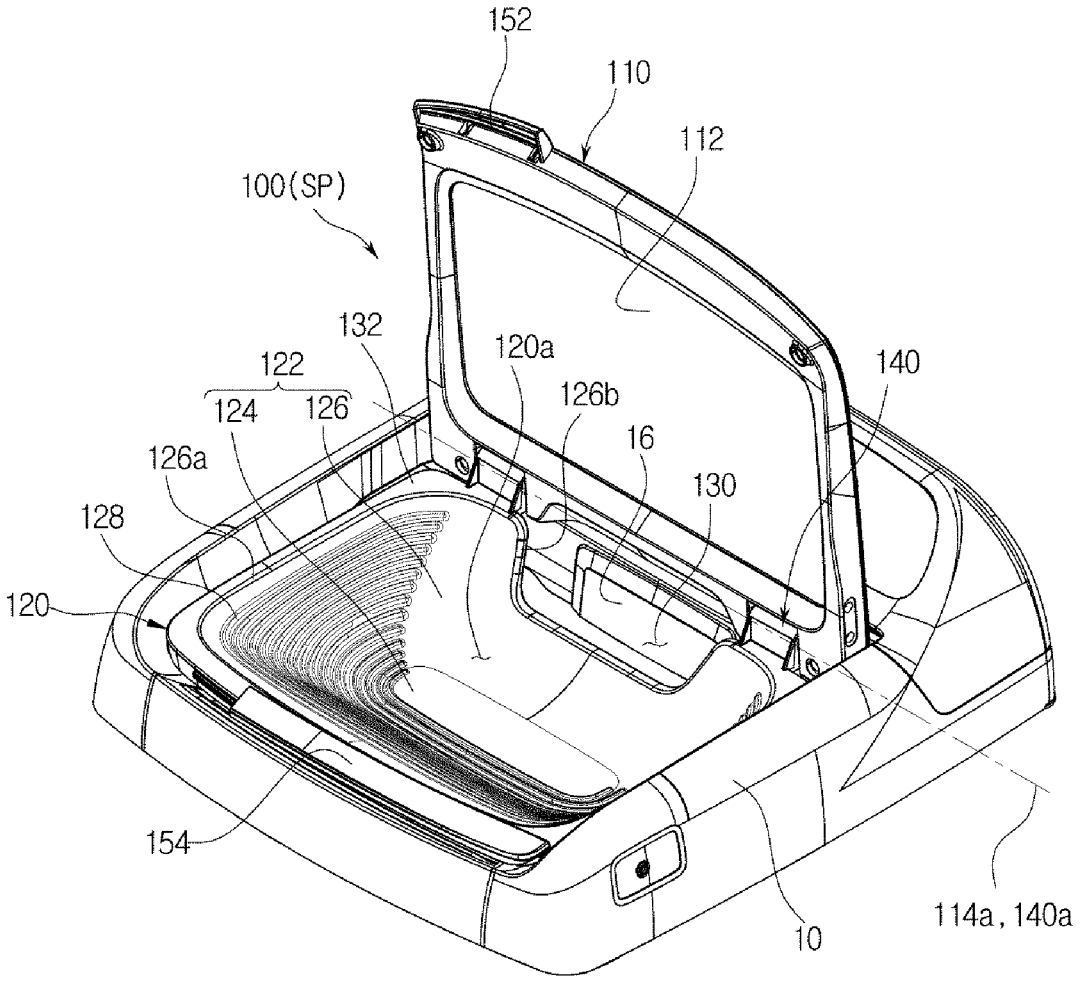
Figure 8C:
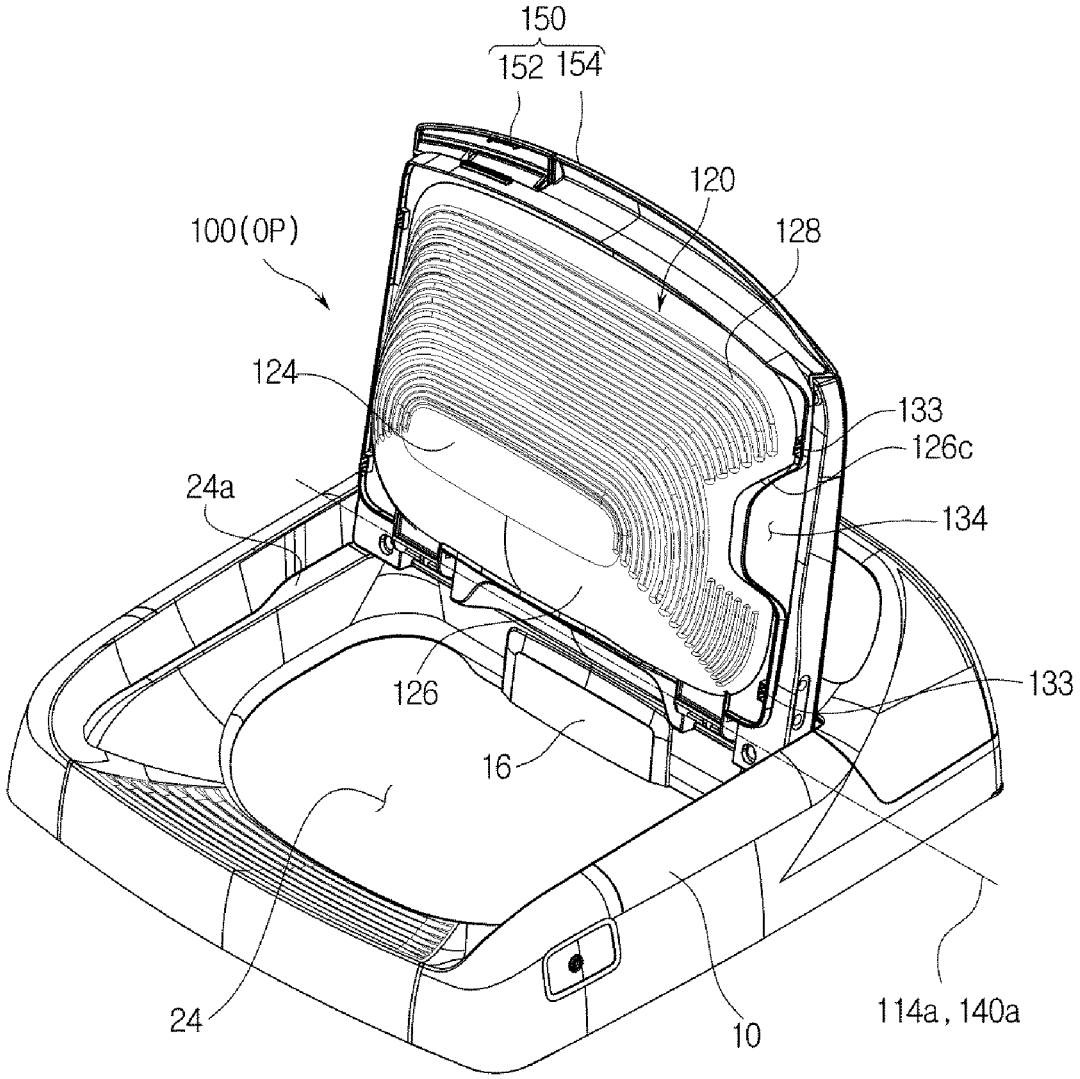

FIGS. 8A, 8B, and 8C illustrate an operation of the door assembly of the washing machine according to the first embodiment.

Referring to FIGS. 8A, 8B, and 8C, the door assembly 100 according to an embodiment may be at a closed position CP, an auxiliary washing position SP, or an opened position OP when the door 110 or the auxiliary washing unit 120 pivots about the pivot axis 114*a* or 140*a*.

The closed position CP is a position at which the door 110 and the auxiliary washing unit 120 are disposed over the opening 24 to cover the opening 24. When the door assembly 100 is at the closed position CP, the washing machine 1 may perform an automatic washing operation.

The auxiliary washing position SP is a position at which the door 110 pivots about the door pivot axis 114*a* from the closed position CP of the door assembly 100 to be opened, and the opening 24 is covered by the auxiliary washing unit 120. When the door assembly 100 is at the auxiliary washing position SP, the user can perform manual washing in the auxiliary washing unit 120.

The opened position OP is a position at which, the door assembly 100 pivots about the pivot axis 114*a* or 140*a* to open the opening 24. The door 110 or the auxiliary washing unit 120 may pivot about the pivot axis 114*a* or 140*a* from the closed position CP or the auxiliary washing position SP to thus open the opening 24. When the door assembly 110 is at the opened position OP, the user may put laundry into the main washing space 11*a*.

The user manipulates the door handle part 152 to move the door assembly 100 between the closed position CP and the auxiliary washing position SP, and the user manipulates the auxiliary handle part 154 to move the door assembly 100 between the closed position CP and the opened position OP.

Hereinafter, an operation of the auxiliary washing unit of the washing machine having the above-described configuration will be described.

Figure 9A:
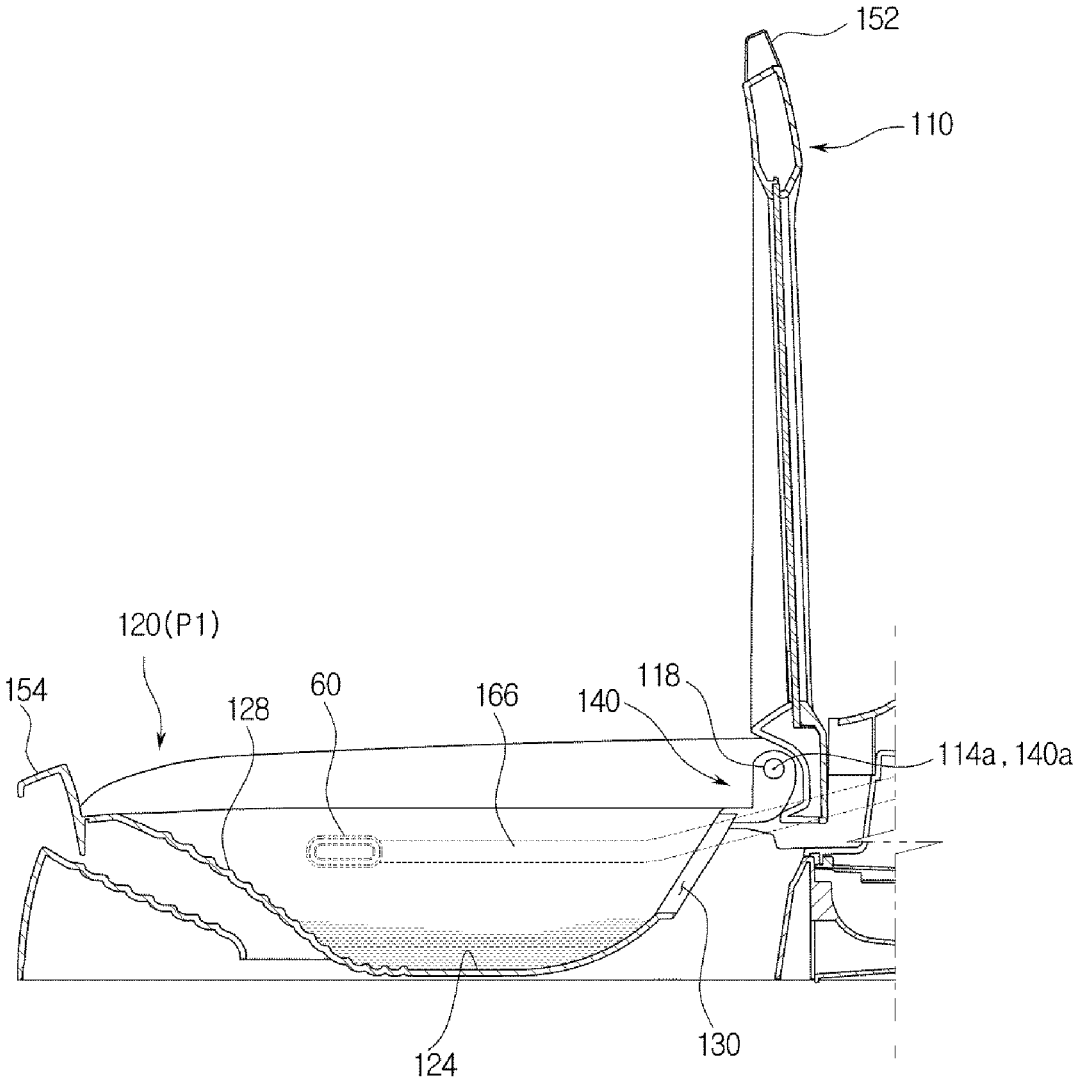
FIGS. 9A and 9B illustrate an operation of the auxiliary washing unit of the washing machine according to the first embodiment.
Figure 9B:
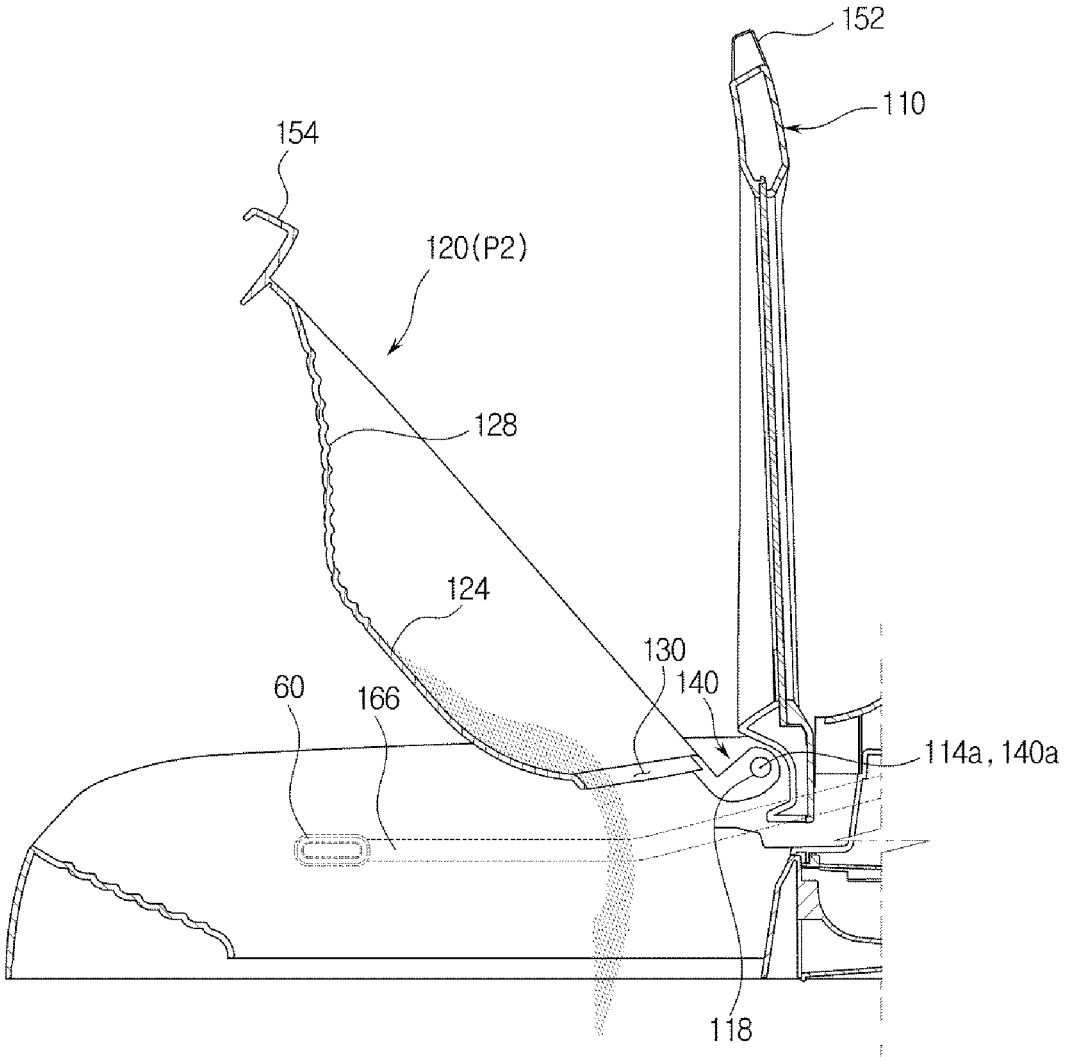

FIGS. 9A and 9B illustrate an operation of the auxiliary washing unit 120 of the washing machine 1 according to the first embodiment.

After the door assembly 100 finishes manual washing in the auxiliary washing position SP, the washing water may be discharged to the main washing space 11*a* through the auxiliary drain 130 or to an outside of the washing machine 1.

Specifically, if a position of the auxiliary washing unit 120 is called a first position P1 when the door assembly 100 is in the auxiliary washing position SP, the auxiliary washing unit 120 may be provided to pivot between the first position P1 and a second position P2 in which the auxiliary washing unit 120 pivots from the first position P1 so that the washing water in the auxiliary washing space 120*a* may be discharged into the main washing space 11*a* through the auxiliary drain 130 or to the outside of the washing machine 1. The second position P2 is a position in which the auxiliary washing unit 120 pivots about the auxiliary pivot axis 140*a* and is tilted so that the washing water in the auxiliary washing space 120*a* may be discharged through the auxiliary drain 130. The second position P2 may be a position between the first position P1 and a position of the auxiliary washing unit 120 when the door assembly 100 is in the opened position OP.

Since the auxiliary drain 130 may be formed in a portion having a lower height than the adjacent side part 126, the washing water may be smoothly discharged through the auxiliary drain 130 when the auxiliary washing unit 120 is tilted so that the washing water does not overflow from the upper end of the side part 126.

In an embodiment, the door 110 may pivot about the door pivot axis 114*a* with respect to the main body, and the auxiliary washing unit 120 may pivot about the auxiliary pivot axis 140*a* with respect to the door 110. However, the door 110 may be coupled to be pivotable with respect to the auxiliary washing unit 120, and the auxiliary washing unit 120 may be coupled to be pivotable with respect to the main body.

Hereinafter, a door assembly 100 according to a second embodiment will be described.

Configurations of the present embodiment that are the same as those of the first embodiment will not be described again.

Figure 10:
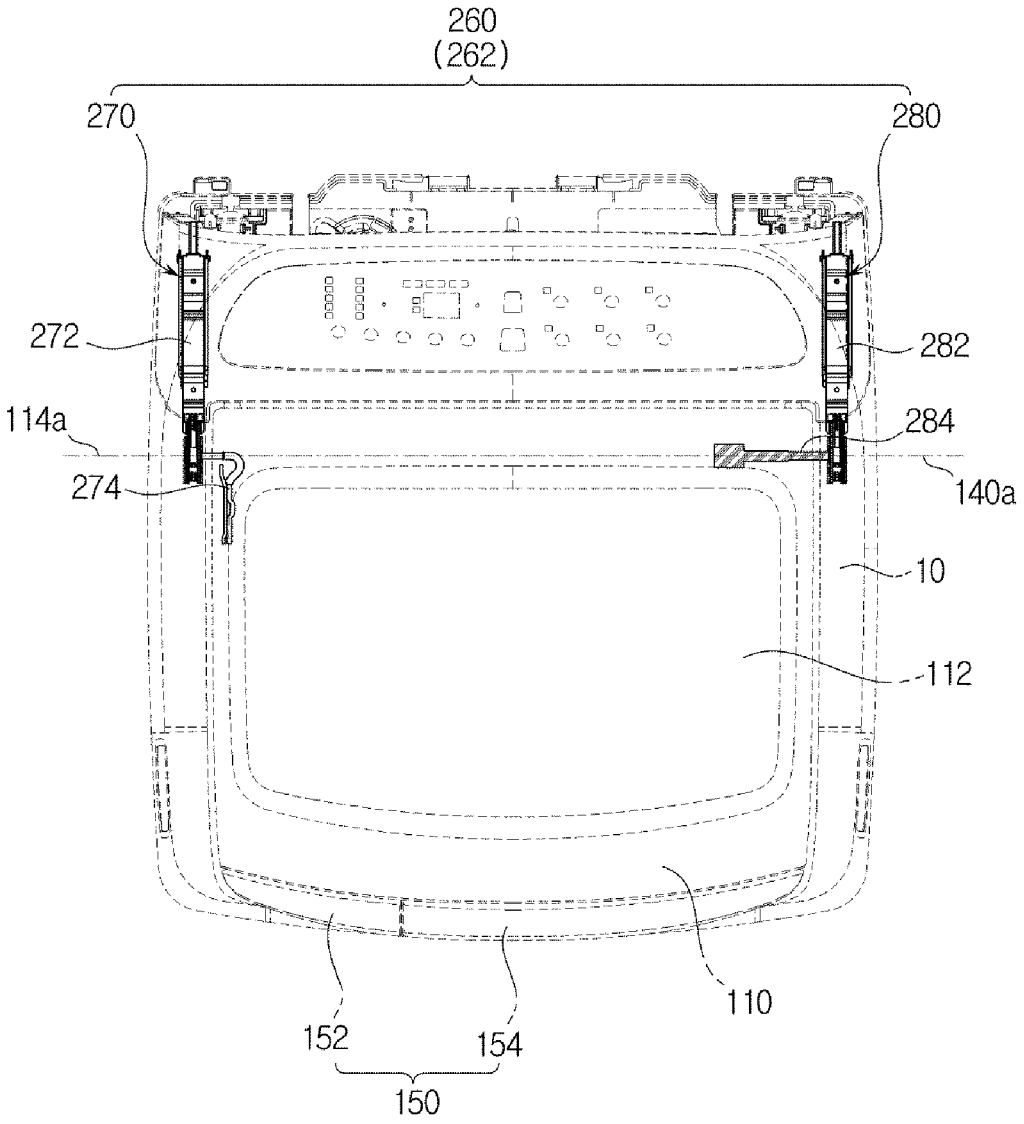
FIG. 10 is a top view of a washing machine according to a second embodiment.
Figure 11A:
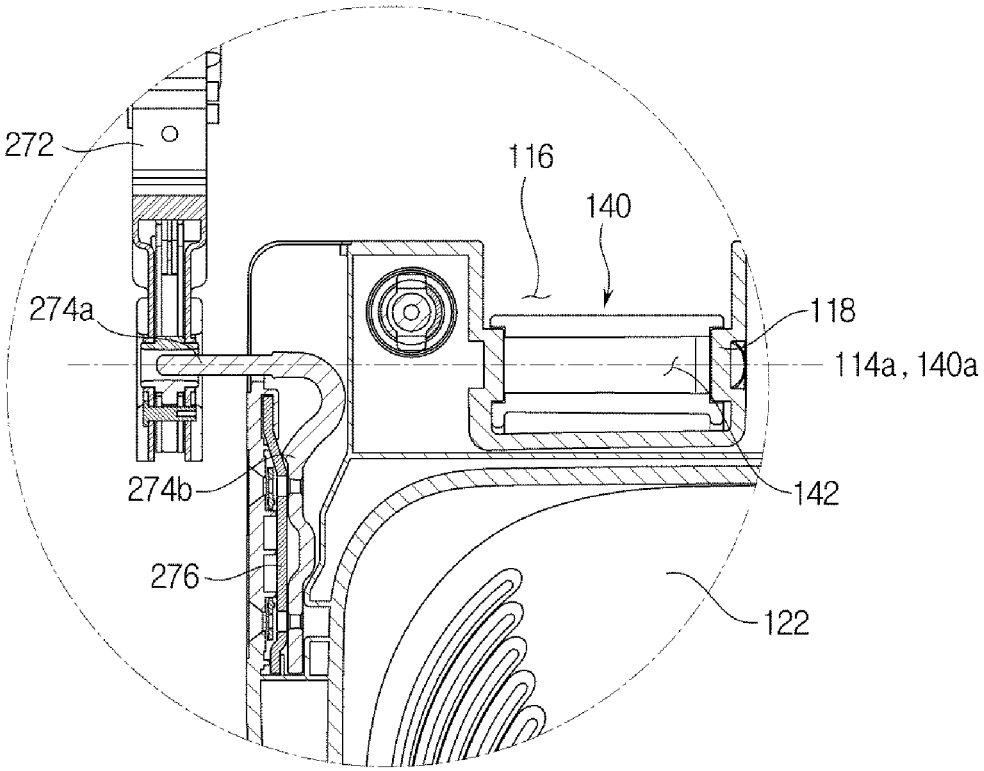
FIGS. 11A and 11B are cross-sectional views showing a damping unit of the washing machine according to the second embodiment.
Figure 11B:
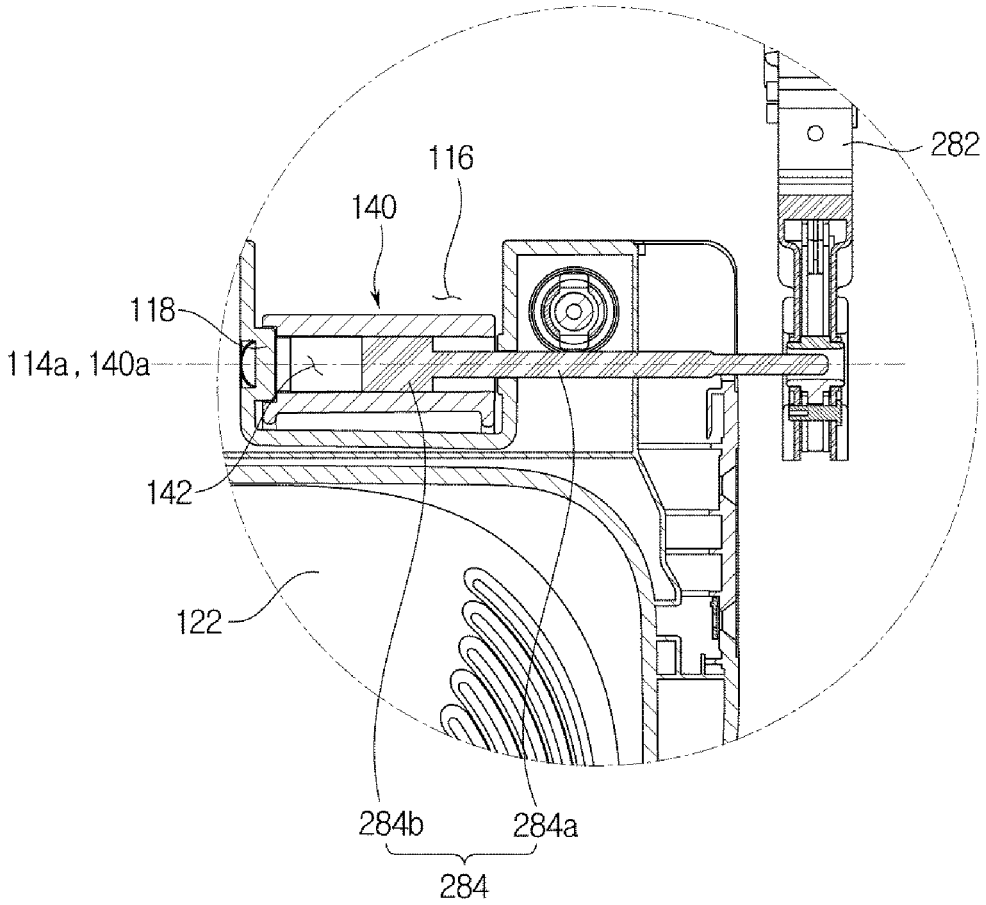

FIG. 10 is a top view of the washing machine according to the second embodiment, and FIGS. 11A and 11B are cross-sectional views showing a damping unit of the washing machine according to the second embodiment. In FIG. 10, a hinge unit 260 according to the current embodiment is represented by solid lines, and the other components are shown by dotted lines to highlight the hinge unit 260.

In the current embodiment, the door assembly 100 includes the hinge unit 260.

The hinge unit 260 may enable the door assembly 100 to pivot with respect to the main body 10. That is, the door 110 or the auxiliary washing unit 120 may pivot with respect to the main body 10 to open and close the opening 24. The hinge unit 260 may be included as a component in the door assembly 100.

The hinge unit 260 may include a damping unit 262 that is disposed on the pivot axis 114*a* or 140*a* of the door 110 or the auxiliary washing unit 120 and damps pivotal movement of the door 110 or the auxiliary washing unit 120.

The damping unit 262 generates damping effect for reducing a speed during the door 110 or the auxiliary washing unit 120 are opened or closed. Via damping of a rotation of the door 110 or the auxiliary washing unit 120 by the damping unit 262, it is possible to reduce an impact with the main body 10 when the door 110 or the auxiliary washing unit 120 are closed, and to reduce a load applied to pivoting elements when the door 110 or the auxiliary washing unit 120 are opened or closed. Thereby, it is also possible to reduce an impact or noise when the door 110 or the auxiliary washing unit 120 are opened or closed.

The damping unit 262 may include a door damping unit 270 configured to damp pivotal movement of the door 110 and provided to the door pivot axis 114*a* of the door 110, and an auxiliary damping unit 280 configured to damp pivotal movement of the auxiliary washing unit 120 and provided to the auxiliary pivot axis 140*a* of the auxiliary washing unit 120. In an embodiment, the door damping unit 270 and the auxiliary damping unit 280 are provided to affect pivotal movement of the door 110 and the auxiliary washing unit 120, however, it is also possible for only one of the door damping unit 270 and the auxiliary damping unit 280 to be provided to affect pivotal movement of the door assembly 100. Also, a plurality of door damping units 270 and a plurality of auxiliary damping units 280 may be provided to affect pivotal movement of the door 110 and the auxiliary washing unit 120.

The door damping unit 270 and the auxiliary damping unit 280 are coupled to the door 110 and the auxiliary washing unit 120, respectively, so as to affect pivotal movement of the door 110 and pivotal movement of the auxiliary washing unit 120, respectively. That is, the door damping unit 270 and the auxiliary damping unit 280 may operate independently.

The arrangement of the door damping unit 270 and the auxiliary damping unit 280 is not limited, and in the current embodiment, the door damping unit 270 may be opposite to the auxiliary damping unit 280 with the door 110 and the auxiliary washing unit 120 therebetween such that the door damping unit 270 and the auxiliary damping unit 280 do not interfere with each other. The door damping unit 270 and the auxiliary damping unit 280 may be aligned as long as they do not interfere with each other.

The door damping unit 270 may include a door damper 272 mounted to the main body 10 and configured to generate damping power, and a door damper shaft 274 connected to the door damper 272, configured to receive the damping power from the door damper 272, and coupled to the door 110.

The door damper 272 may be installed in the main body 10 so as not to be exposed to the outside. In the current embodiment, the door damper 272 may be a spring damper that is disposed in the longitudinal direction at one side of the main body 10 for efficient use of space.

The door damper shaft 274 may be connected to the door damper 272 such that the door damper shaft 274 can pivot about the door pivot axis 114*a* of the door 110. One end of the door damper shaft 274 may be connected to the door damper 272, and the other end of the door damper shaft 274 may be fixed to the door 110 to pivot together with the door 110. Through this arrangement, the door damper shaft 274 may receive damping power from the door damper 272 and reduce a pivoting speed of the door 110 when the door 110 pivots.

The shape of the door damper shaft 274 is not limited, and in the current embodiment, the door damper shaft 274 may include a first door damper shaft 274*a* connected to the door damper 272 and disposed in the axial direction of the door pivot axis 114*a* of the door 110, and a second door damper shaft 274*b* bent from the first door damper shaft 274*a*, fixed to the inner side surface of the door 110, and disposed in a radial shape with respect to the door pivot axis 114*a* of the door 110. Since the second door damper shaft 274*b* may be disposed in a radial shape with respect to the door pivot axis 114*a* along the inner side surface of the door 110, the second door damper shaft 274*b* may stably support pivotal movement of the door 110. The second door damper shaft 274*b* may be fixed to a damper fixing part provided in the inner side surface of the door 110. However, the shape of the door damper shaft 274 is not limited, and the door damper shaft 274 may have any shape with which the door damper 272 can transfer damping power upon pivotal movement of the door 110.

The auxiliary damping unit 280 may include an auxiliary damper 282 fixed to the main body 10 and configured to generate damping power, and an auxiliary damper shaft 284 connected to the auxiliary damper 282, configured to receive the damping power from the auxiliary damper 282, and fixed to the door 110.

The auxiliary damper 282 may be installed in the main body 10 so as not to be exposed to the outside. In the current embodiment, the auxiliary damper 282 may be a spring damper that is disposed in the lengthwise direction at one side of the main body 10 for efficient use of space.

The auxiliary damper shaft 284 may be connected to the auxiliary damper 282 such that the door damper shaft 274 can pivot about the auxiliary pivot axis 140*a* of the auxiliary washing unit 120. One end of the auxiliary damper shaft 284 may be connected to the auxiliary damper 282, and the other end of the auxiliary damper shaft 284 may be fixed to the auxiliary washing unit 120 to pivot together with the auxiliary washing unit 120. Specifically, the other end of the auxiliary damper shaft 284 may be coupled to the auxiliary pivot part 140 of the auxiliary washing unit 120 so that the auxiliary damper shaft 284 can pivot together with the auxiliary washing unit 120. Through this arrangement, the auxiliary damper shaft 284 may receive damping power from the auxiliary damper 282, and reduce the pivoting speed of the auxiliary washing unit 120 when the auxiliary washing unit 120 pivots.

The auxiliary damper shaft 284 may include a first auxiliary damper shaft 284*a* disposed in the axial direction of the auxiliary pivot axis 140*a* of the auxiliary washing unit 120, and a second auxiliary damper shaft 284*b* extending from the first auxiliary damper shaft 284*a* and fixed to the auxiliary pivot part 140. The second auxiliary damper shaft 284*b* may have a cross-sectional area that is wider than that of the first auxiliary damper shaft 284*a*, and can be fixed to the inside of the auxiliary pivot part 140. However, the shape of the auxiliary damper shaft 284 is not limited, and the auxiliary damper shaft 284 may have any shape with which the auxiliary damper 282 can transfer damping power upon pivotal movement of the auxiliary washing unit 120.

Hereinafter, a washing machine according to a third embodiment will be described.

In the following description, descriptions about the same components as those of embodiments described above will be omitted.

Figure 12:
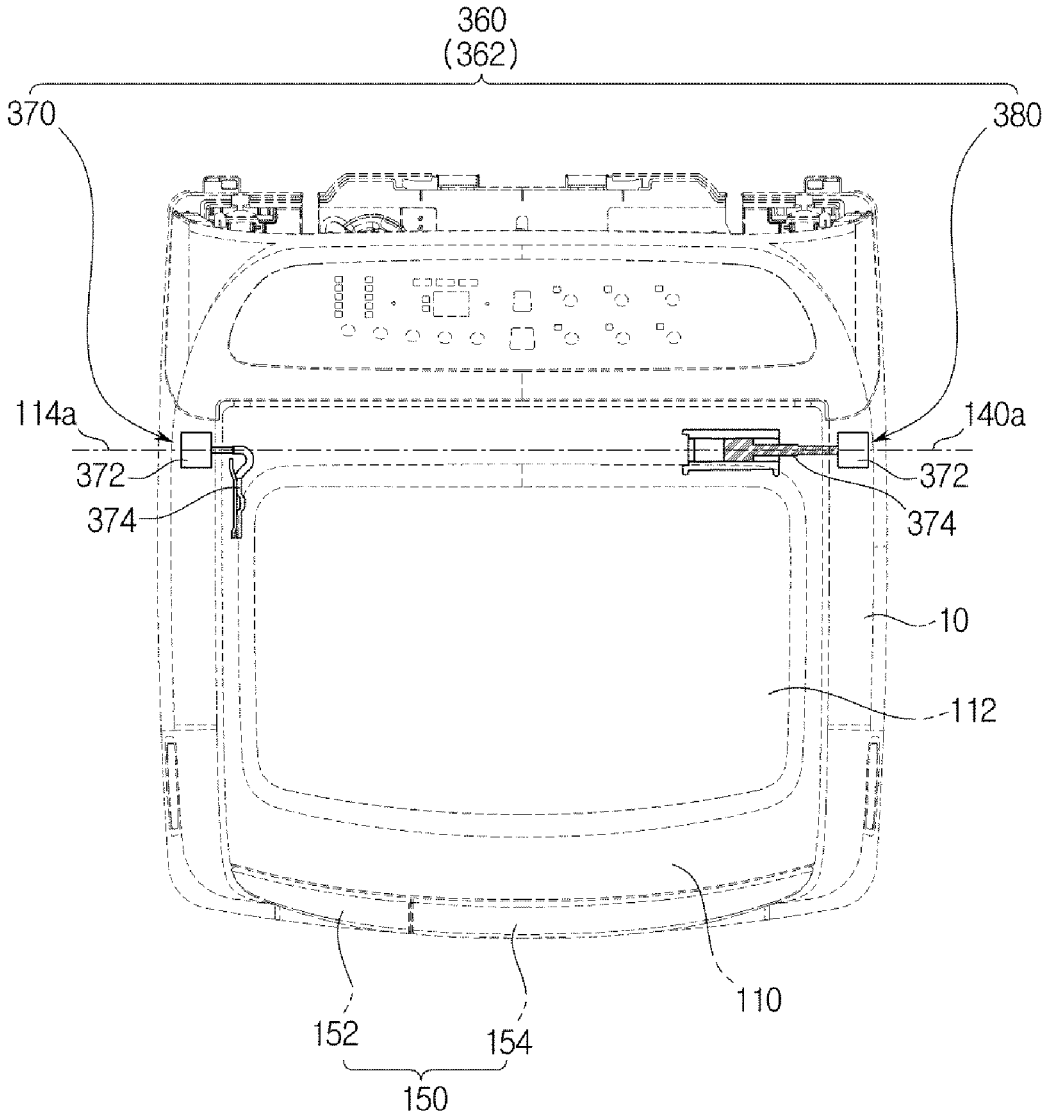
FIG. 12 is a top view of a washing machine according to a third embodiment.
Figure 13A:
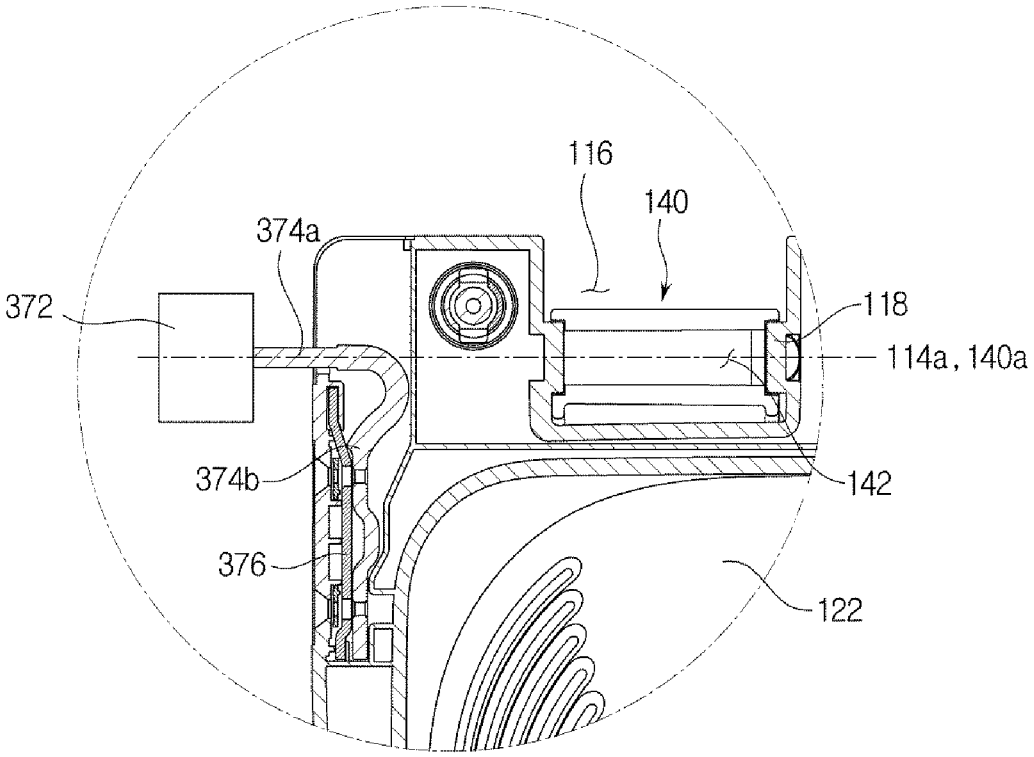
FIGS. 13A and 13B are cross-sectional views showing a damping unit of the washing machine according to the third embodiment.
Figure 13B:
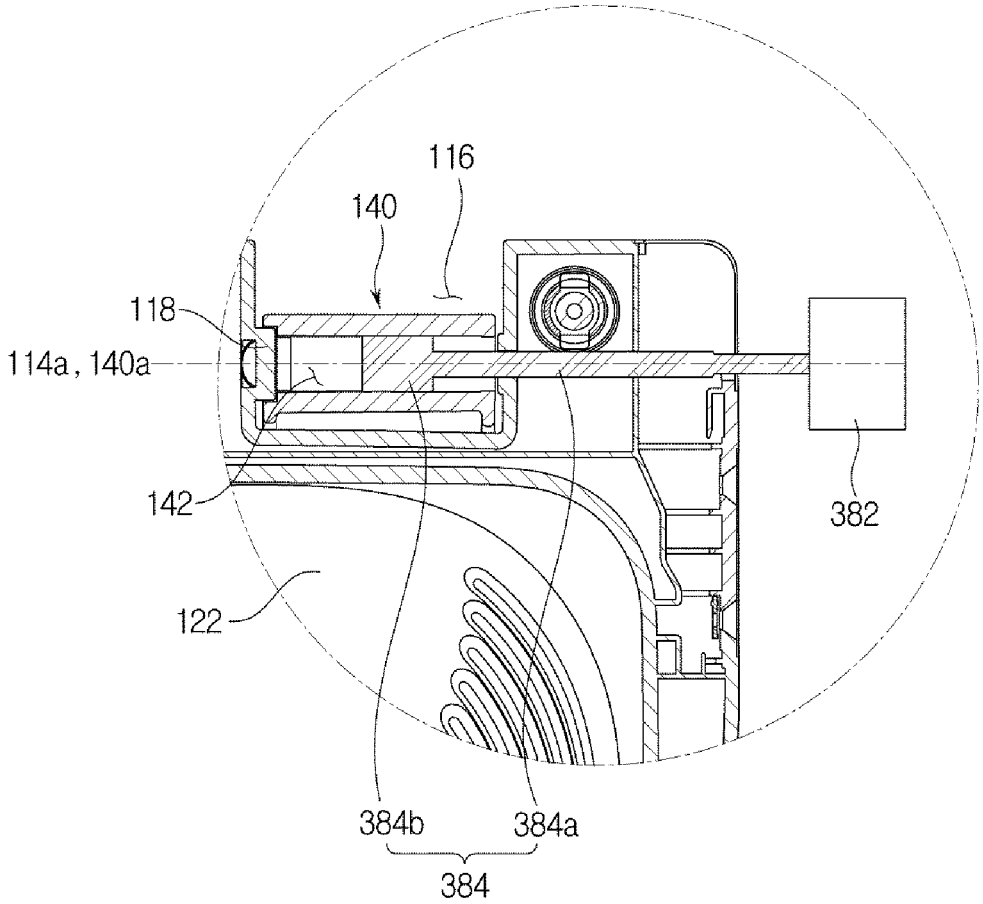

FIG. 12 is a top view of the washing machine according to the third embodiment, and FIGS. 13A and 13B are cross-sectional views showing a damping unit of the washing machine according to the third embodiment. In FIG. 12, a hinge unit 360 according to the current embodiment is represented by solid lines, and the other components are shown by dotted lines to highlight the hinge unit 360.

In the current embodiment, the door assembly 100 may include the hinge unit 360.

The hinge unit 360 may include a damping unit 362 disposed on the pivot axis 114*a* or 140*a* of the door 110 or the auxiliary washing unit 120, and configured to damp pivotal movement of the door 110 or the auxiliary washing unit 120. The damping unit 362 may include a door damper 372 and an auxiliary damper 382.

In the current embodiment, the door damper 372 and the auxiliary damper 382 may be oil dampers, unlike the second embodiment. The arrangement and shapes of the door damper 372 and the auxiliary damper 382 may be the same as in the second embodiment.

A door damper shaft 374 and an auxiliary damper shaft 384 may be configured in the same way as in the second embodiment. Also, a first door damper shaft 374*a*, a second door damper shaft 374*b*, a first auxiliary damper shaft 384*a*, a second auxiliary damper shaft 384*b*, and a damper fixing part may be configured in the same way as in the second embodiment.

Hereinafter, a washing machine according to a fourth embodiment will be described.

Configurations of the present embodiment that are the same as those of the previous embodiments will not be described again.

Figure 14:
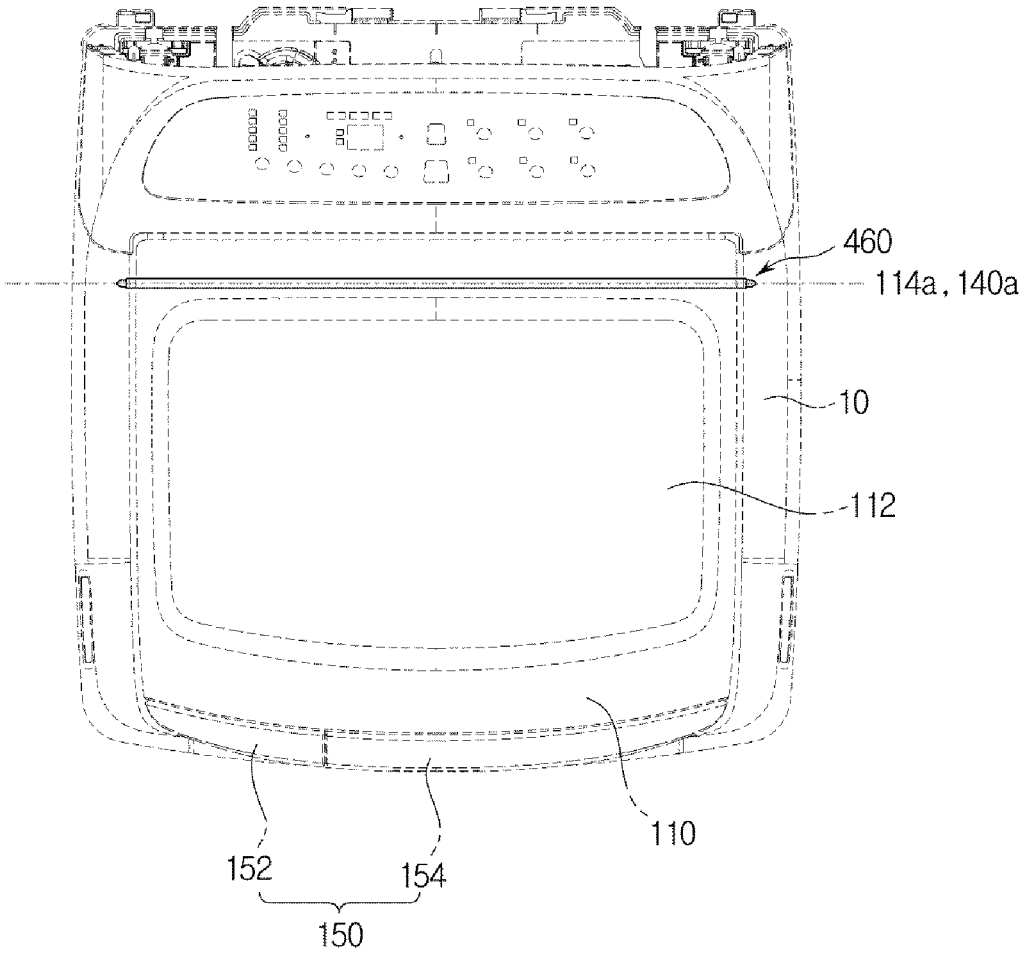
FIG. 14 is a top view of a washing machine according to a fourth embodiment.
Figure 15:
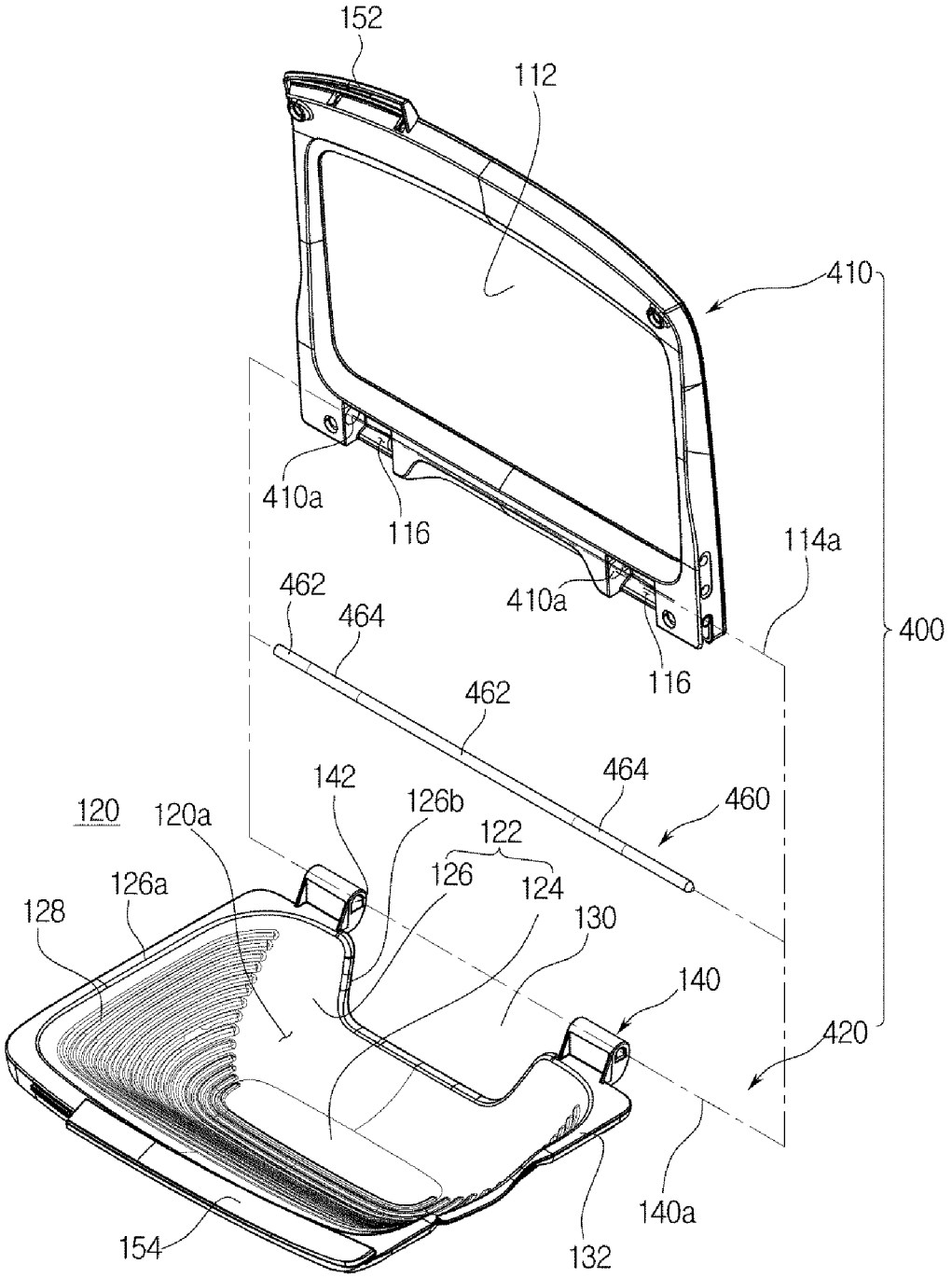
FIG. 15 is an exploded perspective view showing a part of the washing machine according to the fourth embodiment.

FIG. 14 is a top view of the washing machine according to the fourth embodiment, and FIG. 15 is an exploded perspective view showing a part of the washing machine according to the fourth embodiment.

In the current embodiment, unlike the first embodiment, a door assembly 400 pivots about a pivot shaft 460.

A door 410 and an auxiliary washing unit 420 may pivot about the same pivot axis 114*a* or 140*a*, and the pivot shaft 460 may be positioned on the pivot axis 114*a* or 140*a* in order to restrict operations of the door 410 and the auxiliary washing unit 420 to pivotal movement about the pivot axis 114*a* or 140*a*.

The pivot shaft 460 may be positioned on the pivot axis 114*a* or 140*a* such that the door 410 and the auxiliary washing unit 420 can pivot. The pivot shaft 460 may penetrate the door 410 and the auxiliary washing unit 420 so that the door 410 and the auxiliary washing unit 420 can pivot about the pivot axis 114*a* or 140*a*. The pivot shaft 460 may be in the shape of a bar, and may have a polygonal cross-section to be fixed and coupled to the door 410 and the auxiliary washing unit 420.

The pivot shaft 460 may include a door restricting part 462 configured to restrict pivotal movement of the door 410, and an auxiliary restricting part 464 extending from the door restricting part 462 in the axial direction of the pivot axis 114*a* or 140*a* and configured to restrict pivotal movement of the auxiliary washing unit 420.

The door restricting part 462 may pass through a door through hole 410*a* formed along the door pivot axis 114*a* of the door 410 to restrict pivotal movement of the door 410, and the auxiliary restricting part 464 may pass through the pivot hole 142 of the auxiliary pivot part 140 to restrict pivotal movement of the auxiliary washing unit 420.

Although the door restricting part 462 and the auxiliary restricting part 464 pivot about the same pivot axis 114*a* or 140*a*, the door restricting part 462 and the auxiliary restricting part 464 can pivot independently. Thereby, the door 410 and the auxiliary washing unit 420 can operate independently.

Hereinafter, a washing machine according to a fifth embodiment will be described.

Configurations of the present embodiment that are the same as those of the previous embodiments will not be described again.

Figure 16:
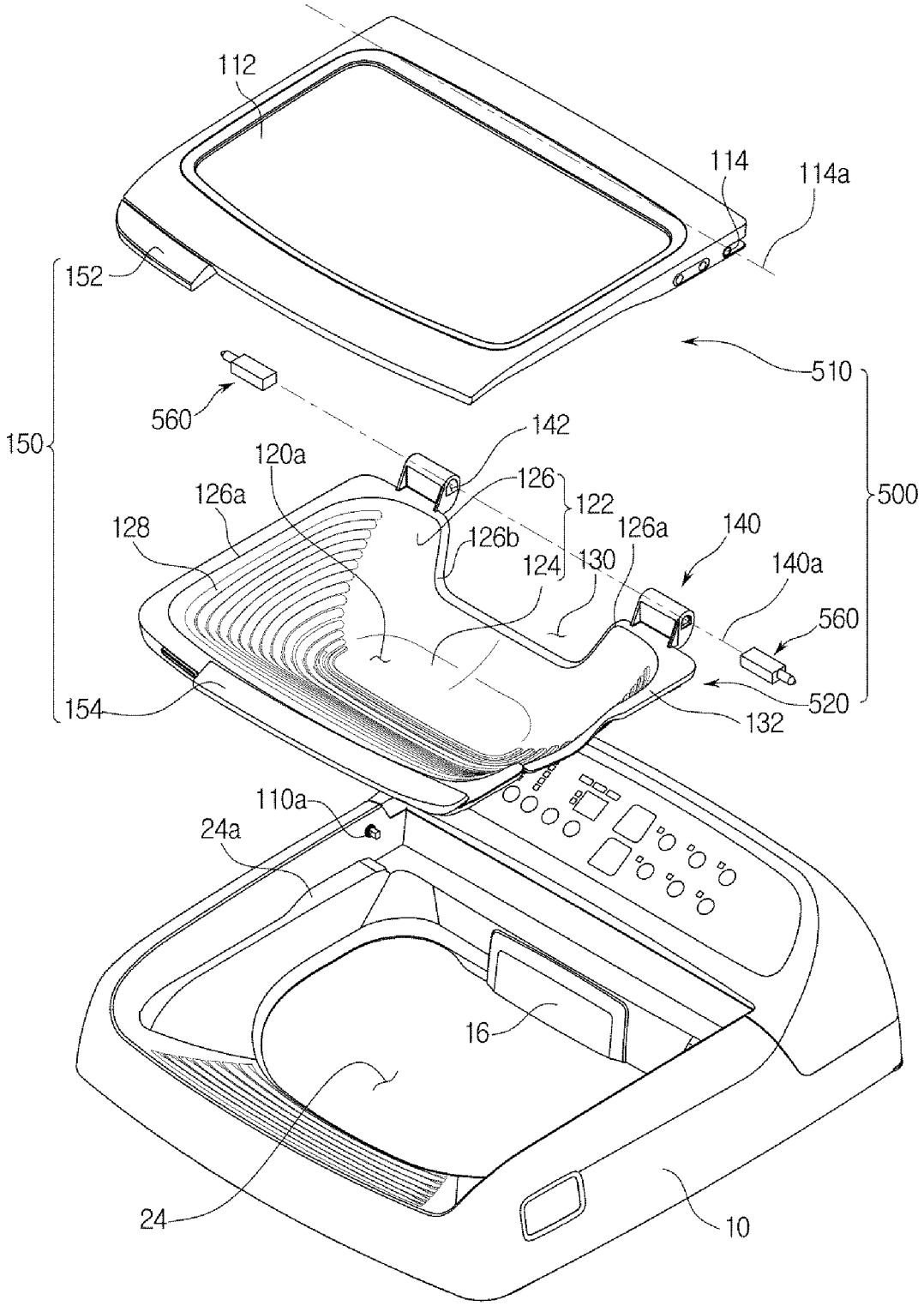
FIG. 16 is an exploded perspective view showing a part of a washing machine according to a fifth embodiment.

FIG. 16 is an exploded perspective view showing a part of the washing machine according to the fifth embodiment.

In the current embodiment, unlike the first embodiment, an auxiliary washing unit 520 can be provided separably from a door 510. That is, the auxiliary washing unit 520 forms an auxiliary washing space 120*a*, and is pivotable in the inside of the door 510, and also be provided separably from the door 510.

A configuration for enabling the auxiliary washing unit 520 to be separated from the door 510 is not limited as long as it is rotatable and can be separated from the door 510.

In the current embodiment, in one side of the auxiliary pivot part 140, a pivot hole 142 may be formed in correspondence to the pivot protrusion 118 of the door 510, and in the other side of the auxiliary pivot part 140, a pin holder 560 may be disposed in correspondence with an insertion hole of the door 510 to be pivotably coupled to the door 510.

The pin holder 560 may be disposed in the auxiliary washing unit 520, and form the auxiliary pivot axis 140*a* which is the center of rotation of the auxiliary washing unit 520 so that the auxiliary washing unit 520 can pivot in the inside of the door 510 and also can be separated from the door 510. The auxiliary pivot axis 140*a* formed by the pin holder 560 may be the same as the door pivot axis 114*a* which is the center of rotation of the door 510.

The arrangement of the pin holder 560 is not limited, and in the current embodiment, the pin holder 560 may be installed in the auxiliary pivot part 140. The pin holder 560 may include a holder main body 562 fixed to the auxiliary pivot part 140 of the auxiliary washing unit 520, and a moving protrusion 564 configured to move forward or backward from the holder main body 562 in the axial direction of the auxiliary pivot axis 140*a* of the auxiliary washing unit 520, and selectively pivotably coupled to the door 510.

The holder main body 562 may be fixed in the auxiliary pivot part 540, and extend in the longitudinal direction of the auxiliary pivot axis 140*a*. The holder main body 562 may have an internal space in which the moving protrusion 564 can move forward and backward.

The moving protrusion 564 may move forward and backward with respect to the holder main body 562 between a protruding position 564*a* at which the moving protrusion 564 protrudes from the holder main body 562 along the auxiliary pivot axis 140*a* and an inserted position 564*b* at which at least one part of the moving protrusion 564 is inserted into the holder main body 562. That is, when the auxiliary washing unit 520 is coupled to the door 510, the moving protrusion 564 may be at the protruding position 564*a* so that the auxiliary washing unit 520 can pivot about the auxiliary pivot axis 140*a*, and when the auxiliary washing unit 520 is separated from the door 510, the moving protrusion 564 may be at the inserted position 564*b* so that the auxiliary washing unit 520 can be separated from the door 510.

The pin holder 560 may further include an elastic member 566. The elastic member 566 may be disposed in the holder main body 562 on the moving path of the moving protrusion 564 so that the moving protrusion 564 can move forward and backward. The moving protrusion 564 may move from the protruding position 564*a* to the inserted position 564*b* due to an external force, and move from the inserted position 564*b* to the protruding position 564*a* due to a restoring force of the elastic member 566.

A method for causing the moving protrusion 564 to move between the protruding position 564*a* and the inserted position 564*b* is not limited. For example, the moving protrusion 564 may be electronically controlled by connecting the moving protrusion 564 to a motor, or the moving protrusion 564 may be physically controlled by applying an external force to move the moving protrusion 564 from the protruding position 564*a* to the inserted position 564*b*.

Hereinafter, an operation of coupling and separation of the auxiliary washing unit 520 and the door 510 will be described.

Figure 17A:
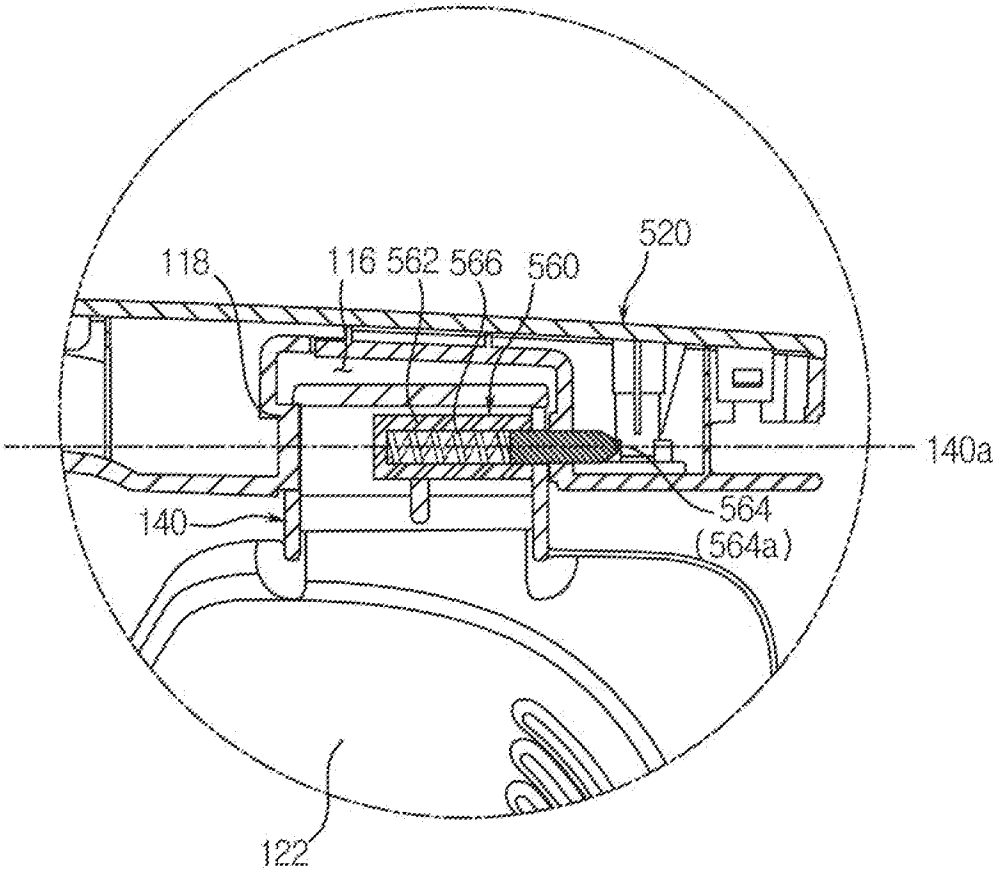
FIGS. 17A, 17B, and 17C illustrate an operation of detaching an auxiliary washing unit from the washing machine according to the fifth embodiment.
Figure 17B:
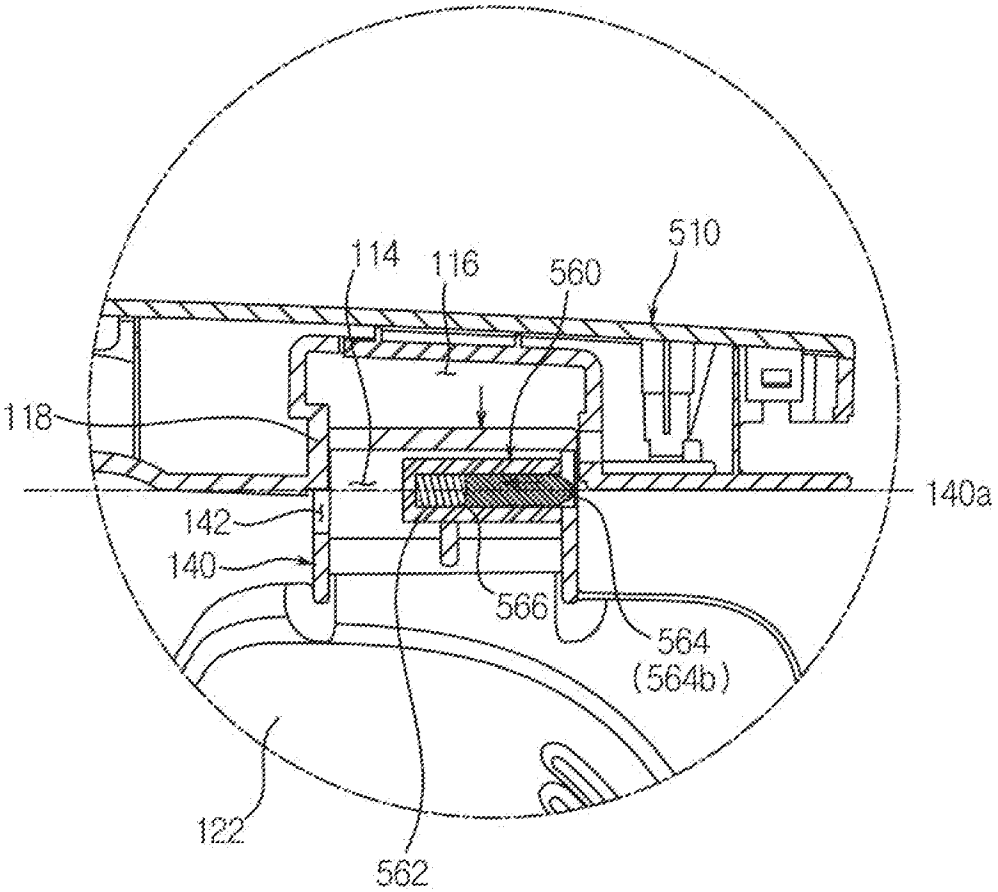
Figure 17C:
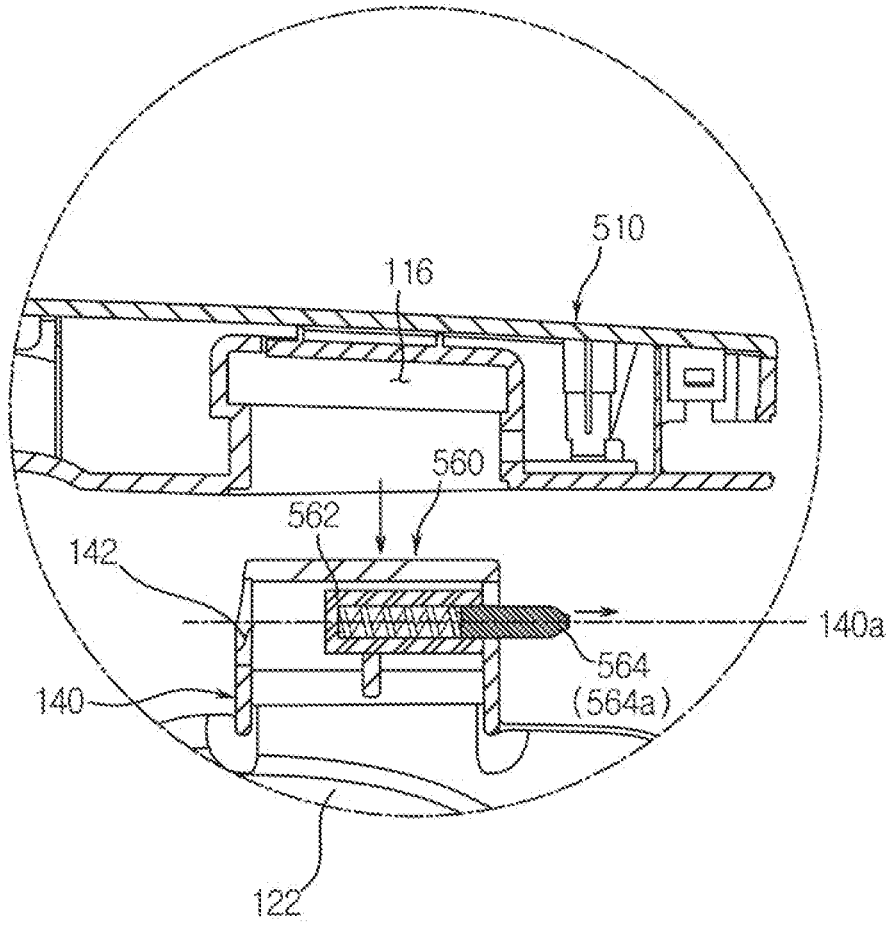

FIGS. 17A, 17B, and 17C illustrate the operation of separating the auxiliary washing unit 520 from the washing machine according to the fifth embodiment.

As shown in FIG. 17A, when the auxiliary washing unit 520 is coupled to the door 510, the moving protrusion 564 may be at the protruding position 564*a*. The auxiliary washing unit 520 may pivot about the auxiliary pivot axis 140*a* through the moving protrusion 564 and the pivot protrusion 118 of the door 510.

When the auxiliary washing unit 520 is separated from the door 510, the moving protrusion 564 may move from the protruding position 564*a* to the inserted position 564*b* so that the auxiliary washing unit 520 is not restricted by the door 510, as shown in FIGS. 17B and 17C. After the auxiliary washing unit 520 is separated from the door 510, the moving protrusion 564 may return to the protruding position 564*a* from the inserted position 564*b* due to the elastic member 566.

Hereinafter, a washing machine according to a sixth embodiment will be described.

Configurations of the present embodiment that are the same as those of the previous embodiments will not be described again.

Figure 18:
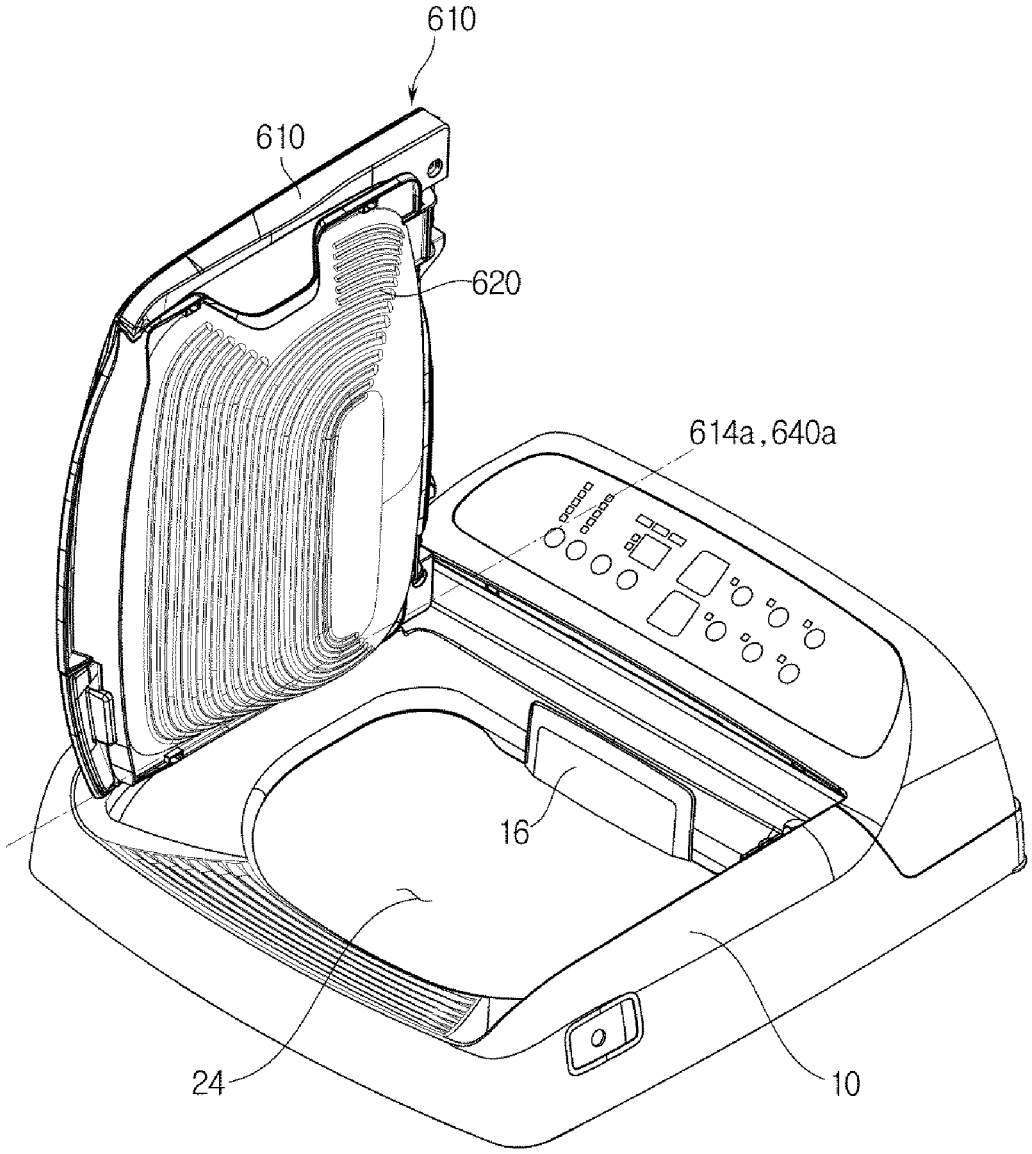
FIG. 18 is a perspective view showing a part of a washing machine according to a sixth embodiment.

FIG. 18 is a perspective view showing a part of the washing machine according to the sixth embodiment.

In an embodiment, a door assembly 600 may be provided to be opened and closed in a left-right direction. That is, unlike the above-described embodiments in which the pivot axes 114*a* and 140*a* are located behind the opening 24 so that the door assembly pivots in a front-back direction on the pivot axis 114*a* or 140*a*, in this embodiment, a door pivot axis 614*a* of a door 610 and an auxiliary pivot axis 640*a* of an auxiliary washing unit 620 are located on one side of the opening 24 so that the door assembly 600 pivots on the door pivot axis 614*a* or the auxiliary pivot axis 640*a*.

Specifically, the door assembly 600 may be hinge-coupled to a part of a main body corresponding to one side of the opening 24, so as to pivot in the left-right direction with respect to the main body. The door 610 of the door assembly 600 and the auxiliary washing unit 620 may pivot in different directions to open and close the opening 24, and in this embodiment, the door 610 of the door assembly 600 and the auxiliary washing unit 620 may be hinge-coupled to the left side of the main body as seen from the front of the main body, so as to pivot in the left-right direction.

Hereinafter, a washing machine according to a seventh embodiment will be described.

Configurations of the present embodiment that are the same as those of the previous embodiments will not be described again.

Figure 19:
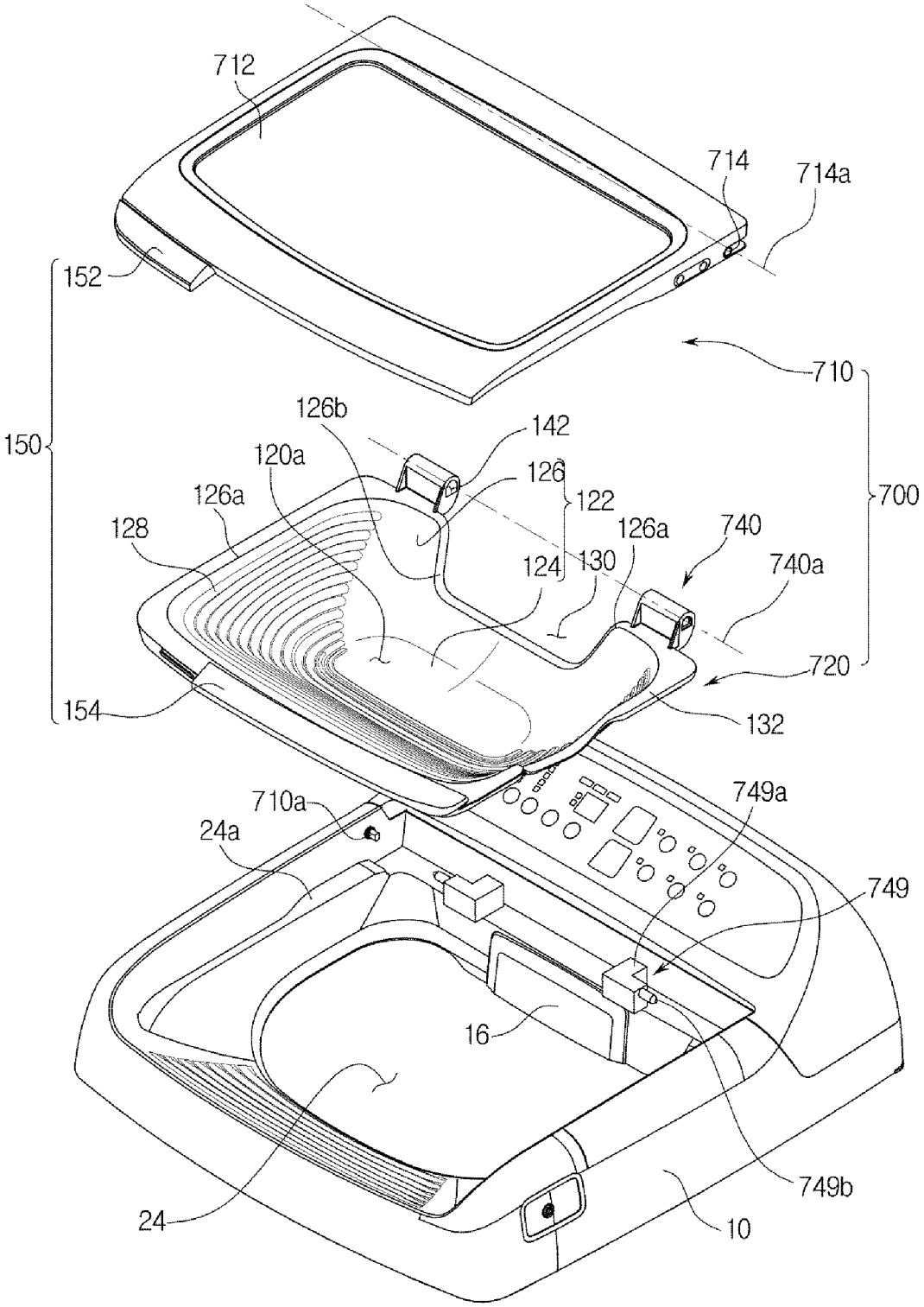
FIG. 19 is an exploded perspective view showing a part of a washing machine according to a seventh embodiment.
Figure 20:
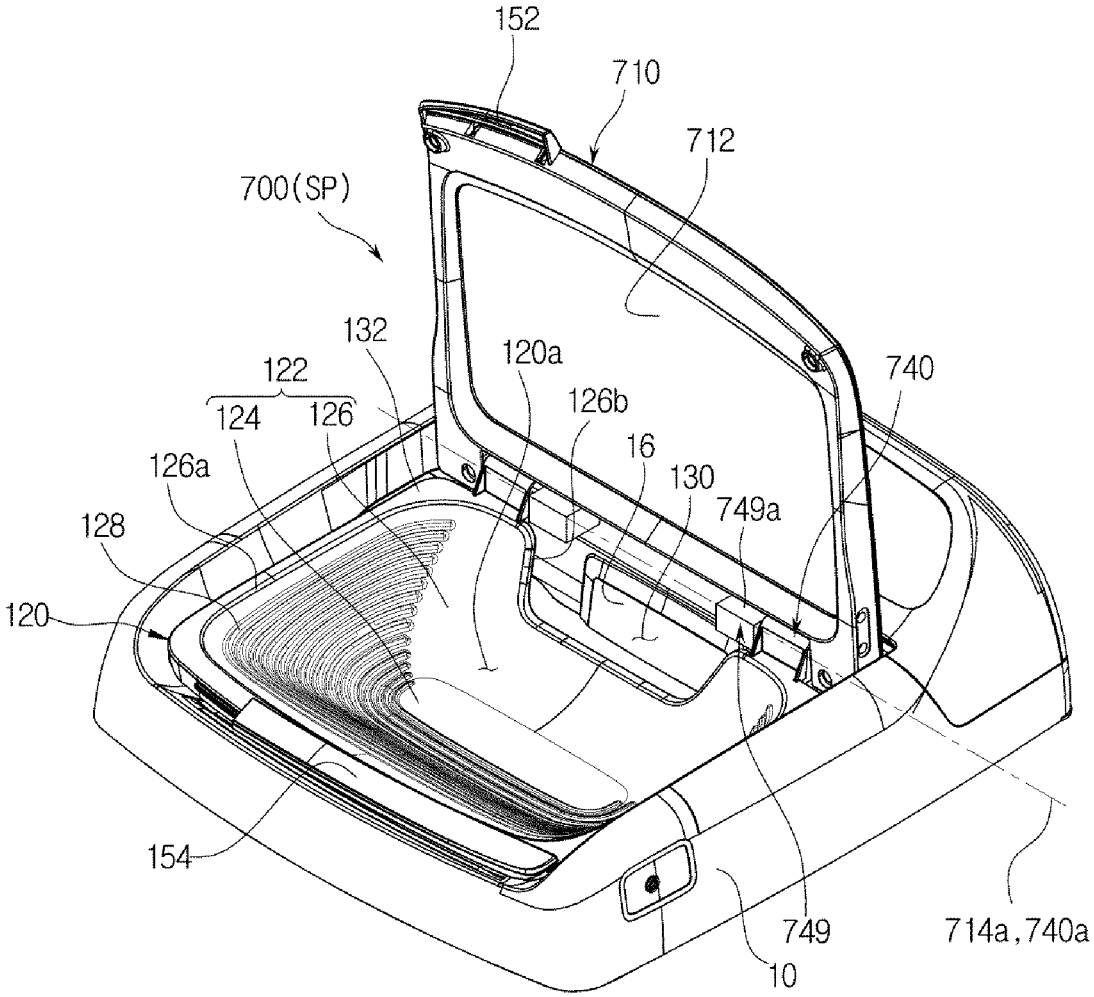
FIG. 20 is a perspective view showing a part of the washing machine according to the seventh embodiment.

FIG. 19 is an exploded perspective view showing a part of the washing machine according to the seventh embodiment, and FIG. 20 is a perspective view showing a part of the washing machine according to the seventh embodiment.

In the current embodiment, a door assembly 700 may be configured such that both a door 710 and an auxiliary washing unit 720 pivot with respect to the main body 10.

In order for the auxiliary washing unit 720 to pivot with respect to the main body 10, the auxiliary washing unit 720 may be pivotably coupled to the main body 10 to pivot about a first pivot axis, and in order for the door 110 to pivot with respect to the main body 10, the door 110 may be pivotably coupled to the main body 10 to pivot about a second pivot axis. Herein, the first pivot axis may be an auxiliary pivot axis 740*a* passing through an auxiliary pivot part 740, and the second pivot axis may be a door pivot axis 714*a* passing through an accommodation part 714.

The auxiliary washing unit 720 and the door 710 may also be referred to as a first door and a second door, respectively. Also, the auxiliary pivot part 740 and the accommodation part 714 may be referred to as a first door-main body coupling part and a second door-main body coupling part, respectively. The first door-main body coupling part 740 and the second door-main body coupling part 714 may each be provided as at least one piece. The door 710 may include the accommodation part 714, and a door pivot part 710*a* may be inserted into the accommodation part 714 to pivotably support the door 710 with respect to the main body 10. However, the present invention is not limited thereto, and the door pivot part 710*a* may be formed in the shape of a protrusion protruding in the axial direction of the door pivot axis 714*a* from the outer side surface of the door 710 such that the door 710 can pivot about the door pivot axis 714*a*. That is, the door pivot part 710*a* may have any shape that enables the door 710 to pivot with respect to the main body 10.

The auxiliary washing unit 720 may pivot with respect to an auxiliary hinge 749 installed in the main body 10. Unlike the above-described embodiment in which the auxiliary washing unit pivots with respect to the door, in this embodiment, the auxiliary washing unit 720 may pivot with respect to the main body 10.

The auxiliary hinge 749 includes an auxiliary hinge body 749*a* extending from the main body 10, and an auxiliary hinge shaft 749*b* protruding from the auxiliary hinge body 749*a* and enabling the auxiliary washing unit 720 to pivot. The auxiliary pivot axis 740*a* of the auxiliary washing unit 720 may be formed through the auxiliary hinge shaft 749*b*.

The auxiliary hinge shaft 749*b* may be inserted into the auxiliary pivot part 740 so that the auxiliary pivot axis 740*a* passes through the auxiliary hinge shaft 749*b*.

The auxiliary hinge body 749*a* may extend from the main body 10 to support the auxiliary hinge shaft 749*b*. The auxiliary hinge body 749*a* may be disposed behind the opening 24 in the main body 10. The auxiliary hinge body 749*a* may include an auxiliary hinge damper (not shown) to damp pivotal movement of the auxiliary hinge shaft 749*b*.

A reference numeral 712 represents a transparent member as described above.

A locking part for locking the door 110 with the auxiliary washing unit 120 so that the door 110 is not separated from the auxiliary washing unit 120 when the door assembly 100 is at the opened position OP may be provided. Hereinafter, the locking part for locking the door 110 with the auxiliary washing unit 120 will be described.

Figure 21:
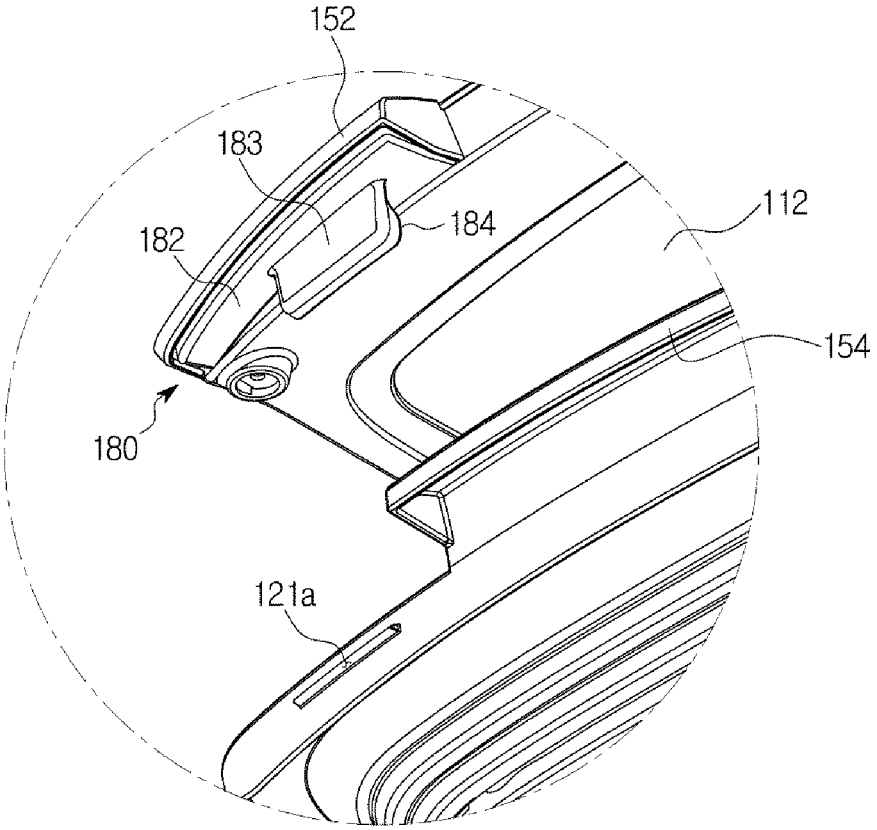
FIG. 21 is a perspective view showing a locking part of a door assembly according to an eighth embodiment.
Figure 22:
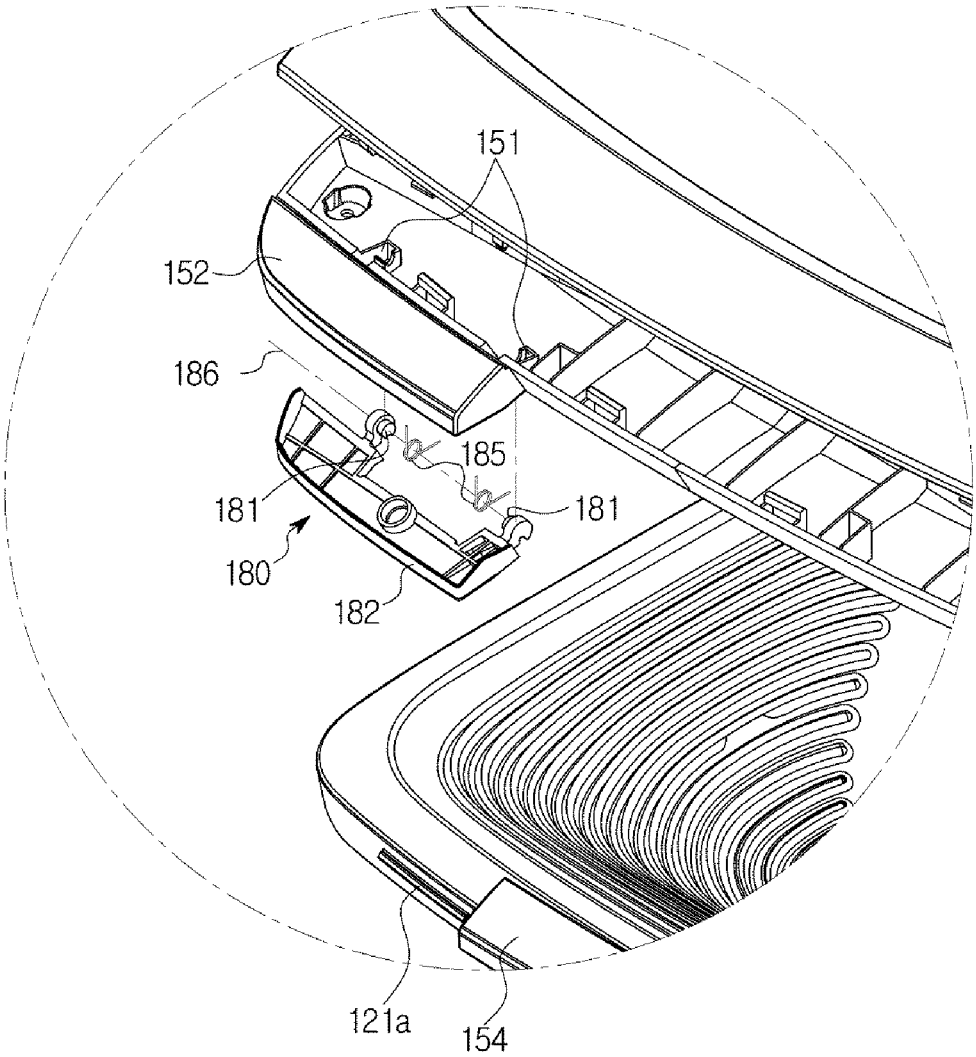
FIG. 22 is an exploded perspective view showing the locking part of the door assembly according to the eighth embodiment.
Figure 23A:
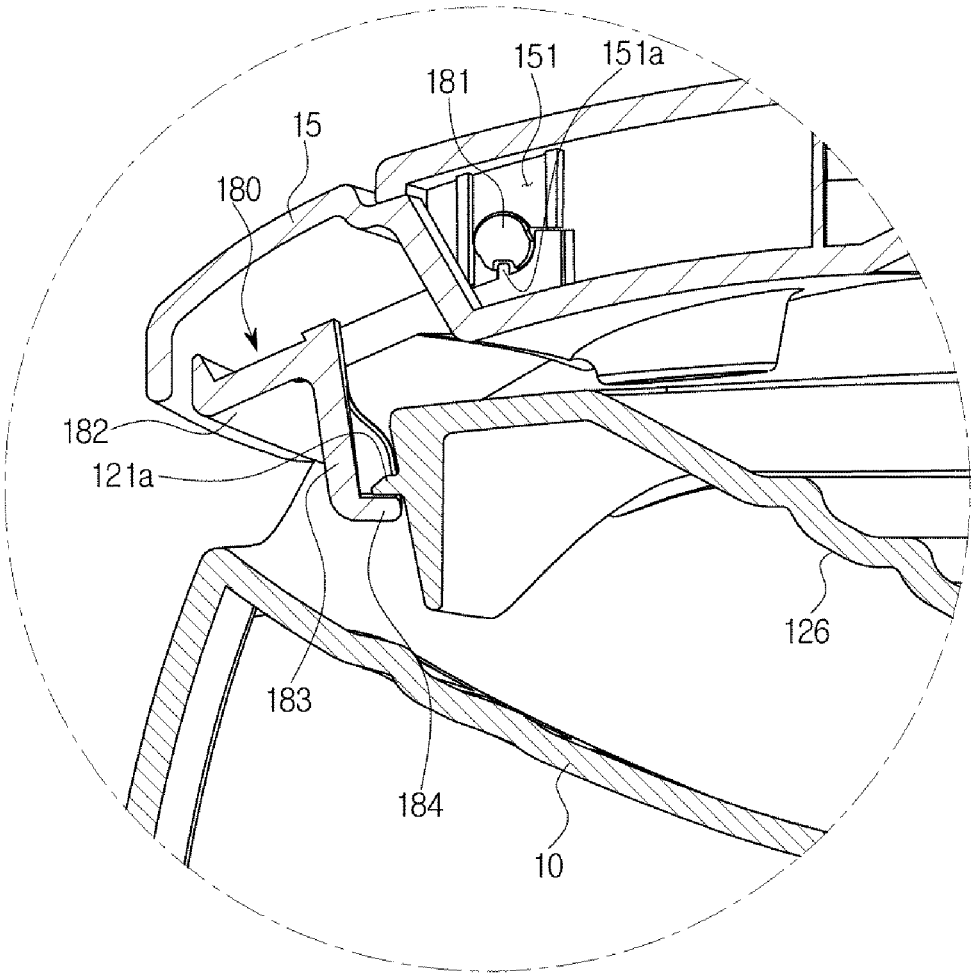
FIG. 23A is a cross-sectional view showing a locked state of the door assembly according to the eighth embodiment.
Figure 23B:
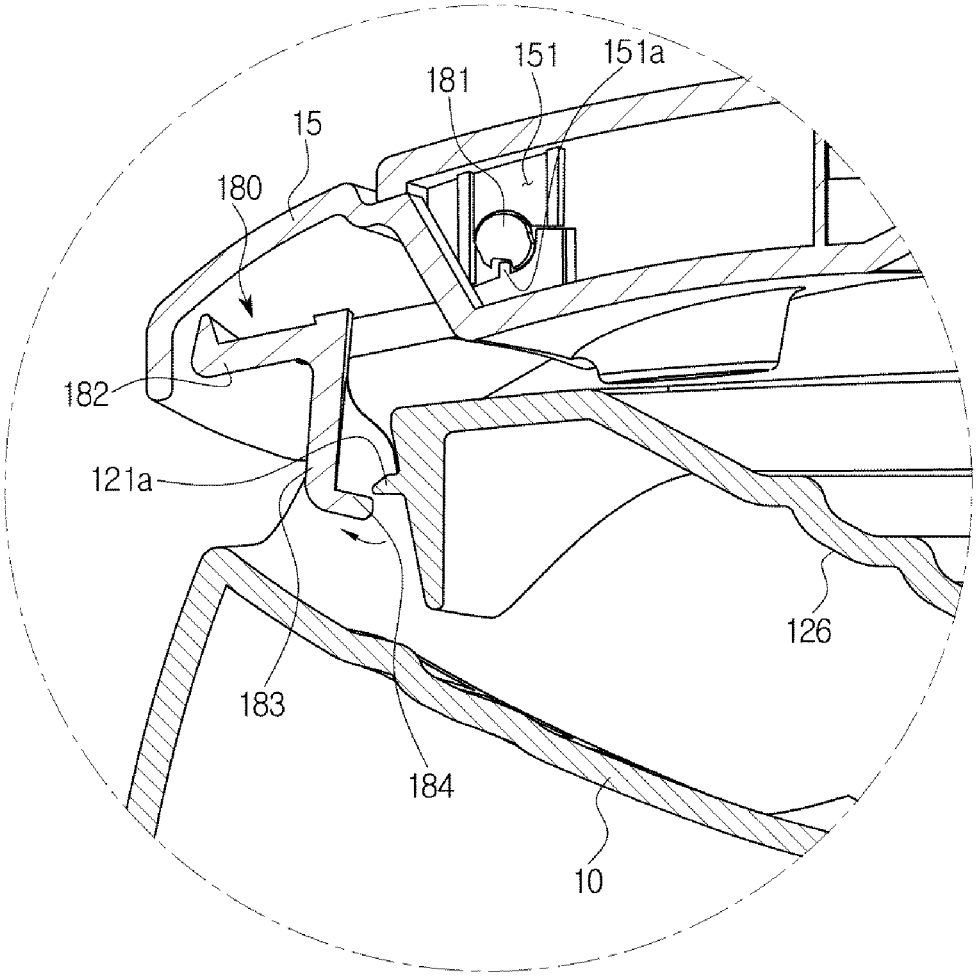
FIG. 23B is a cross-sectional view showing an unlocked state of the door assembly according to the eighth embodiment.
Figure 24:
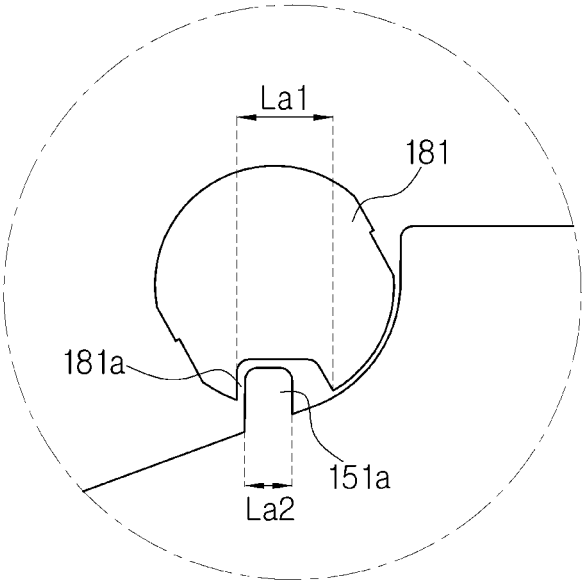
FIG. 24 is an enlarged view of an area I of FIG. 23A.

FIG. 21 is a perspective view showing a locking part of a door assembly according to an eighth embodiment, FIG. 22 is an exploded perspective view showing the locking part of the door assembly according to the eighth embodiment, FIG. 23A is a cross-sectional view showing a locked state of the door assembly according to the eighth embodiment, FIG. 23B is a cross-sectional view showing an unlocked state of the door assembly according to the eighth embodiment, and FIG. 24 is an enlarged view of an area I of FIG. 23A.

Referring to FIGS. 21 to 24, a door assembly 100 according to the eighth embodiment may include a locking structure for coupling the door 110 to the auxiliary washing unit 120 so that the door 110 is not separated from the auxiliary washing unit 120. For example, a locking part in the shape of a protrusion part may be formed in any one of the door 110 and the auxiliary washing unit 120, and a catching part for catching the locking part may be formed in the other of the door 110 and the auxiliary washing unit 120. The locking part may be released from the catching part according to a user's manipulation. Hereinafter, an embodiment in which the door 110 includes a locking part 180 and the auxiliary washing unit 120 includes a catching part 212*a* will be described.

The door 110 may include the locking part 180, and the auxiliary washing unit 120 may include the catching part 121*a* so that the door 110 is coupled to the auxiliary washing unit 120 when the locking part 180 is caught by the catching part 121*a*. The locking part 180 may be disposed at the door handle part 152. The catching part 121*a* may be disposed on the front surface of the auxiliary washing unit 120 corresponding to the location of the locking part 180. The catching part 121*a* may protrude from the front side surface of the auxiliary washing unit 120 to catch a projection part 184 of the locking part 180, which will be described below. However, the locations and shapes of the locking part 180 and the catching part 121*a* are not limited to those described above.

A state in which the locking part 180 is caught by the catching part 121*a* so that the door 110 is not separated from the auxiliary washing unit 120 may be referred to as a locked state of the door assembly 100. A state in which the locking part 180 is released from the catching part 121*a* according to a user's manipulation may be referred to as an unlocked state of the door assembly 100.

The locking part 180 may be positioned on the lower surface of the door handle part 152. The locking part 180 may be configured to be pivotable on a pivot axis 186. The locking part 180 may include a manipulation part 182 mounted on the lower surface of the door handle part 152, an extending part 183 protruding at a predetermined angle from the manipulation part 182, and the projection part 184 protruding from the extending part 183.

The extending part 183 may extend at an angle of about 90 degrees from the manipulation part 182. The projection part 184 may protrude from the end of the extending part 183. The projection part 184 may be caught by the catching part 121*a* formed in the auxiliary washing unit 120.

A pivot protrusion 181 may be provided at one side of the manipulation part 182. The pivot protrusion 181 may protrude up to the pivot axis 186 so that the manipulation part 182 can pivot about the pivot axis 186. An accommodation part 151 into which the pivot protrusion 181 can be inserted may be provided on the door 110 adjacent to the door handle part 152. The pivot protrusion 181 may be pivotable in the accommodation part 151.

A pivot hole 181*a* may be formed at one side of the pivot protrusion 181. The pivot hole 181*a* may have a predetermined width La1, and extend in the axial direction of the pivot axis 186. An insertion part 151*a* may protrude into the accommodation part 151 provided in the door 110. The insertion part 151*a* may extend in the axial direction of the pivot axis 186.

The width La1 of the pivot hole 181*a* may be larger than a thickness La2 of the insertion part 151*a*. If the pivot protrusion 181 pivots to a predetermined angle about the pivot axis 186, the inner side of the pivot hole 181*a* may be caught by the insertion part 151*a* so that the pivot protrusion 181 does not pivot the predetermined angle or more.

The locking part 180 may further include an elastic member 185. In order to prevent the door 110 from being separated from the auxiliary washing unit 120 when the door assembly 100 is at the opened position OP or at the closed position CP, the elastic member 185 may press the locking part 180 to maintain the state in which the protrusion part 184 is caught by the catching part 121*a*. For example, the elastic member 185 may press the upper surface of the manipulation part 182 downward. The manipulation part 182 may pivot counterclockwise about the pivot axis 186 due to the elastic member 185 so that the protrusion part 184 can be caught by the catching part 121*a*.

Accordingly, when the door assembly 100 is at the opened position OP or at the closed position CP without application of any external force, the state in which the door 110 is coupled to the auxiliary washing unit 120 by the locking part 180 can be maintained.

A user may apply a force to the manipulation part 182 in a direction that is opposite to that of a force applied to the manipulation part 182 by the restoring force of the elastic member 185 to thereby release the locked state of the locking part 180. For example, if the user presses the lower surface of the manipulation part 182 upward with a force that is greater than the restoring force of the elastic member 185, the manipulation part 182 may pivot counterclockwise about the pivot axis 186 so that the protrusion part 184 can be decoupled from the catching part 121*a*. Then, the locked state of the locking part 180 may be released so that the door 110 and the auxiliary washing unit 120 become pivotable about the pivot axis 114*a* or 140*a*.

When the door assembly 100 is at the closed position CP, the user may operate the door handle part 152 while pressing the manipulation part 182 to thus open only the door 110. Then, the user may perform manual washing in the auxiliary washing unit 120 that covers the opening 24. Also, when the door assembly 100 is at the opened position OP, the user may operate the auxiliary handle part 154 while pressing the manipulation part 182 so that the auxiliary washing unit 120 covers the opening 24 of the washing machine 1.

If no external force is applied to the locking part 180 when the door 110 is coupled to the auxiliary washing unit 120 by the locking part 180, the user may operate the handle part 150 to pivot the door 110 and the auxiliary washing unit 120 together. If no auxiliary washing is needed, the user may manipulate the handle part 150 without applying an external force to the locking part 180 to position the door assembly 100 at the opened position or at the closed position CP.

If manual washing is needed, the user may press the manipulation part 182 of the locking part 180 to release the locked state of the locking part 180. If the locked state of the locking part 180 is released, the door 110 and the auxiliary washing unit 120 may pivot separately on the pivot axes 114 and 140*a*. The user may position the door assembly 100 at the auxiliary washing position SP to perform manual washing.

The user may pivot and press any one of the door 110 and the auxiliary washing unit 120 toward the other so that the protrusion part 184 is caught by the catching part 121*a*. If the protrusion part 184 is positioned to be caught by the catching part 121, the state in which the protrusion part 184 is caught by the catching part 121*a* can be maintained by the elastic member 185. Thereby, the door assembly 100 may be in a locked state.

If manual washing is needed, the user may manipulate the door handle part 152 to open the door 110. The user may perform manual washing in the auxiliary washing unit 120, and after finishing manual washing, the user may manipulate the auxiliary handle part 154 to pivot the auxiliary washing unit 120 toward the door 110 and put laundry into the main washing space. If laundry is put into the main washing space, the user pivots the door 110 and the auxiliary washing unit 120 to cover the opening 24 so that the door assembly 100 is at the closed position CP. If the door assembly 100 is at the closed position CP, the user can perform washing by the washing machine 1.

Figure 25:
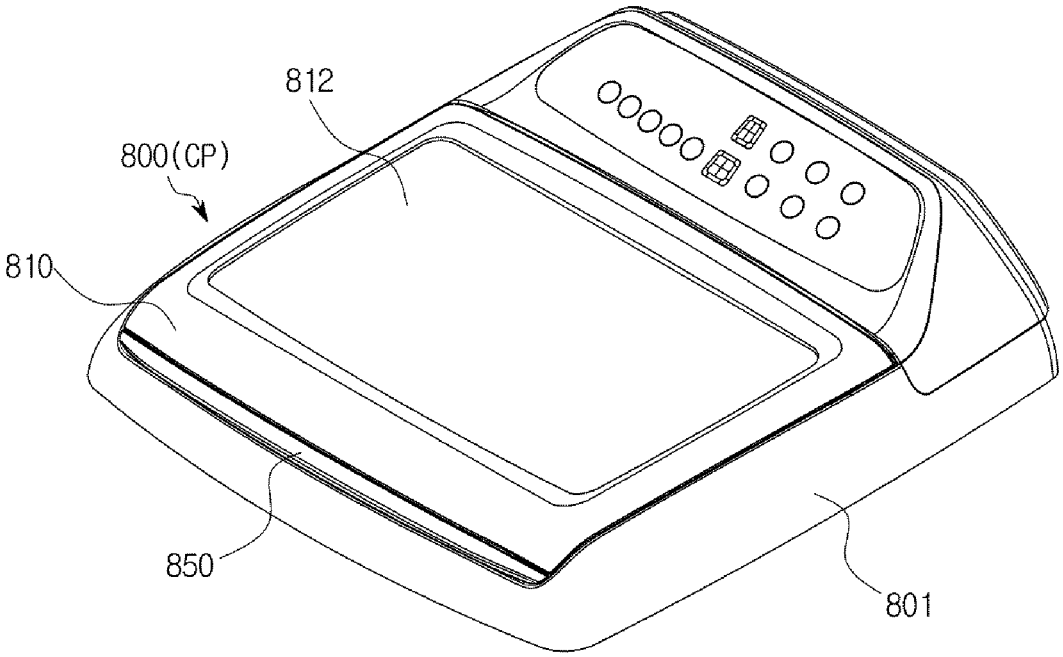
FIG. 25 is a perspective view showing a door assembly according to a ninth embodiment.
Figure 26:
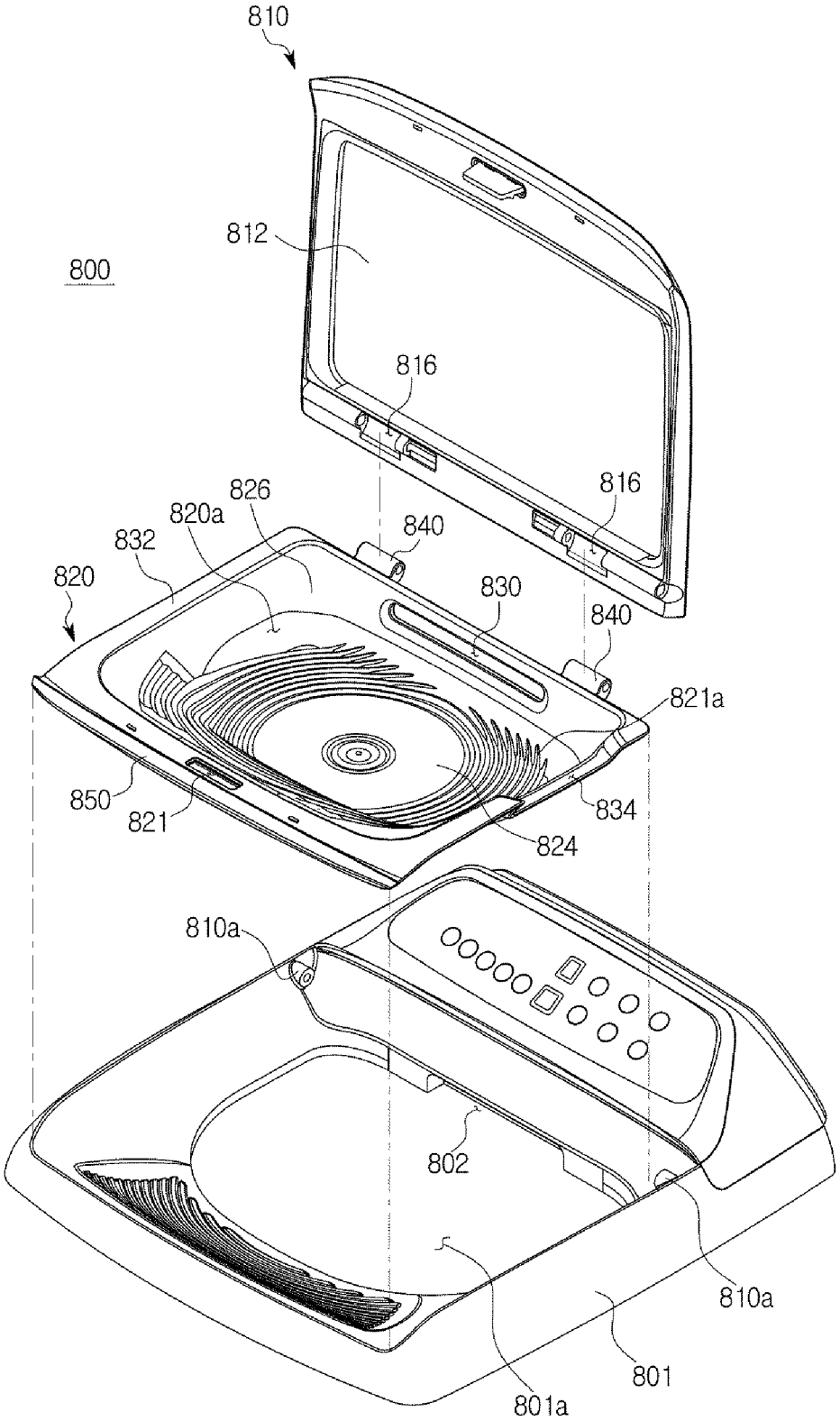
FIG. 26 is an exploded perspective view showing the door assembly according to the ninth embodiment.

FIG. 25 is a perspective view showing a door assembly according to a ninth embodiment, and FIG. 26 is an exploded perspective view showing the door assembly according to the ninth embodiment.

Referring to FIGS. 25 and 26, a door assembly 800 according to the ninth embodiment may include a door 810 and an auxiliary washing unit 820. The door assembly 800 may be provided to open and close an opening 801*a*. Descriptions of the door assembly 100 shown in FIGS. 2 and 3 can be applied in a similar way to the door assembly 800 shown in FIGS. 25 and 26.

The door assembly 800 may be mounted on the main body 801 to open and close the opening 803. A pivot part 810*a* may be provided in one side of the main body 801 so that the door assembly 800 can be pivotably coupled to the main body 801. The pivot part 810*a* may protrude in the shape of a protrusion part to be inserted into an accommodation part (not shown) formed in the door 810. Thereby, the door 810 may be pivotably supported with respect to the main body 801. The shape of the pivot part 810 is not limited. A reference numeral 802 represents a detergent supply device.

The door 810 may include a transparent member 812 so that the inside of the washing machine 1 is visible when the door 110 closes the opening 24.

The auxiliary washing unit 820 includes an auxiliary washing space 820*a* so that a user can perform manual washing. Since the auxiliary washing space 820*a* may be partitioned from the main washing space 11*a*, washing can be performed independently in each space. Also, washing can be performed separately or simultaneously in the main washing space 11*a* and the auxiliary washing space 820*a*.

The auxiliary washing unit 820 may have the same pivot axis as the door 810, and be pivotable about the pivot axis in the inside of the door 810.

A handle part 850 may be provided in front of the auxiliary washing unit 820. The user may manipulate the handle part 850 to open and close the door assembly 800. If the door assembly 800 is installed in the main body 801, the handle part 850 may protrude forward from the door 810. That is, a front-back width W1 of the door 810 may be shorter than a front-back width W2 of the auxiliary washing unit 820 including the handle part 850.

The auxiliary washing space 820*a* of the auxiliary washing unit 820 may be defined by a bottom part 824 and a side part 826. The bottom part 824, which is a factor determining a depth of the auxiliary washing space 820*a*, may be flat or curved. The side part 826 may be curved toward the bottom part 824. The bottom part 824 and the side part 826 may be configured to define the auxiliary washing space 820*a* in a recessed shape in order to reserve washing water and perform separate washing in the auxiliary washing space 820*a*.

A plurality of rubbing protrusions 727 may be formed in the bottom part 824 and the side part 826 to increase frictional force with laundry upon manual washing such that dirt is easily washed from the laundry.

The auxiliary washing unit 820 may include an auxiliary drain 830. The auxiliary drain 830 may be provided in the shape of a hole in the side part 826. Washing water stored in the auxiliary washing space 820*a* may be discharged through the auxiliary drain 830 when the auxiliary washing unit 820 pivots. However, the shape of the auxiliary drain 830 is not limited to the above-described shape.

The auxiliary washing unit 820 may include a seating flange 832. The seating flange 832 may be formed along the upper end of the auxiliary washing unit 820 so that the auxiliary washing unit 820 can be seated on the main body 801. The main body 801 may include a seating part on which the seating flange 832 can be seated.

The auxiliary washing unit 820 may include a water inlet 834 corresponding to the auxiliary water supply opening 60 in order to flow washing water supplied from the auxiliary water supply opening 60 to the auxiliary washing unit 820. The water inlet 834 may be formed as a recession in the upper end of the side part 826 defining the auxiliary washing space 820*a*. However, the present invention is not limited thereto, and the water inlet 834 may have any shape with which washing water supplied through the auxiliary water supply opening 60 is not interfered with by the side part 826 of the auxiliary washing unit 820.

Figure 27:
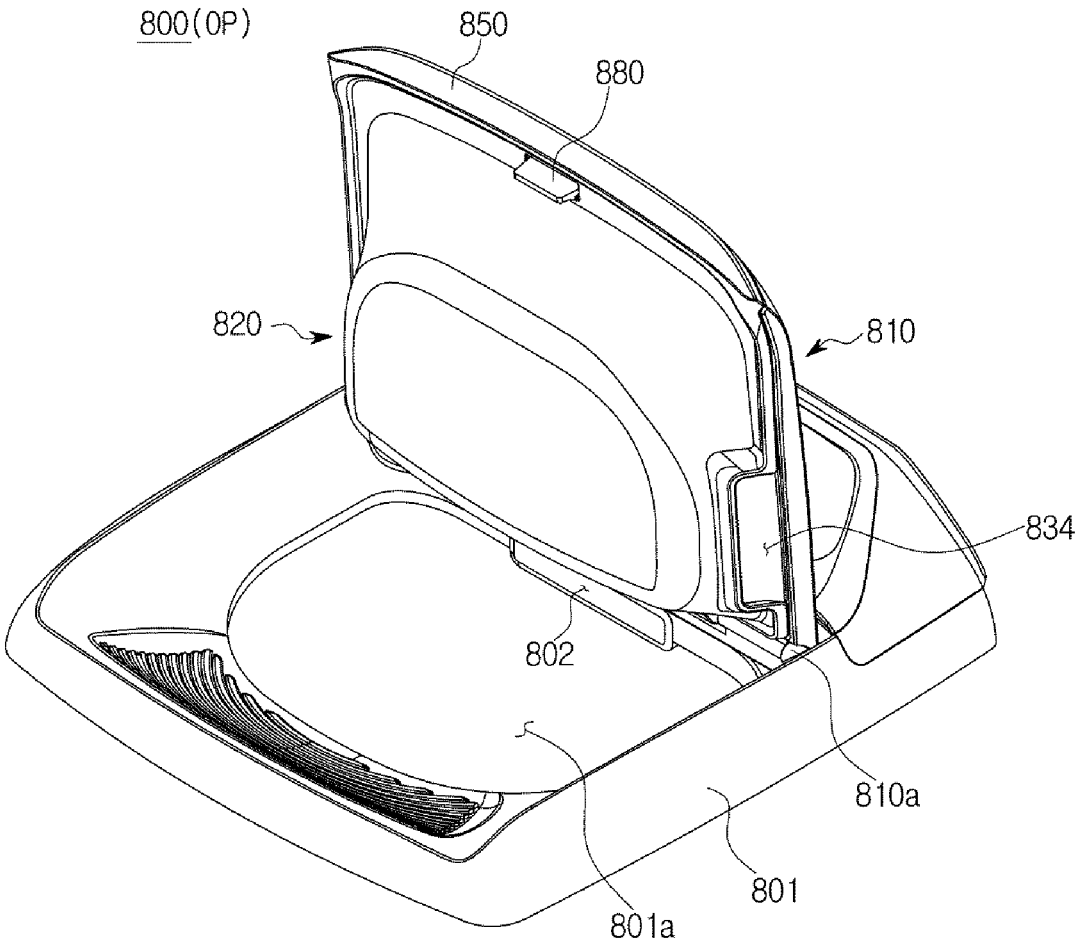
FIG. 27 is a perspective view showing an opened state of the door assembly according to the ninth embodiment.
Figure 28:
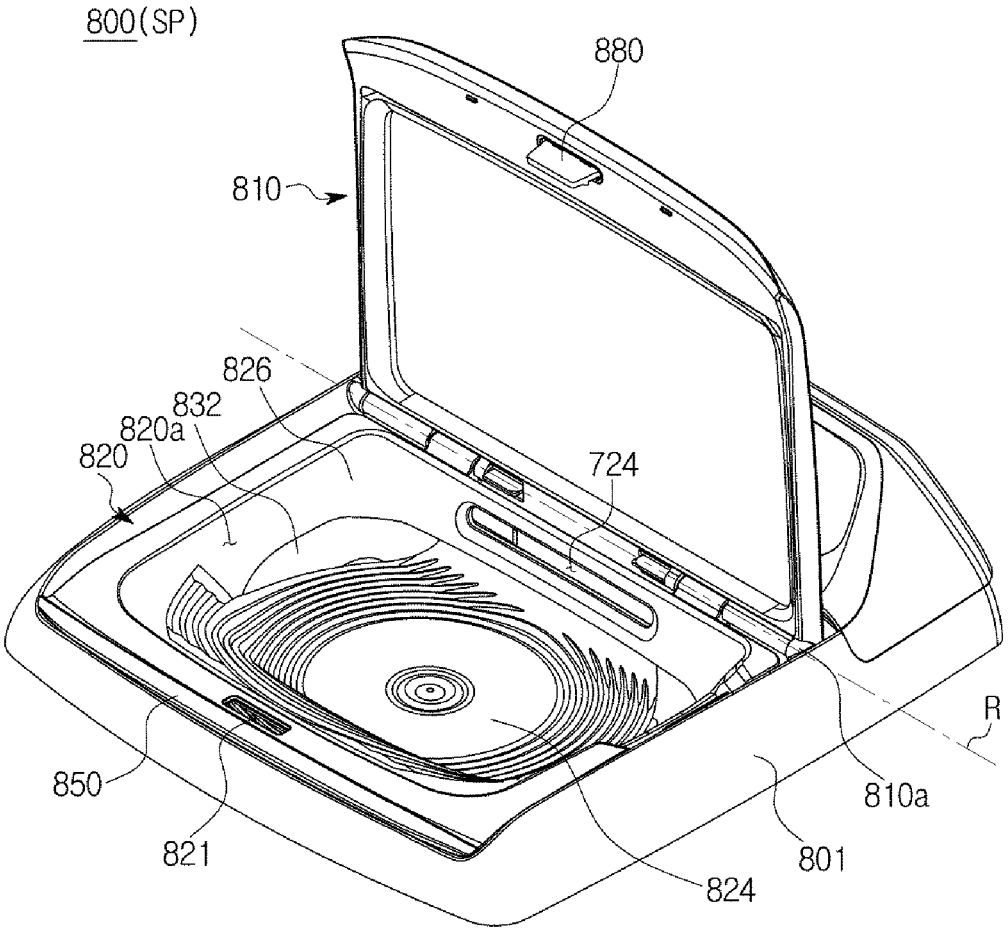
FIG. 28 is a perspective view showing the door assembly according to the ninth embodiment in an auxiliary washing position.

FIG. 27 is a perspective view showing an opened state of the door assembly 800 according to the ninth embodiment, and FIG. 28 is a perspective view showing the door assembly 800 according to the ninth embodiment that is at the auxiliary washing position SP.

Referring to FIGS. 27 and 28, the door 810 and the auxiliary washing unit 820 of the door assembly 800 according to the ninth embodiment may be pivotable with respect to the main body 801. The pivot axis of the door 810 and the pivot axis of the auxiliary washing unit 820 may be aligned on the same side so that the door 810 and the auxiliary washing unit 820 can be opened and closed in the same direction. For example, the door 810 and the auxiliary washing unit 820 may be pivotable about the same pivot axis R.

As shown in FIG. 26, the auxiliary washing unit 820 may include an auxiliary pivot part 840 protruding toward the pivot axis, and an insertion part 816 corresponding to the auxiliary pivot part 840 may be formed in one side of the door 810. The auxiliary pivot part 840 may be pivotably inserted into the insertion part 816 such that the pivot axis of the auxiliary washing unit 820 is the same as the pivot axis of the door 810.

Like the door assembly 100 shown in FIGS. 2 and 3, the door assembly 800 shown in FIGS. 25 to 28 may be located at the closed position CP, the auxiliary washing position SP, or the opened position OP. The closed position CP is a position at which the door 810 and the auxiliary washing unit 820 are disposed over the opening 801*a* to cover the opening 801*a*. The auxiliary washing position SP is a position at which the door 810 pivots from the closed position CP about the pivot axis R to be opened, and the opening 801*a* is covered by the auxiliary washing unit 820 so that a user can perform manual washing in the auxiliary washing unit 820. The opened position OP is a position at which the door assembly 800 opens the opening 801*a* so that a user can insert laundry through the opening 801*a*.

The user may position the door assembly 80 at the auxiliary washing position SP and perform manual washing only when auxiliary washing is needed.

Since the front-back width W1 of the door 810 is shorter than the front-back width W2 of the auxiliary washing unit 820 including the handle part 850, the user may manipulate the handle part 850 to pivot the door assembly 800 when the door assembly 800 is at the closed position CP so that both the door 810 and the auxiliary washing unit 820 pivot about the pivot axis R and the door assembly 800 can be located at the opened position OP.

When no manual washing is needed, the user may manipulate the handle part 850 to pivot the door assembly 80 about the pivot axis R in one direction so as to position the door assembly 800 at the closed position CP or the opened position OP. When manual washing is needed, the user may pivot only the auxiliary washing unit 820 about the pivot axis R in another direction when the door assembly 800 is at the opened position OP so as to position the door assembly 800 at the auxiliary washing position SP.

The door assembly 800 may include a locking part for locking the door 810 with the auxiliary washing unit 820 so that the door 810 is not separated from the auxiliary washing unit 820 when the door assembly 800 is at the opened position OP. Hereinafter, a locking part for locking the door 810 with the auxiliary washing unit 820 will be described.

Figure 29:
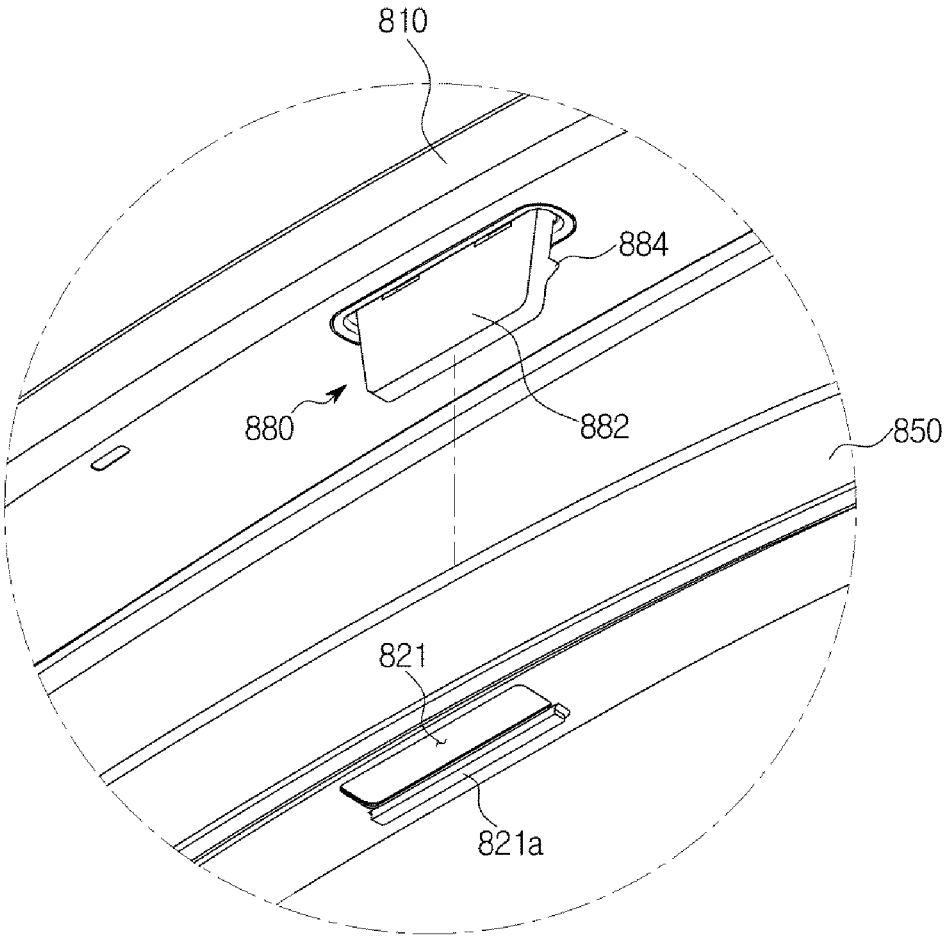
FIG. 29 is a perspective view showing a locking part of the door assembly according to the ninth embodiment.
Figure 30A:
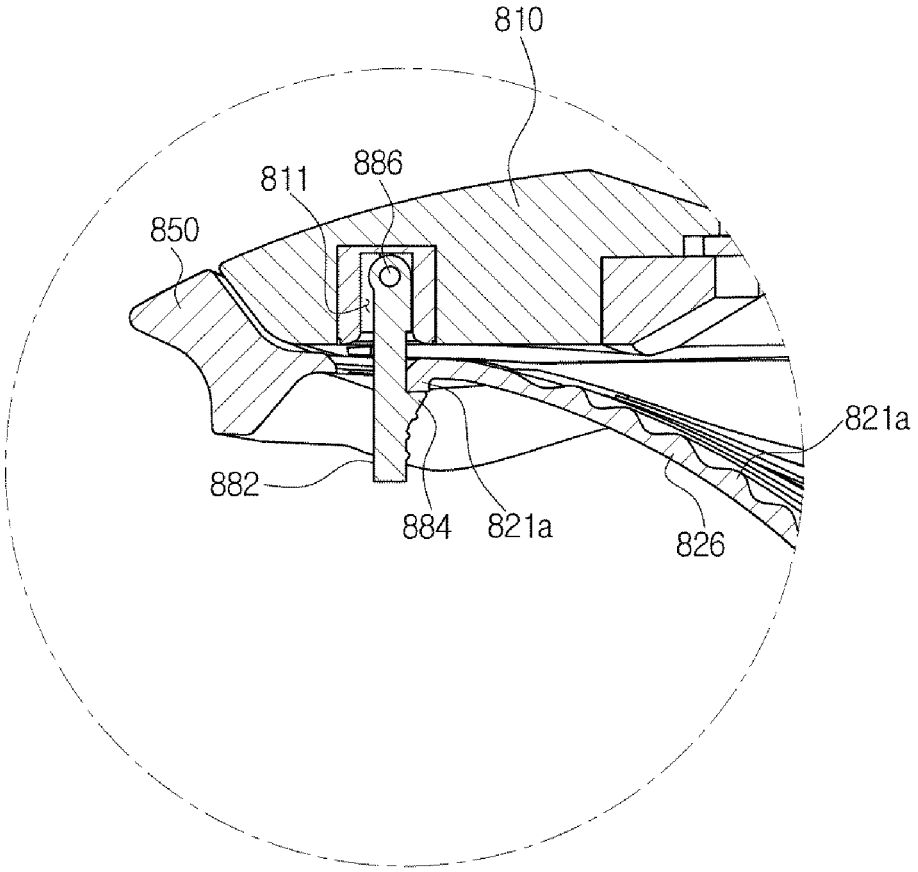
FIG. 30A is a cross-sectional view showing a locked state of the door assembly according to the ninth embodiment.
Figure 30B:
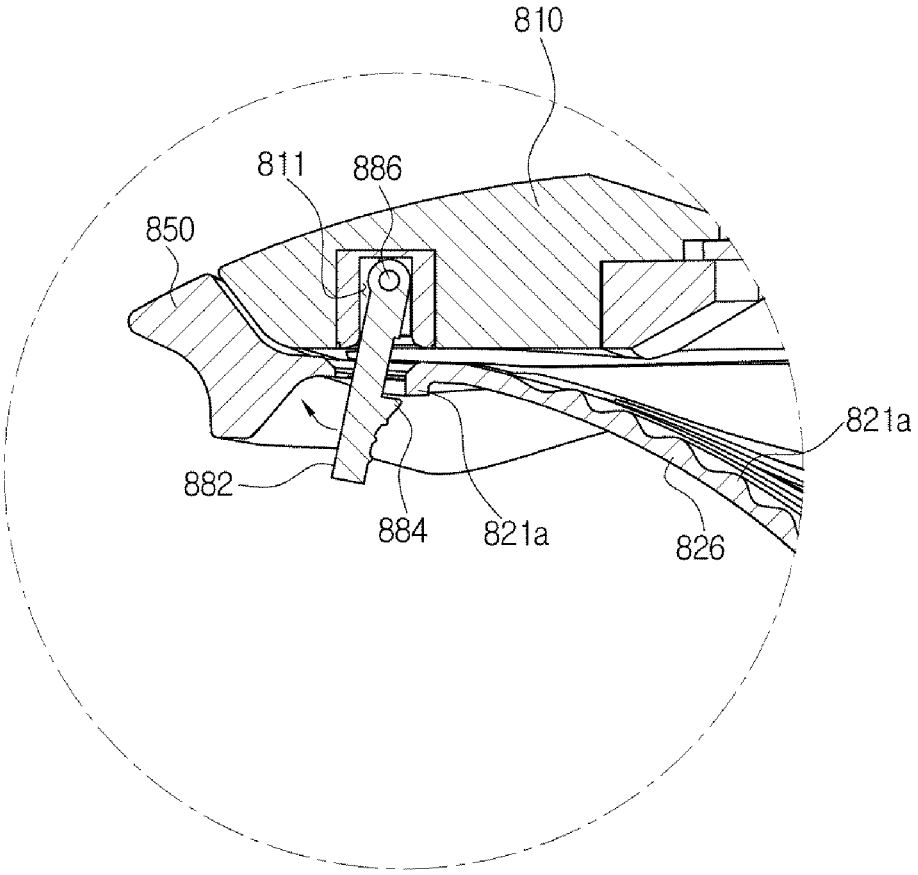
FIG. 30B is a cross-sectional view showing an unlocked state of the door assembly according to the ninth embodiment.

FIG. 29 is a perspective view showing a locking part of the door assembly 800 according to the ninth embodiment, FIG. 30A is a cross-sectional view showing a locked state of the door assembly 800 according to the ninth embodiment, and FIG. 30B is a cross-sectional view showing an unlocked state of the door assembly 800 according to the ninth embodiment.

Referring to FIGS. 29 to 30B, the door assembly 800 according to the ninth embodiment includes a locking structure for coupling the door 810 to the auxiliary washing unit 820 so that the door 810 is not separated from the auxiliary washing unit 820. For example, a locking part in the shape of a protrusion part may be formed in any one of the door 810 and the auxiliary washing unit 820, and a catching part for catching the locking part may be formed in the other of the door 810 and the auxiliary washing unit 820. The locking part may be released from the catching part according to a user's manipulation. Hereinafter, an embodiment in which the door 810 includes a locking part 880 and the auxiliary washing unit 820 includes a catching part 821*a* will be described.

The locking part 880 may be disposed at one side in front of the door 810. The locking part 880 may include a manipulation part 882 protruding from the lower surface of the door 810, and a protrusion part 884 protruding from one side of the manipulation part 882. The manipulation part 882 may be installed in the door 810 to be pivotable on a pivot shaft 886. An accommodation part 811 for accommodating a part of the manipulation part 882 may be formed in a part of the door 810, and the pivot shaft 886 may be installed in the inner lateral walls of the accommodation part 811.

A through hole 821 through which the locking part 880 can penetrate may be formed in the auxiliary washing unit 820. The catching part 821*a* for catching the protrusion part 884 may protrude below the through hole 821. If the manipulation part 882 penetrates the through hole 821 so that the protrusion part 884 is caught by the catching part 821*a*, the door 810 can be coupled to the auxiliary washing unit 820. This state can be referred to as a locked state of the door assembly 800.

When auxiliary washing is needed, the user may manipulate the manipulation part 882 when the door assembly 800 is at the opened position OP so that the protrusion part 884 is released from the catching part 821*a*. The user may pivot the manipulation part 882 with respect to the pivot shaft 886 so that the protrusion part 884 is released from the catching part 821*a*. Thereby, the locked state of the door assembly 800 may be released so that the door 810 and the auxiliary washing unit 820 can pivot separately. Then, the user may set the auxiliary washing unit 820 on the main body 801 to perform manual washing.

During manual washing or upon completion of manual washing, the user may pivot and press the auxiliary washing unit 820 toward the door 810 so that the protrusion part 884 is caught by the catching part 821*a*. Thus, the door assembly 800 may return to the locked state.

The locking part 880 may further include an elastic member (not shown). The elastic member may press the locking part 880 so that the protrusion part 884 is caught by the catching part 821*a* as long as no external force is applied while the door assembly 800 is at the opened position OP or at the closed position CP. Thereby, the state in which the door 810 is coupled to the auxiliary washing unit 820 can be maintained as long as no external force is applied so that the user can open and close the door assembly 800 conveniently.

When the door assembly 800 is at the closed position CP, the user may manipulate the handle part 850 to pivot the door assembly 800 about the pivot axis R so that the door assembly 800 is at the opened position OP. When manual washing is needed, the user may press the locking part 880 to release the locked state, and lower the auxiliary washing unit 820 toward the main body 801 to perform manual washing. After finishing manual washing, the user may raise the auxiliary washing unit 820 toward the door 810 to put laundry into the main washing space. After putting laundry into the main washing space, the user may lower the door assembly 800 so as to position the door assembly 800 at the closed position CP to perform washing.

In the state in which the door assembly 800 is locked by the locking part as described above, the door 810 may be coupled to the auxiliary washing unit 820 to pivot together with the auxiliary washing unit 820, and in the state in which the door assembly 800 is unlocked, the auxiliary washing unit 820 may be pivotable separately from the door 810. The user can pivot the door 810 and the auxiliary washing unit 820 together when manual washing is not needed, and unlock the door assembly 800 to position the door assembly 800 at the auxiliary washing position SP and perform manual washing only when manual washing is needed.

Figure 31:
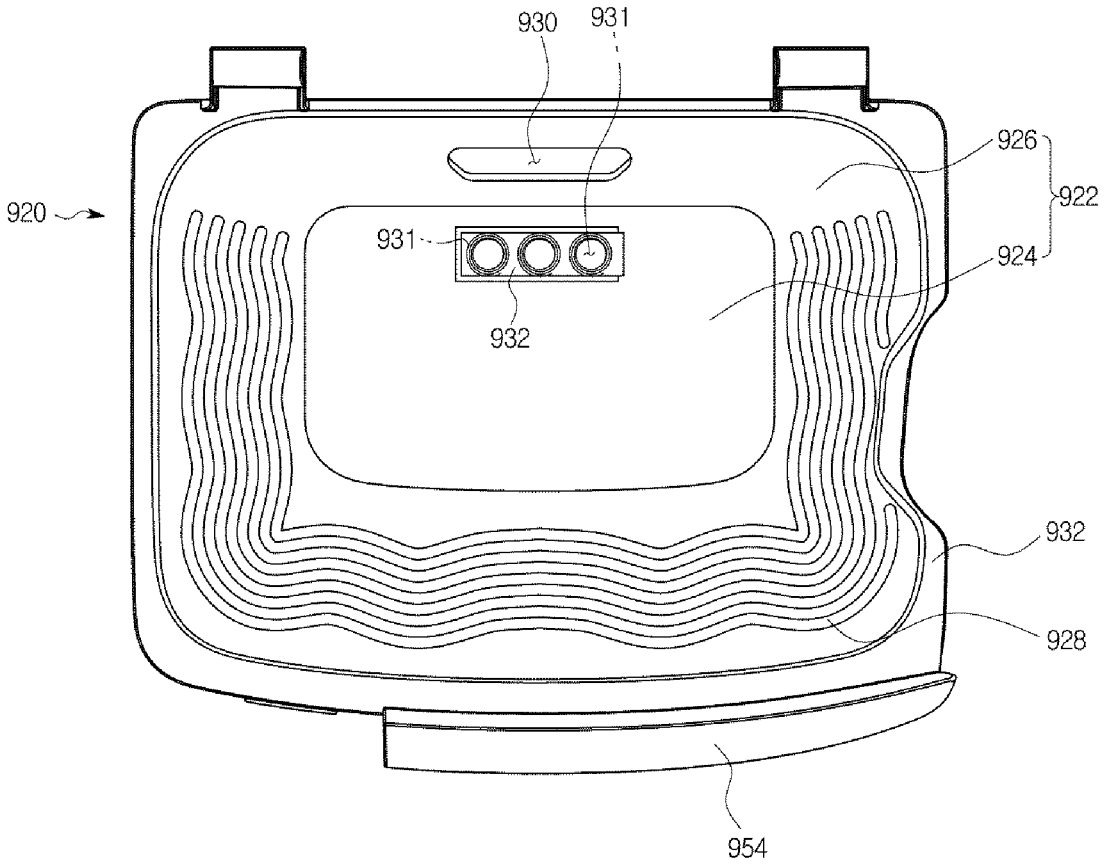
FIG. 31 is a top view of an auxiliary washing unit according to a tenth embodiment.

FIG. 31 is a top view of an auxiliary washing unit according to a tenth embodiment.

Referring to FIG. 31, an auxiliary washing unit 920 according to the tenth embodiment includes a unit body 922 composed of a bottom part 924 and a side part 926. The side part 926 may be curved toward the bottom part 924. Rubbing protrusions 928 may be formed in the unit body 922 in order to facilitate auxiliary washing. The rubbing protrusions 928 may be in the shape of a plurality of waves or in the shape of a plurality of protrusions. The shapes of the rubbing protrusions 928 are not limited.

A first auxiliary drain 931 may be formed in the bottom part 924, and a second auxiliary drain 930 may be formed in the side part 926. The first auxiliary drain 931 may be opened and closed by a sliding cover 932. The first auxiliary drain 931 may be opened and closed by the sliding cover 932 according to a user's convenience. For example, when a user wants to perform manual washing in the state in which water is stored in the auxiliary washing unit 920, the user may slide the sliding cover 932 to close the first auxiliary drain 931. Also, in order to prevent water from scattering during manual washing, the user may slide the sliding cover 932 to open the first auxiliary drain 931. When manual washing is performed in the state in which water is stored in the auxiliary washing unit 920, water overflowing from the second auxiliary drain 930 formed in the side part 926 can be discharged to the main washing space.

A flow path guide 931*a* formed in a spiral pattern may be formed around the second auxiliary drain 930. Through the flow path guide 931*a*, water can be easily discharged from the auxiliary washing unit 920.

A soap case or a brush cradle may be further provided in the auxiliary washing unit 920 in order to increase a user's convenience.

Although specific embodiments have been described above, the present invention is not limited to these embodiments, and it will be apparent to those skilled in the art that various modifications and variations can be made without departing from the gist of the technical idea of the appended claims.

Hereinafter, a washing machine according to an eleventh embodiment will be described.

Configurations of the present embodiment that are the same as those of the previous embodiments will not be described again.

Figure 32:
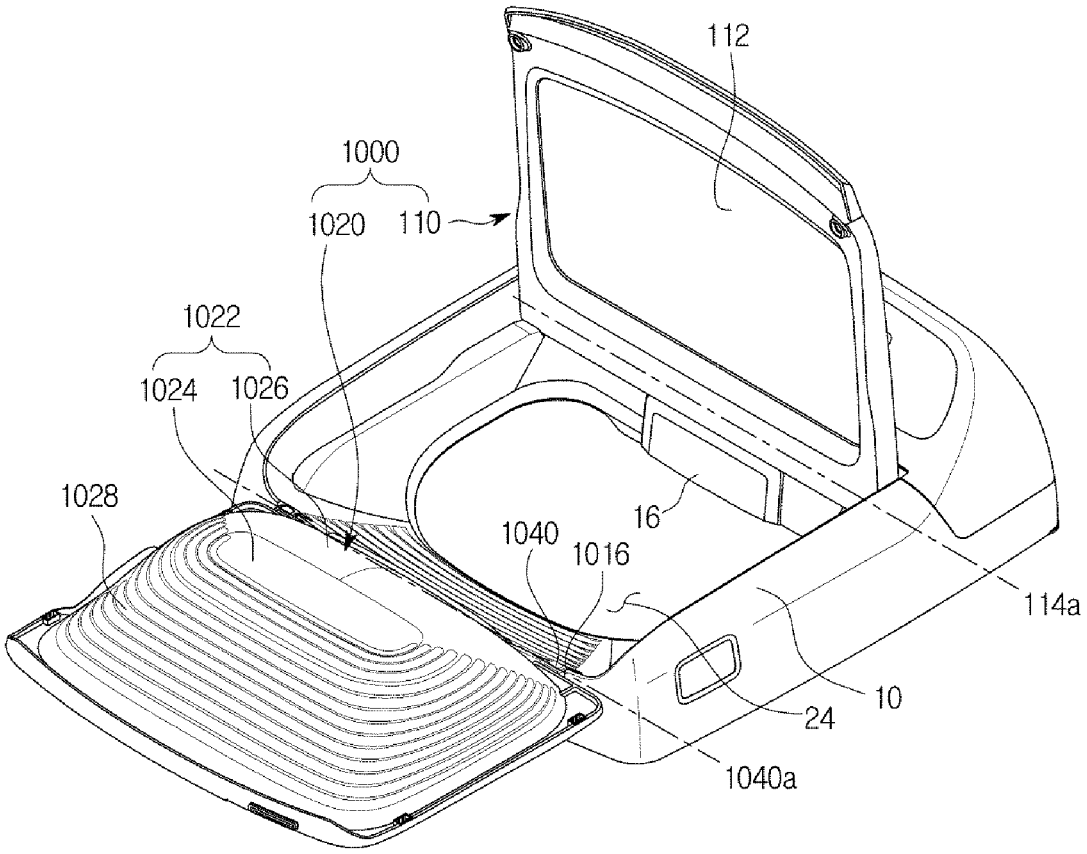
FIGS. 32 and 33 are views for describing a door assembly of a washing machine according to an eleventh embodiment and operations of the door assembly.
Figure 33:
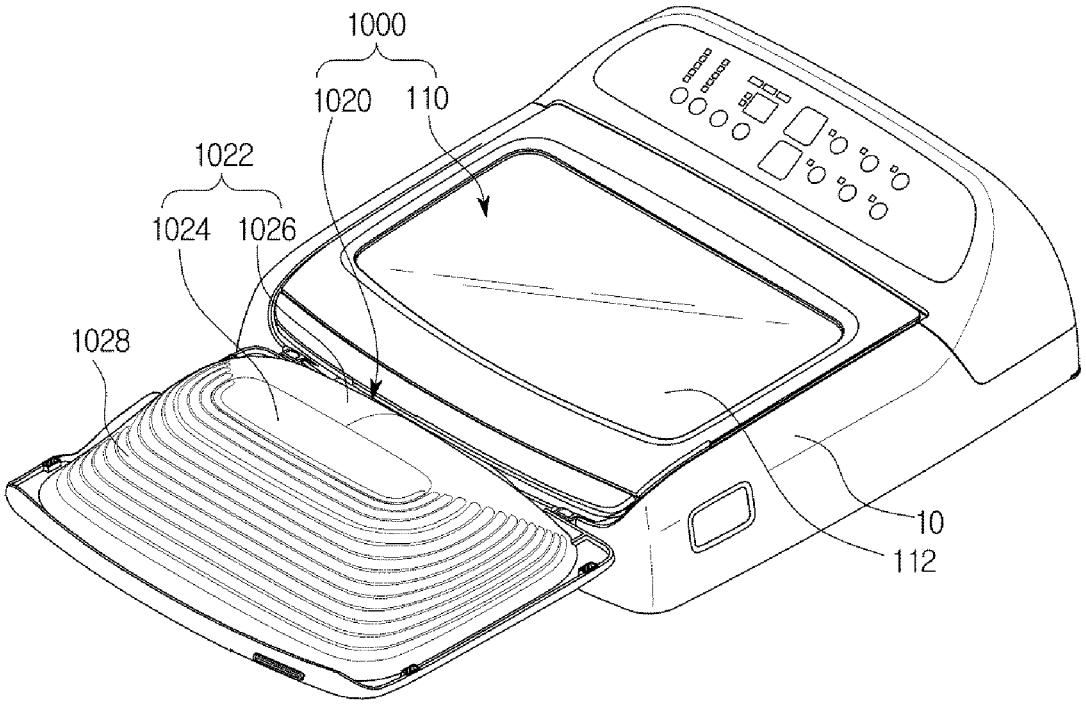

FIGS. 32 and 33 are views for describing a door assembly of the washing machine according to the eleventh embodiment and operations of the door assembly.

Configurations of the present embodiment that are the same as those of the first embodiment will not be described again.

A door assembly 1000 may include a door 110 and an auxiliary washing unit 1020.

The auxiliary washing unit 1020 may include a unit body 1022 composed of a bottom part 1024 and a side part 1026.

The door 110 and the auxiliary washing unit 1020 are each pivotable with respect to the main body 10.

The door 110 may be pivotable about the door pivot axis 114*a*, and the auxiliary washing unit 1020 may be pivotable about an auxiliary pivot axis 1040*a*.

In this embodiment, the door pivot axis 114*a* and the auxiliary pivot axis 1040*a* are at different positions with respect to an opening 104. That is, the door 110 and the auxiliary washing unit 1020 are pivotable in different directions. In the current embodiment, the door pivot axis 114*a* and the auxiliary pivot axis 1040*a* are spaced in parallel so that the door 110 can pivot with respect to the main body 10 in a front-back direction toward the back of the main body 10, and the auxiliary washing unit 1020 can pivot with respect to the main body 10 in the front-back direction toward the front of the main body 10.

The auxiliary washing unit 1020 includes an auxiliary pivot part 1040.

The auxiliary pivot part 1040 may protrude from the unit body 1022 so that the auxiliary pivot axis 1040*a* is spaced from the unit body 1022. Through this configuration, it is possible to increase the rotational radius of the auxiliary washing unit 1020 and to prevent the unit body 1022 from being caught by the door 110 or the main body 10 when the auxiliary washing unit 1020 pivots.

An insertion part 1016 may be formed in one side of the main body 10 in a concave shape in which the auxiliary pivot part 1040 of the auxiliary washing unit 1020 can pivot.

Through the configuration of this embodiment, since the door 110 and the auxiliary washing unit 1020 can pivot in different directions, a user can open and close the door 110 even when the auxiliary washing unit 1020 pivots in a direction to open the opening 104. That is, the auxiliary washing unit 1020 and the door 110 can pivot independently.

Hereinafter, a washing machine according to a twelfth embodiment will be described.

Configurations of the present embodiment that are the same as those of the previous embodiments will not be described again.

Figure 34:
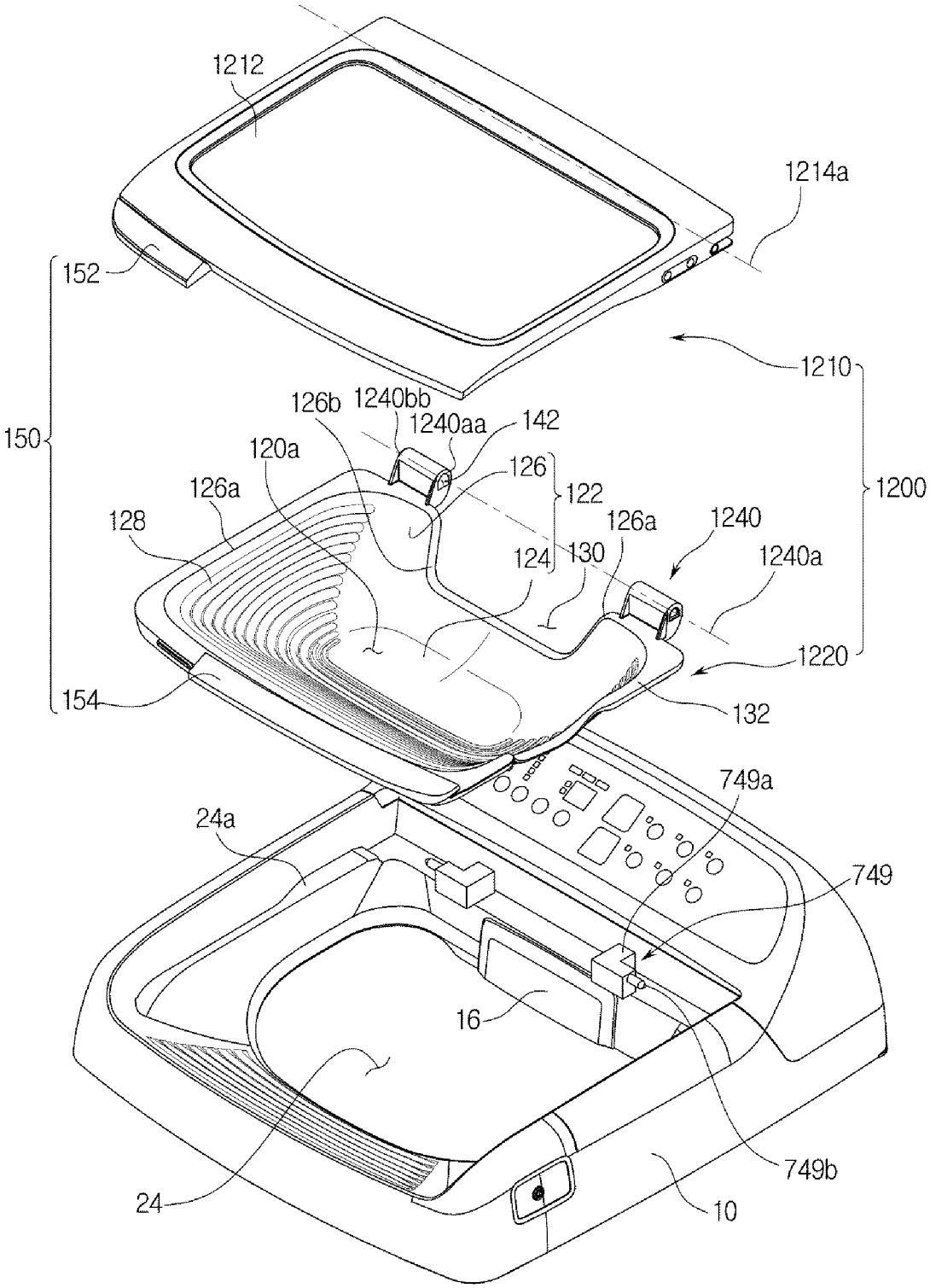
FIG. 34 is an exploded perspective view of a door assembly according to a twelfth embodiment.
Figure 35:
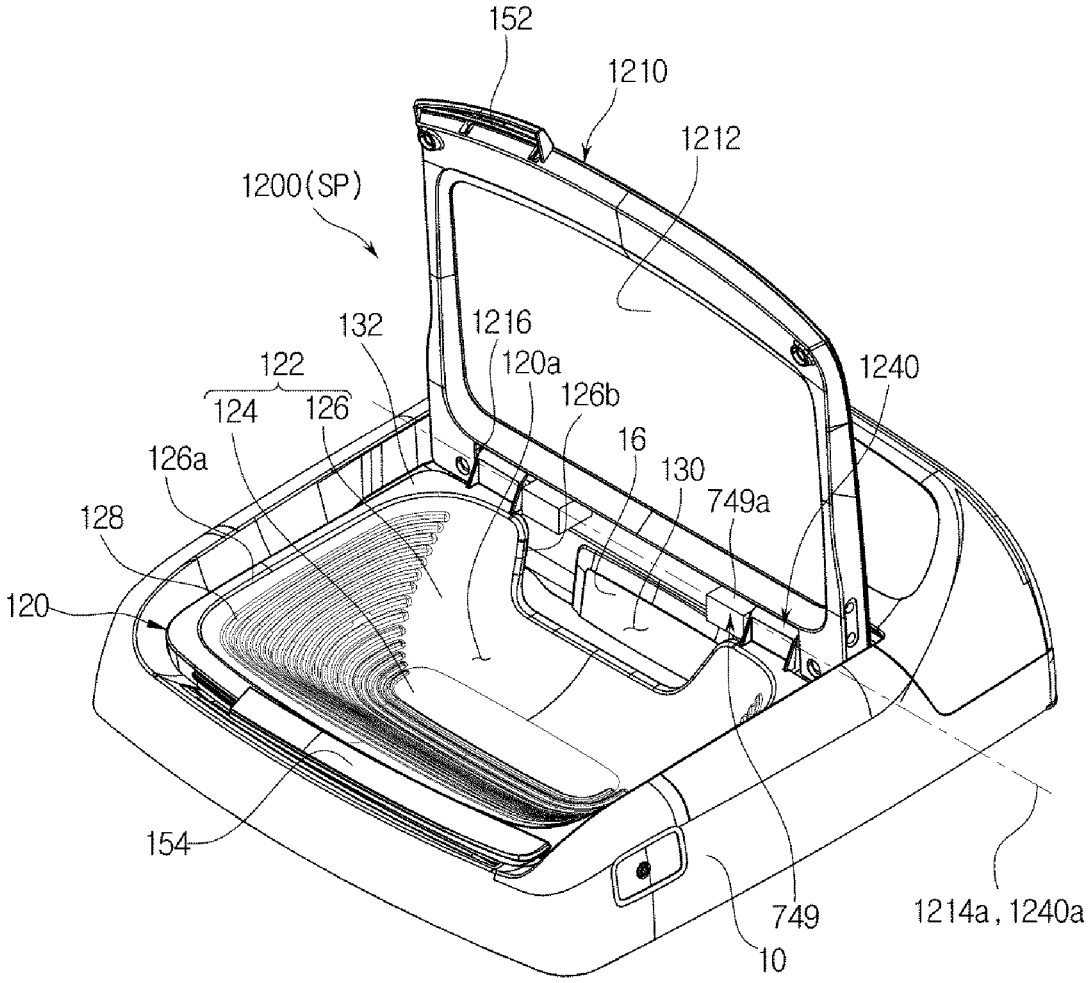
FIG. 35 is a perspective view of the door assembly according to the twelfth embodiment.

FIG. 34 is an exploded perspective view of a door assembly according to the twelfth embodiment, and FIG. 35 is a perspective view of the door assembly according to the twelfth embodiment.

In this embodiment, a washing machine to which a door assembly may be pivotably coupled in a different way from the first embodiment will be described.

In the door assembly 1200, a door 1210 may be pivotable with respect to an auxiliary washing unit 1220, and the auxiliary washing unit 1220 may be pivotable with respect to the main body 10.

In order for the auxiliary washing unit 1220 to pivot with respect to the main body 10, the auxiliary washing unit 1220 may be connected to the main body 10 to be pivotable about a first pivot axis, and in order for the door 1210 to pivot with respect to the main body 10, the door 1210 may be connected to the auxiliary washing unit 1220 to be pivotable about a second pivot axis. Herein, the first pivot axis is referred to as an auxiliary pivot axis 1240*a*, and the second pivot axis is referred to as a door pivot axis 1214*a*.

The auxiliary washing unit 1220 and the door 1210 may also be referred to as a first door 1220 and a second door 1210. The first door 1220 may include at least one door-main body coupling part 1240*aa* that is hinge-coupled to the main body 10, and at least one door-door coupling part 1240*bb* that is hinge-coupled to the second door.

The first door-main body coupling part 1240*aa* may be one side of an auxiliary pivot part 1240 of the auxiliary washing unit 1220, which corresponds to the auxiliary hinge 749 (see the seventh embodiment).

The door-door coupling part 1240*bb* may be the other side of the auxiliary pivot part 1240 of the auxiliary washing unit 1220, which corresponds to the insertion part 116 (see the first embodiment) of the door 110. In the current embodiment, the one side of the auxiliary pivot part 1240 may be provided as the first door-main body coupling part 1240*aa*, and the other side of the auxiliary pivot part 1240 may be provided as the first door-door coupling part 1240*bb*, however, the first door-main body coupling part 1240*aa* and the first door-door coupling part 1240*bb* may be provided as separate components.

The second door 1210 may include at least one second door-door coupling part 1216 that is hinge-coupled to the first door-door coupling part 1240*bb*. The second door-door coupling part 1216 may be the insertion part 116 of the door 110, like the first embodiment.

A reference numeral 1212 may be a transparent member as described above. Also, reference numerals 749, 749*a*, and 749*b* may be the auxiliary hinge 749, the auxiliary hinge body 749*a*, and the auxiliary hinge shaft 749*b*, respectively, as described above in the seventh embodiment.

It will be apparent to those skilled in the art that various modifications and variations can be made in the present invention without departing from the spirit or scope of the inventions. Thus, it is intended that the present invention cover the modifications and variations of this invention provided they come within the scope of the appended claims and their equivalents.

What is claimed is:

1. A washing machine comprising:

a main body having an opening through which to receive laundry into the washing machine; and a door assembly disposed over the opening, wherein the door assembly includes:

a door configured to open and close the opening, an auxiliary washing unit disposed under the door, having a size corresponding to the door, and forming an auxiliary washing space configured to contain water and to hold laundry to be hand washed with the contained water, and a locking part configured to lock the door and the auxiliary washing unit together, wherein the auxiliary washing unit includes an auxiliary drain disposed at a rear of the auxiliary washing unit and configured to discharge the contained water when the auxiliary washing unit is tilted by a pivoting of the auxiliary washing unit.

2. The washing machine according to claim 1, wherein the door and the auxiliary washing unit are pivotable with respect to the main body and, when the locking part locks the door and the auxiliary washing unit together, the door and the auxiliary washing unit are pivotable together.

3. The washing machine according to claim 1, wherein the locking part is on one of the door and the auxiliary washing unit, and the door assembly further includes a catching part on the other of the door and the auxiliary washing unit to catch the locking part.

4. The washing machine according to claim 3, wherein the door assembly includes an elastic member pressing the locking part so that the locking part is maintainable in a state in which the locking part is caught by the catching part as long as no external force is applied to the locking part.

5. The washing machine according to claim 3, wherein the locking part is on the door, and the catching part is on the auxiliary washing unit.

6. The washing machine according to claim 5, wherein a through hole is formed in the auxiliary washing unit, and the locking part penetrates through the through hole to be caught by the catching part.

7. The washing machine according to claim 6, wherein the catching part is disposed below the through hole and is configured to catch the locking part penetrating through the through hole.

8. The washing machine according to claim 1, wherein the door assembly includes a handle part configured to move at least one of the door and the auxiliary washing unit.

9. The washing machine according to claim 8, wherein the handle part includes a door handle part on the door, and an auxiliary handle part on the auxiliary washing unit.

10. The washing machine according to claim 9, wherein a length of the auxiliary handle part is longer than a length of the door handle part.

11. The washing machine according to claim 8, wherein the handle part is on the auxiliary washing unit, and the door and the auxiliary washing unit are movable together according to a manipulation of the handle part.

12. The washing machine according to claim 1, wherein the door and the auxiliary washing unit are pivotable about a same pivot axis.

13. The washing machine according to claim 1, wherein the auxiliary washing unit includes an auxiliary water supply opening to supply the water to the auxiliary washing space.

14. The washing machine according to claim 1, further comprising:

a main washing space provided in the main body, wherein, when the door opens the opening while the door and the auxiliary washing unit are not locked together by the locking part, the auxiliary washing unit allows laundry held in the auxiliary washing space to be manually washed independently of laundry that is washed in the main washing space.

15. The washing machine according to claim 1, wherein the door and the auxiliary washing unit are pivotable with respect to the main body, and when the locking part locks the door and the auxiliary washing unit together, the door and the auxiliary washing unit are pivotable together to open and close the opening.

16. The washing machine according to claim 15, wherein, when a locked state of the locking part is released, the door and the auxiliary washing unit are separately pivotable.

17. The washing machine according to claim 16, wherein the door is pivotable to open and close the opening, the auxiliary washing unit is pivotable to cover and uncover the opening, and when the opening is opened by the door and the auxiliary washing unit is positioned to cover the opening, manual washing is able to be performed in the auxiliary washing space.

18. The washing machine according to claim 1, wherein the door is positioned with respect to the auxiliary washing unit so that, when the door closes the opening, the door covers the auxiliary washing unit.

* * * * *